US010927552B2

(12) United States Patent
Crosier et al.

(10) Patent No.: US 10,927,552 B2
(45) Date of Patent: Feb. 23, 2021

(54) VENEER PANEL AND VENEER CORNER WITH MOUNTING SYSTEMS

(71) Applicant: Stone Creek Products, LLC, Arthur, IL (US)

(72) Inventors: Kevin R. Crosier, Sullivan, IL (US); Chad L. Yoder, Arthur, IL (US); David J. Witbeck, Arthur, IL (US)

(73) Assignee: Stone Creek Products, LLC, Arthur, IL (US)

( * ) Notice: Subject to any disclaimer, the term of this patent is extended or adjusted under 35 U.S.C. 154(b) by 0 days.

(21) Appl. No.: 16/792,097

(22) Filed: Feb. 14, 2020

(65) Prior Publication Data

US 2020/0263436 A1 Aug. 20, 2020

Related U.S. Application Data

(60) Provisional application No. 62/889,860, filed on Aug. 21, 2019, provisional application No. 62/806,130, filed on Feb. 15, 2019.

(51) Int. Cl.
*E04F 13/08* (2006.01)
*E04F 13/076* (2006.01)

(52) U.S. Cl.
CPC ..... *E04F 13/0889* (2013.01); *E04F 13/076* (2013.01); *E04F 13/0866* (2013.01)

(58) Field of Classification Search
None
See application file for complete search history.

(56) References Cited

U.S. PATENT DOCUMENTS

| | | | |
|---|---|---|---|
| 4,875,319 | A | 10/1989 | Hohmann |
| 5,379,561 | A | 1/1995 | Saito |
| 5,956,920 | A | 9/1999 | Davis |
| 6,430,885 | B1 | 8/2002 | Ito |
| 6,874,290 | B1 | 4/2005 | Bokan |
| 7,007,436 | B1 | 3/2006 | Kelley |
| 7,121,051 | B2 | 10/2006 | Hunsaker |
| 7,278,244 | B1 | 10/2007 | Rubio |
| 7,325,366 | B1 | 2/2008 | Hohmann, Jr. et al. |
| 8,096,090 | B1 | 1/2012 | Hohmann, Jr. et al. |
| 8,443,556 | B2 | 5/2013 | Hiscock et al. |
| 8,726,597 | B2 | 5/2014 | Hohmann, Jr. |

(Continued)

FOREIGN PATENT DOCUMENTS

| | | |
|---|---|---|
| CA | 2319858 A1 | 6/2001 |
| CA | 2815508 A1 | 9/2014 |

(Continued)

OTHER PUBLICATIONS

Globalspec, Push on Fasteners Information. IEEE, retrieved online at: https://www.globalspec.com/learnmore/mechanical_compounds/mechanical_fasteners/push_fasteners. 2 pages, (2019).

(Continued)

*Primary Examiner* — Joshua K Ihezie
(74) *Attorney, Agent, or Firm* — McCarter & English, LLP; Jonathan M. Sparks; Wendy Thai

(57) ABSTRACT

The invention provides a veneer panel for use on a surface of a building. The veneer panel can be fabricated with a mounting system that includes a frame and/or a backing for efficient installation on a building surface, as well as a mounting strip or mating connector that can be installed on a building surface to further support the veneer panel.

20 Claims, 32 Drawing Sheets

(56) References Cited

U.S. PATENT DOCUMENTS

| | | | |
|---|---|---|---|
| 8,782,988 | B2 | 7/2014 | Wolf et al. |
| 9,038,341 | B2 | 5/2015 | Lam et al. |
| 9,038,350 | B2 | 5/2015 | Hohmann, Jr. |
| 9,085,908 | B2 | 7/2015 | Desch nes |
| 9,145,695 | B2 | 9/2015 | Ciuperca |
| 9,309,677 | B1 | 4/2016 | Anic |
| 9,464,442 | B1 | 10/2016 | Olczyk et al. |
| 9,587,398 | B1 | 3/2017 | Attebery, II |
| 9,593,490 | B2 | 3/2017 | Anic |
| 9,677,283 | B2 | 6/2017 | Attebery |
| 9,708,817 | B2 | 7/2017 | Gestetner |
| 9,856,642 | B2 | 1/2018 | Ukrainetz |
| 9,903,124 | B2 | 2/2018 | Wolf et al. |
| 10,151,117 | B2 | 12/2018 | Kuelker |
| 10,329,775 | B2 | 6/2019 | Wolf et al. |
| 10,378,216 | B2 | 8/2019 | Wolf et al. |
| 10,557,273 | B2 | 2/2020 | Wolf et al. |
| 2003/0170093 | A1 | 9/2003 | Janeway |
| 2004/0065035 | A1 | 4/2004 | De Vlam |
| 2007/0062083 | A1 | 3/2007 | Lin |
| 2007/0094998 | A1 | 5/2007 | Gomez Insa et al. |
| 2017/0350146 | A1 | 12/2017 | McCary, Sr. |
| 2018/0209154 | A1 | 7/2018 | Ausseur et al. |
| 2019/0301177 | A1 | 10/2019 | Wolf et al. |
| 2020/0123785 | A1 | 4/2020 | Wolf et al. |

FOREIGN PATENT DOCUMENTS

| | | | |
|---|---|---|---|
| CA | 2624627 | C | 12/2014 |
| CA | 2995362 | A1 | 2/2017 |
| CA | 2997058 | A1 | 3/2017 |
| CA | 2865857 | C | 2/2018 |
| EP | 0391737 | A1 | 10/1990 |
| WO | 2017/0027775 | A1 | 2/2017 |
| WO | 2017/186694 | A1 | 11/2017 |

OTHER PUBLICATIONS

Silvermine Stone Company, Tips for Installing Mortarless Stone Veneer Siding. Retrieved online at: https://www.stonedistribution.com/silvermine-stone-company. 6 pages, (2019).

Glen-Gery Stone, Patented StoneFit Wall System with Dryfit Technology. glengary.com, 8 pages, May 2017.

STONEfacade, Architectural Stone Cladding System. Brochure, CertainTeed Corporation, Saint-Gobain. 20 pages, May 2018.

STONEfacade, Architectural Stone Cladding System. Installation Guidelines, CertainTeed Corporation, Saint-Gobain. 14 pages, Nov. 2016.

Waypost, Waypost Installation Instructions, Premium Stone Siding. Installation Guide, www.waypostsiding.com. 4 pages.

FIG. 9B
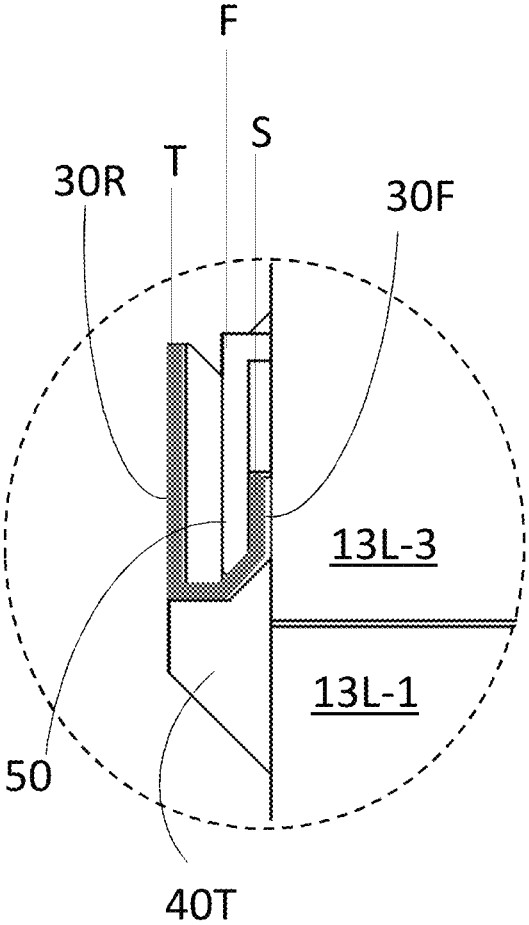
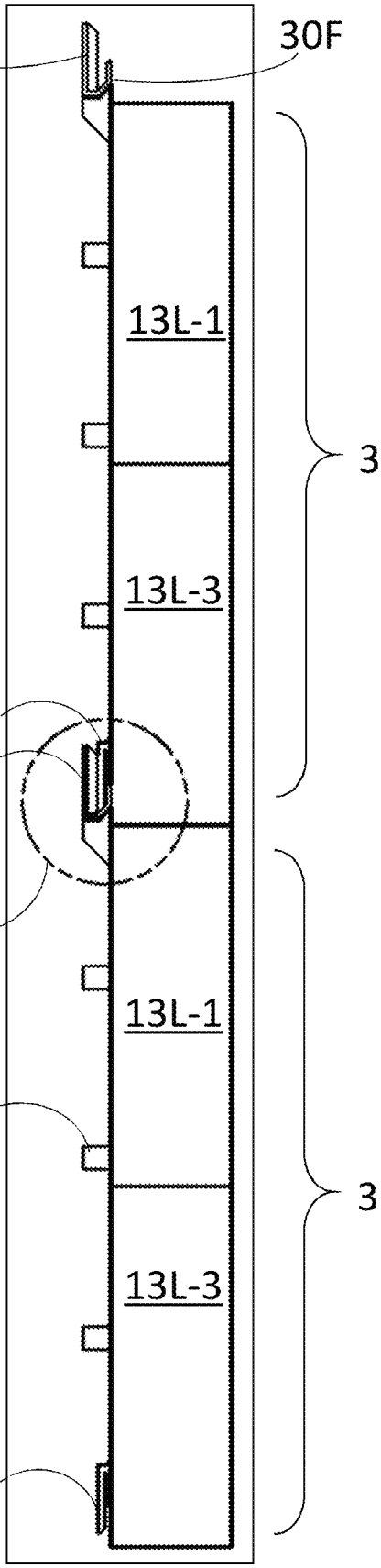
FIG. 9A

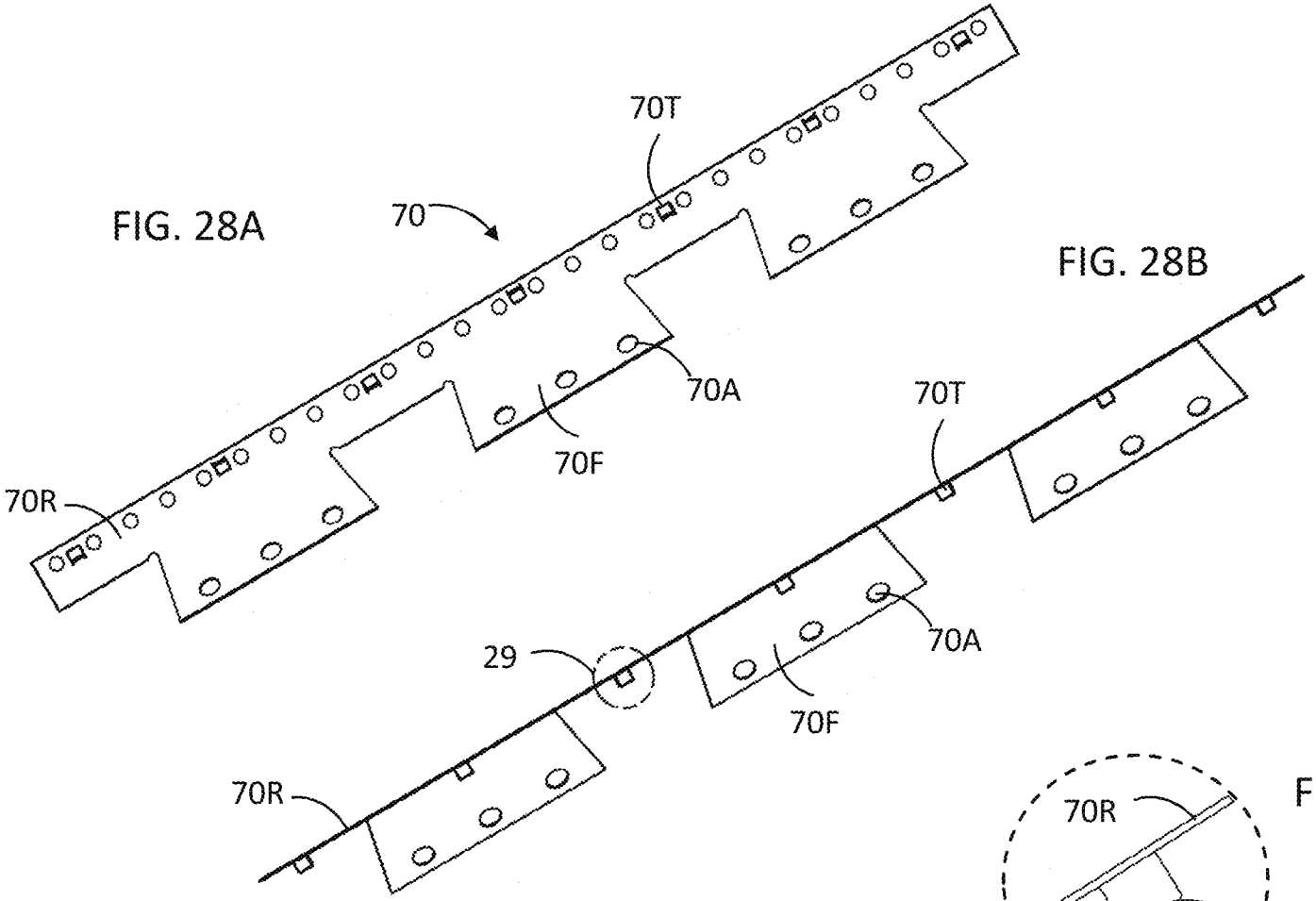
FIG. 28A
FIG. 28B
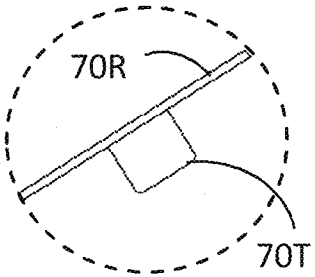
FIG. 29

FIG. 34A
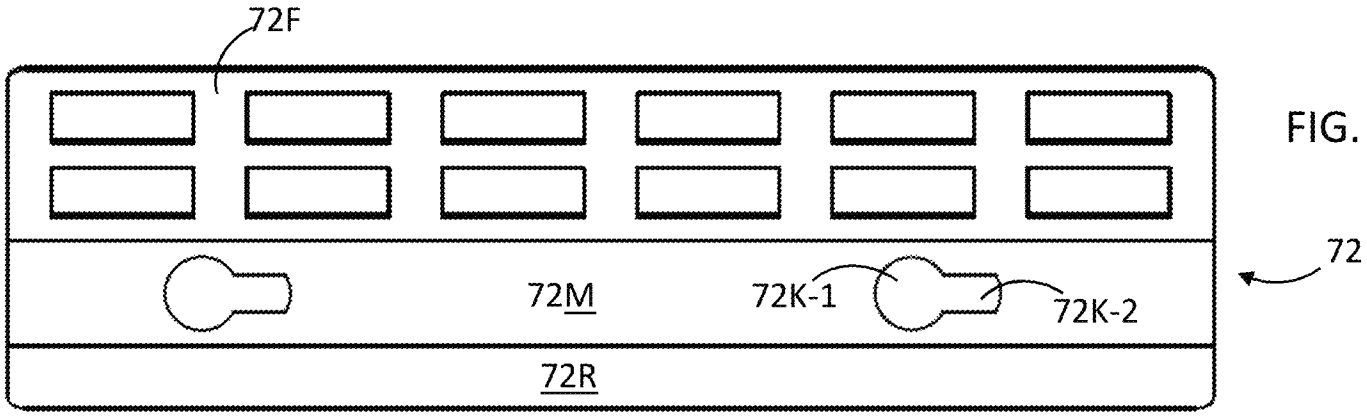
FIG. 34B
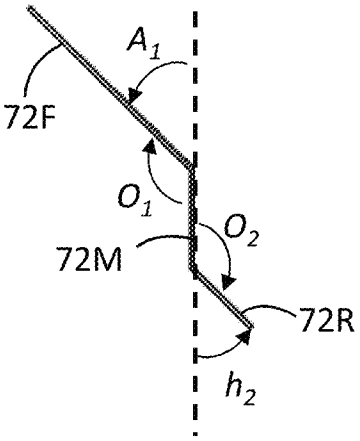
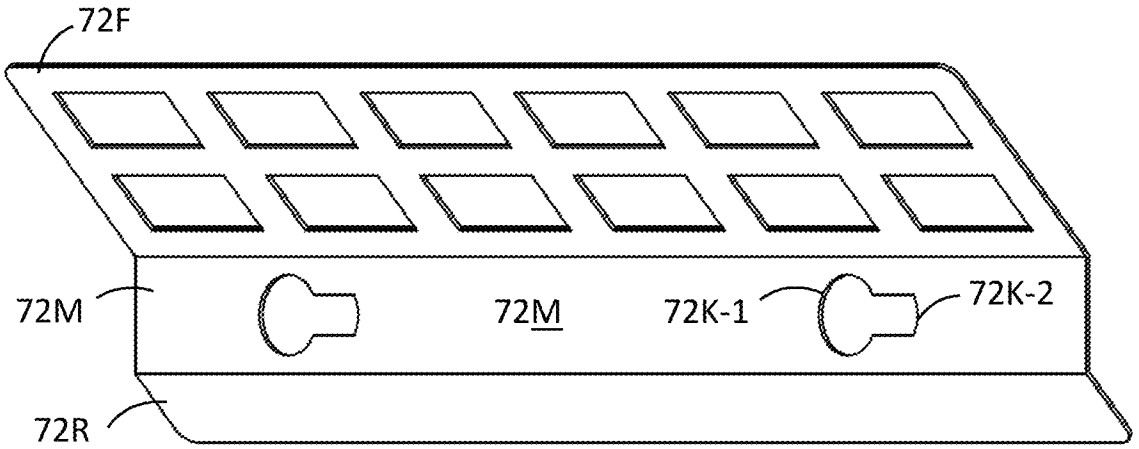
FIG. 34C

VENEER PANEL AND VENEER CORNER WITH MOUNTING SYSTEMS

This application claims priority to U.S. provisional application No. 62/806,130, filed Feb. 15, 2019, and U.S. provisional application No. 62/889,860, filed Aug. 21, 2019, the contents of which are incorporated herein by reference in their entirety.

BACKGROUND

The use of natural stones or building bricks as cladding can greatly enhance the visual appeal and value of a building. However, material costs and labor costs associated with installation of these products can be prohibitive. Prefabricated stone or brick veneer panels offer an alternative to natural stones or building bricks as they provide the look of stones or bricks without the disadvantages of excess weight, costs and laborious installation. Although, installation of pre-fabricated stone or brick veneer panels do not require special masonry skills associated with laying by hand, installation remains a time-consuming and involved process, and the larger sizes of pre-fabricated veneer panels can limit their versatility as a cladding product for harder to fit areas such as edges or corners.

SUMMARY

The invention provides an improved veneer panel with a mounting system for versatile and efficient installation. The veneer panel and mounting system are configured to allow trimming to size as needed on site for ease of installation. The corner panel is configured for use in an inverted orientation for a left or right corner installation on an outside or inside corner.

In one aspect, the invention provides a veneer panel that includes (a) a veneer body having a front face, a rear face and an intermediate thickness therebetween, the intermediate thickness defining a first and a second opposite plane parallel side; and (b) a frame partially embedded in the intermediate thickness of the veneer body, the frame having: (i) an exposed, elongated J-shaped fastening member at the rear edge of the first opposite plane parallel side, the J-shaped fastening member comprising a tall planar rear section, a short planar forward section, and a base section joining the tall planar rear section to the short planar forward section to form a groove, the tall planar rear section comprising a fastening hole for securing the veneer panel to a surface; (ii) an exposed, elongated flange at the bottom edge of the rear face of the veneer body, the flange comprising a plane which is between the plane of the tall planar rear section and the plane of the short planar forward section of the J-shaped fastening member, thereby enabling the flange to rest in the groove of a second J-shaped fastening member above which the veneer panel is mounted; and (iii) a connecting rib connecting the J-shaped fastening member and the flange. The connecting rib has: (a) a rib body section embedded in the intermediate thickness of the veneer body, (b) a first rearward-angled rib end portion connecting an embedded first end of the rib body section and the J-shaped fastening member, (c) a second rearward-angled end portion connecting an embedded second end of the rib body section and the flange, and (d) an exposed orthogonal support member extending rearwardly from the connecting rib, the orthogonal support member comprising a first mating connector of a pair of mating connectors.

In some embodiments, the veneer panel also includes a two-section reinforcement member that has: (a) an exposed reinforcement section secured to the rear of the tall planar rear section of the J-shaped fastening member, the exposed reinforcement section having a second fastening hole that aligns with the first fastening hole on the tall planar rear section of the J-shaped fastening member; and (b) an anchoring fin adjoining the exposed reinforcement section at a first angle, the anchoring fin being embedded within the intermediate thickness of the veneer body, the anchoring fin comprising an opening which comprises veneer body material. In some embodiments, the two-section reinforcement member is secured to the J-shaped fastening member through engagement of a flexural frame connector on the reinforcement member with an undercut or cutout on the J-shaped fastening member. In some embodiments, the flexural frame connector is a foldable tab or a hook.

In some embodiments of a veneer panel of the invention, the tall planar rear section of the J-shaped fastening member has a first plurality of fastening holes.

In some embodiments, the reinforcement section has a second plurality of fastening holes, the second plurality of fastening holes and the first plurality of fastening being similarly spaced such that each hole in the second plurality of holes aligns with a hole in the first plurality of holes.

In some embodiments, the tall planar rear section of the J-shaped fastening member has a plurality of vertically extending ridges effective to maintain clearance between the tall planar rear section of the J-shaped fastening member and a flange resting in the groove of the J-shaped fastening member, each vertically extending ridge separating two or more fastening holes of the plurality of fastening holes.

In some embodiments of a veneer panel of the invention, the first mating connector is a male connector. In some embodiments, the first mating connector is a snap connector that has a notch or a push connector that has a cylindrical head.

In some embodiments of a veneer panel of the invention, the frame has a plurality of connecting ribs, a plurality of orthogonal support members, or a plurality of connecting ribs and a plurality of orthogonal support members. In some embodiments, the frame has two, three or four connecting ribs, and wherein each connecting ribs comprises one, two or three orthogonal support members. In some embodiments, the frame is made using a polymeric material, the two-section reinforcement member is made using a metal, metal alloy or steel, the veneer body is made using concrete, or any combination thereof.

In some embodiments, the veneer body has a first body section and a second body section that adjoin to form a right-angle body corner.

In some embodiments in which the veneer body has a first body section and a second body section, a first flange is attached to the first body section; a second flange is attached to the second body section; or a first flange is attached to the first body section and a second flange is attached to the second body section. In some embodiments, the first flange and the second flange are adjoining sections of an angled flange. In some embodiments in which the veneer body has a first body section and a second body section, the exposed flange has a first flange section and a second flange section, wherein the first flange section and the second flange section adjoin at right angle at bottom rear of the right-angle body corner.

In some embodiments in which the veneer body has a first body section and a second body section, a first J-shaped fastening member is attached to the first body section; a second J-shaped fastening member is attached to the second body section; or a first J-shaped fastening member is attached to the first body section and a second J-shaped fastening member is attached to the second body section. In some embodiments, the first J-shaped fastening member and the second J-shaped fastening members are adjoining sections of an angled J-shaped fastening member. In some embodiments in which the veneer body has a first body section and a second body section, the J-shaped fastening member has a first J-shaped fastening member section and a second J-shaped fastening member section, wherein the first and the second J-shaped fastening member sections adjoin at right angle at the top rear of the right-angle body corner.

In some embodiments in which the veneer body has a first body section and a second body section, the tall planar rear section of the first J-shaped fastening member has a first plurality of fastening holes; the tall planar rear section of the second J-shaped fastening member has a second plurality of fastening holes; or the tall planar rear section of the first J-shaped fastening member has a first plurality of fastening holes, and the tall planar rear section of the second J-shaped fastening member has a second plurality of fastening holes.

In some embodiments in which the veneer body has a first body section and a second body section, a two-section reinforcement member is secured to the first, the second, or both the first and the second J-shaped fastening members, wherein the two-section reinforcement member has: (a) an exposed reinforcement section secured to the rear of the tall planar rear section of the respective J-shaped fastening members, the exposed reinforcement section having a second fastening hole that aligns with the first fastening hole on the respective tall planar rear section; and (b) an anchoring fin adjoining the exposed reinforcement section at a first angle, the anchoring fin being embedded within the intermediate thickness of the veneer body, the anchoring fin having an opening which comprises veneer body material.

In some embodiments in which the veneer body has a first body section and a second body section, the tall planar rear section of the first J-shaped fastening member section has a first plurality of fastening holes; the tall planar rear section of the second J-shaped fastening member section has a second plurality of fastening holes; or the tall planar rear section of the first J-shaped fastening member section has a first plurality of fastening holes, and the tall planar rear section of the second J-shaped fastening member section has a second plurality of fastening holes.

In some embodiments in which the veneer body has a first body section and a second body section, a two-section reinforcement member is secured to the first, the second, or both the first and the second J-shaped fastening member sections, wherein the two-section reinforcement member has: (a) an exposed reinforcement section secured to the rear of the tall planar rear section of the respective J-shaped fastening member sections, the exposed reinforcement section having a second fastening hole that aligns with the first fastening hole on the respective tall planar rear section; and (b) an anchoring fin adjoining the exposed reinforcement section at a first angle, the anchoring fin being embedded within the intermediate thickness of the veneer body, the anchoring fin comprising an opening which comprises veneer body material.

In some embodiments in which the veneer body has a first body section and a second body section, the first body section has a first front face and the second body section has a second front face, and wherein the first front face and the second front face orient in diverging directions thereby forming a veneer corner effective for installation on an outside corner. In some embodiments in which the veneer body has a first body section and a second body section, the first body section has a first front face and the second body section has a second front face, and wherein the first front face and the second front face orient in converging directions thereby forming a veneer corner effective for installation on an inside corner.

In some embodiments of a veneer panel of the invention, the J-shaped fastening member, flange, connecting rib and orthogonal support member are integrally formed parts of the frame.

In another aspect, the invention provides a mounting strip configured for use with a veneer panel of the invention. The mounting strip has at least two mating connectors and a mounting flange with a rear flat side configured to lay flush against a flat surface for securing the mounting strip to the flat surface. The at least two mating connectors of the mounting strip is a male connector and a female connector of a single mating pair, the male connector and the female connector being effective to form a snap-in or push-in joint, and the male and female connectors comprise a central axis perpendicular to the mounting strip. The mounting flange is configured to lay flush against the flat surface for securing the mounting strip to the flat surface, the mounting flange having at least two fastening holes, wherein two of the at least two fastening holes flank opposite side portions of a connector of the at least two mating connectors for securing the mounting strip to the flat surface.

In some embodiments, the mounting strip also has a raised body supporting the female connector in a position offset from the mounting flange, the female connector having a plurality of radial retention tabs cooperating to retain a push-in male connector comprising a cylindrical head.

In another aspect, the invention provides a veneer panel that has: (a) a veneer body having a front face, a rear face and an intermediate thickness therebetween, the intermediate thickness defining a first and a second opposite plane parallel side; (b) a backing attached to the rear face of the veneer body, and (c) a three-section mounting member comprising an anchoring fin embedded within the intermediate thickness of the veneer body, a hanger section for mounting the veneer panel to a vertical surface, and a backing attachment mid-section connecting the anchoring fin and hanger section.

The backing has: (i) raised peripheral edges defining a setting space within which the rear face and a rear portion of the intermediate thickness of the veneer body are disposed, the raised peripheral edges comprising a pair of opposite and parallel peripheral edges; (ii) a first elongated slot through which a three-section mounting member extends from the setting space through the backing to the rear of the backing, the first elongated slot being parallel to and nearer a first peripheral edge of the pair of opposite and parallel peripheral edges; (iii) a mounting member attachment means adjacent the first elongated slot between the first elongated slot and the first peripheral edge that secures the three-section mounting member to the backing; and (iv) an orthogonal support member extending rearwardly from the rear of the backing, the orthogonal support member comprising a first mating connector of a pair of mating connectors.

The three-section mounting member has an anchoring fin, a hanger section, and a backing attachment mid-section connecting the anchoring fin and hanger section is such that: (i) the backing attachment mid-section is secured flush to the backing within the setting space through the mounting member attachment means; (ii) the anchoring fin adjoins the backing attachment mid-section to form a first obtuse structural angle, the anchoring fin extending from the backing attachment mid-section outwardly and upwardly into the veneer body at a first acute angle; and (iii) the hanger section adjoins the backing attachment mid-section to form a second obtuse structural angle, the hanger section extending from the backing attachment mid-section, through the elongated slot, and outwardly and downwardly from the rear of the backing at a second acute angle, wherein the second acute angle is a hanging angle.

In some embodiments of the veneer panel, the second obtuse structural angle and the second acute hanging angle are supplementary angles; and wherein the second acute hanging angle is between about 20 degrees to about 70 degrees. In some embodiments of the veneer panel, the second acute hanging angle is between about 40 degrees to about 50 degrees.

In some embodiments of a veneer panel, the backing further includes: (a) a second elongated slot through which a second three-section mounting member extends from the setting space through the backing into the rear of the backing, the second elongated slot being parallel to and nearer a second peripheral edge of the pair of opposite and parallel peripheral edges; and (b) a second mounting member attachment means adjacent the second elongated slot, between the second elongated slot and the second peripheral edge, that secures the second three-section mounting member to the backing.

In some embodiments of the veneer panel, the first, the second, or each of the first and the second mounting member attachment means has a mating connector that operates through a keyhole on the backing attachment mid-section of the respective three-section mounting member.

In some embodiments, the mating connector has narrow stem portion extending to a wide head portion, and wherein the keyhole has (a) a wide cutout portion dimensioned to fit the wide head portion of the mating connector; and (b) an adjoining narrow cutout portion dimensioned to fit the narrow stem portion of the mating connector to secure the three-section mounting member to the backing.

In some embodiments, the veneer panel is such that: (a) the veneer body includes a primary veneer body section adjoining a secondary veneer body section at right angle to form a two-section veneer body, in which (i) the front face of the veneer body has a primary and a secondary front face section; (ii) the rear face of the veneer body has a primary and a secondary rear face section; and (iii) each of the first and the second opposite plane parallel sides of the veneer body comprises a primary section and a secondary section; and (b) the backing includes a primary backing section adjoining a secondary backing section at right angle to form a two-section backing attached to the rear face of the two-section veneer body, in which: (i) the primary and secondary backing sections has raised peripheral edges thereby providing a setting space within which the rear face and a rear portion of the intermediate thickness of the two-section veneer body are disposed; (ii) the primary backing section comprising the first and the second elongated slots through which the respective three-section mounting member extends from the setting space through the backing to the rear of the backing; (iii) the primary backing section further has the first and the second mounting member attachment means; and (iv) each of the primary and secondary backing sections has the orthogonal support member.

In some embodiments, the primary front face section and the secondary front face section orient in diverging directions thereby forming a veneer panel effective for installation on an outside corner. In other embodiments, the primary front face section and the secondary front face section orient in converging directions thereby forming a veneer panel effective for installation on an inside corner.

In some embodiments, the primary backing section and the secondary backing section each has a plurality of orthogonal support members.

In some embodiments, the first mating connector is a male connector. In some embodiments, the first mating connector is a snap connector that has a notch or a push connector that has a cylindrical head.

In some embodiments, the anchoring fin of the three-section mounting member has a plurality of openings filled with veneer body material.

In some embodiments, the backing is made using a polymeric material, the three-section mounting member is made using a metal, a metal alloy or steel, and the veneer body is made using concrete, or any combination thereof.

In another aspect, the invention provides a three-section mounting member that has an anchoring fin, a hanger section, and a backing attachment mid-section connecting the anchoring fin and hanger section is such that: (a) the backing attachment mid-section is secured flush to the backing within the setting space through the mounting member attachment means; (b) the anchoring fin adjoins the backing attachment mid-section to form a first obtuse structural angle, the anchoring fin extending from the backing attachment mid-section outwardly and upwardly into the veneer body at a first acute angle; and (c) the hanger section adjoins the backing attachment mid-section to form a second obtuse structural angle, the hanger section extending from the backing attachment mid-section, through the elongated slot, and outwardly and downwardly from the rear of the backing at a second acute angle, wherein the second acute angle is a hanging angle.

In another aspect, the invention provides a two-section mounting rail configured for use with a veneer panel of the invention, the two-section mounting rail has: (a) a lower planar wall fastening section comprising a fastening hole; and (b) an upper hanging rail section adjoining the lower wall fastening section at a third obtuse structural angle such that the upper hanging rail section extends upwardly and outwardly from a vertical surface to which the two-section mounting rail is fastened at a third acute angle, wherein the third acute angle is about the same size as the second acute angle. In some embodiments of a two-section mounting rail, the wall fastening section has a plurality of fastening holes. In some embodiments, the two-section mounting rail is constructed of metal, a metal alloy or steel.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Other features and advantages of the invention will be apparent from the following detailed description and from the claims.

BRIEF DESCRIPTION OF THE FIGURES

FIG. 9A-9B are a side view of two stacked veneer panels (9A) and an enlarge view illustrating the flange of one veneer panel resting in the J-shaped fastening member of the veneer panel installed directly below (9B).

FIG. 28A-28B are a perspective view and a top view, respectively, of the two-section reinforcement member of FIG. 26.

FIG. 29 is an enlarged view from the top of the flexural fold-over frame connector shown in FIG. 28.

FIG. 34A-34C are (a) a front side view (from the concrete facing side) of an embodiment of a three-section mounting member for use with the two-section backing shown in FIG. 32; (b) a right side view of the three-section mounting member; and (c) a right perspective view of the three-section mounting member.

DETAILED DESCRIPTION

The invention provides veneer panels having the appearance of stones or bricks that can be efficiently installed on a surface of a building. The invention provides veneer panels that can be installed on a flat surface such as an external or internal wall, veneer panels that can be installed on an outward facing corner such as an outward facing corner of a building, or veneer panels that can be installed in an inward facing corner such as a corner in a room or other fully or partially enclosed space attached to or part of a building.

Figure 11B:
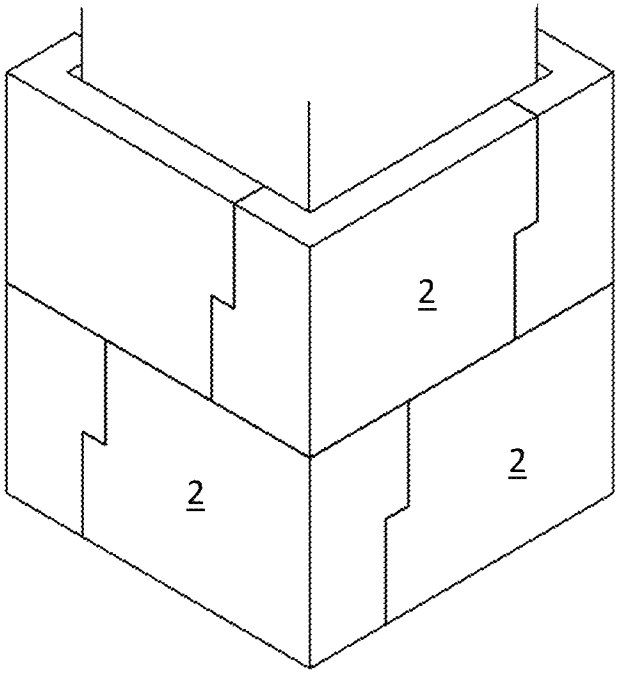
FIG. 11A-11B are perspective views of a veneer corner according to the invention as affixed to a portion of a structure.
Figure 11A:
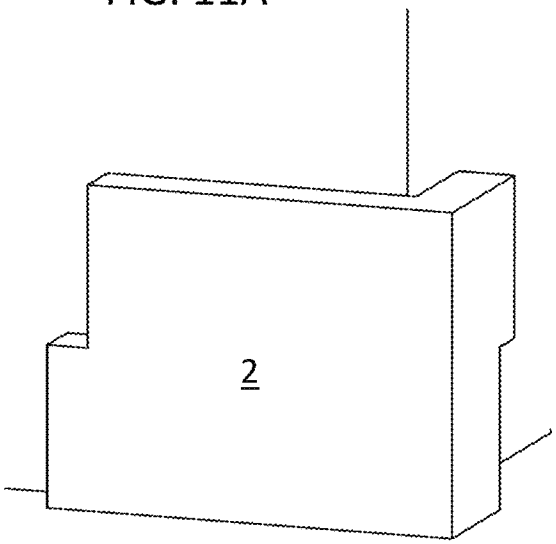

As used herein, the term "veneer panel" refers to (1) a veneer having a single-section body with a generally planar front face and a planar rear face and a thickness therebetween for use on a flat surface, as well as (2) a veneer having two body sections that intersect at an angle to form a two-section body for use in a corner or other angled areas where two building surfaces meet. Where a veneer panel incorporates an angle formed by two body sections, the angle can be about 90 degrees, less than 90 degrees or more than 90 degrees.

Where a veneer panel has two body sections that form an angle, the body sections can be configured with front face sections directed in converging or diverging directions, i.e. towards the same or different spaces, respectively. A veneer panel that has two body sections with front face sections directed in diverging directions, i.e. towards different spaces, can be installed on an exterior corner as illustrated in FIG. 11A-11B. A veneer panel that has two body sections with front face sections directed in converging directions, i.e. towards the same space, can be installed on an inside corner such as a corner in an enclosed or partially enclosed space, for example, a corner in a room or a corner in a porch. A veneer panel having a body structure that incorporates an angle for use where two surfaces of a building intersect can also be referred to as a "veneer corner."

Thus, a veneer panel of the invention can have a generally planar structure with a selected thickness for use on a flat surface, as well as an angled structure for use in or on a corner. The veneer panel and various supporting and mounting systems are generally shown in the figures.

I. Corner-Less Panels

Veneer Panel 1

Figure 1:
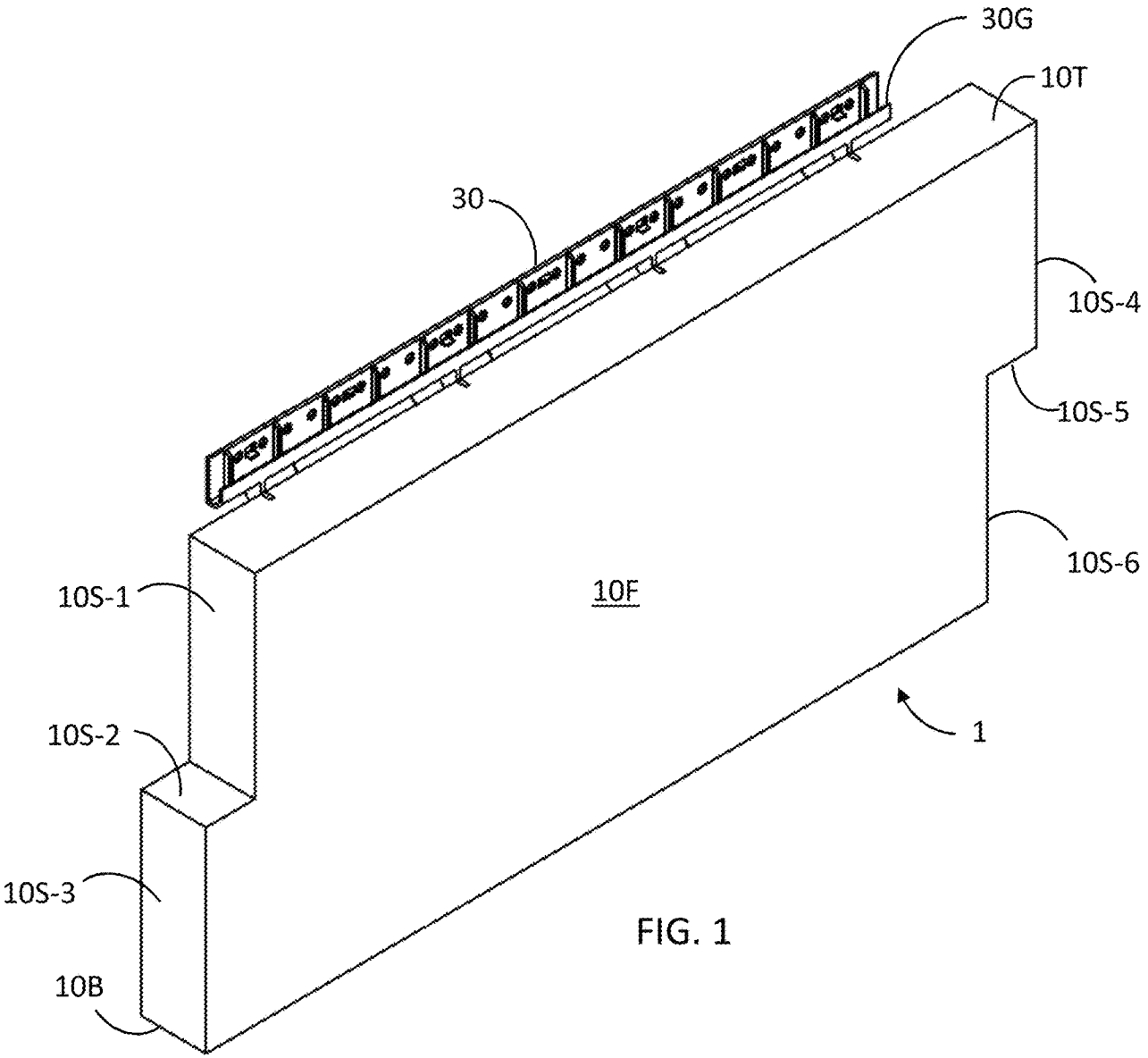
FIG. 1 is a front perspective view of a veneer panel incorporating a molded frame and a two-section reinforcement member according to the invention.
Figure 2:
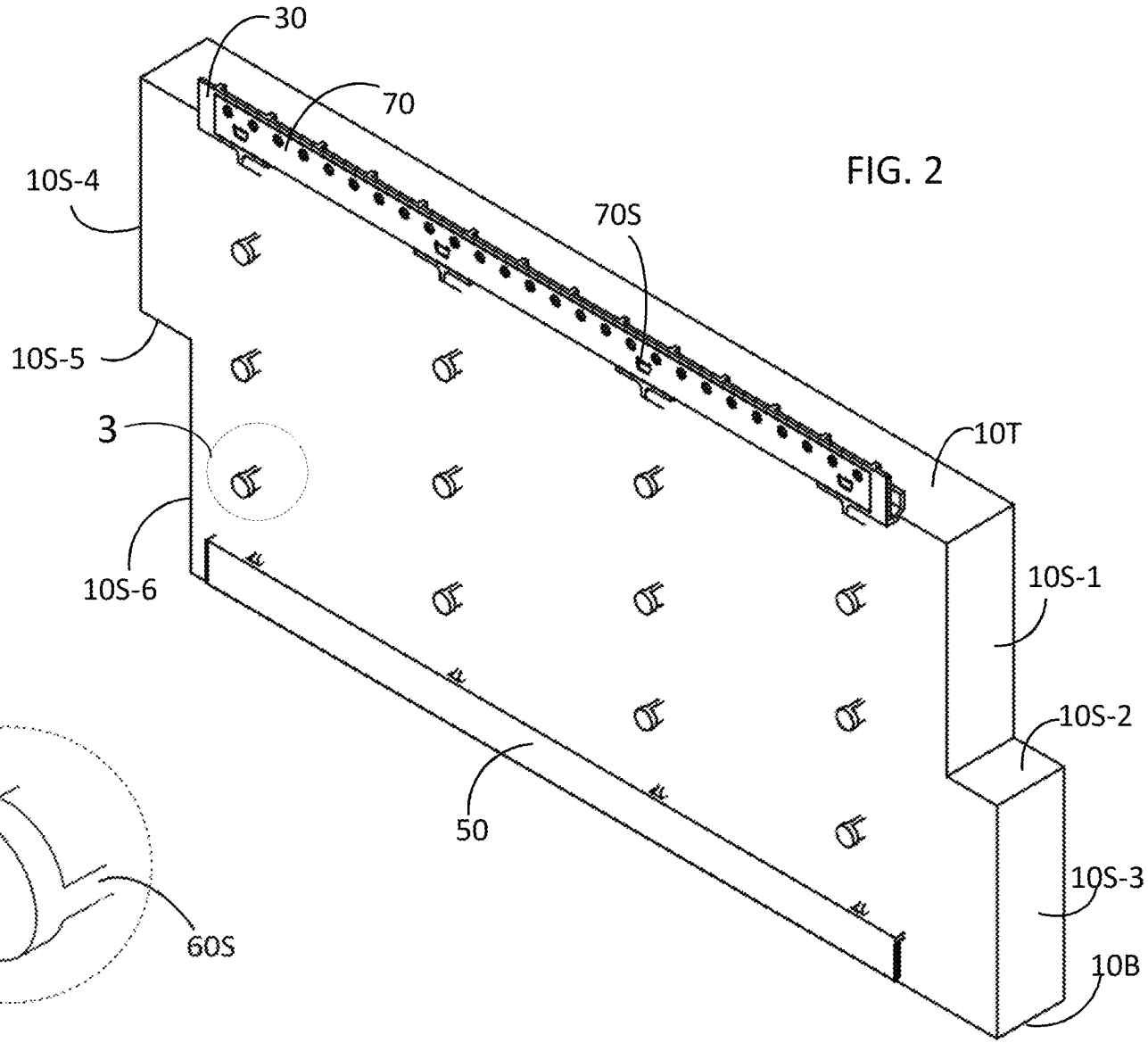
FIG. 2 is a rear perspective view of the veneer panel shown in FIG. 1.

FIG. 1-2 illustrate an embodiment of a veneer panel provided by the invention. FIG. 1 provides a front perspective view, and FIG. 2 provides a rear perspective view of veneer panel 1.

Veneer panel 1 includes veneer body 10 with front face 10F, rear face 10R, and an intermediate thickness defining first plane parallel side 10T and second plane parallel side 10B. Veneer body 10 also has staggered left and right sides form by side faces 10S-1, 10S-2 and 10S-3 on the left and side faces 10S-4, 10S-5 and 10S-6 on the right, of which 10S-1 and 10S-4 are plane parallel sides, and 10S-3 and 10S-6 are plane parallel sides.

Figure 3:
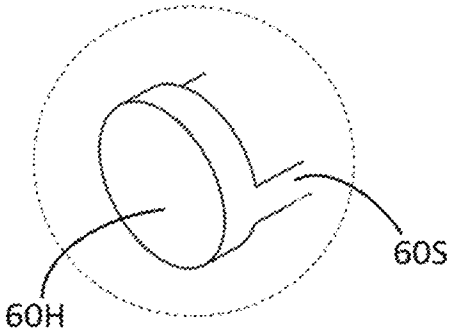
FIG. 3 is an enlarged view of an embodiment of an orthogonal support member extending from the rear of the veneer panel of FIG. 2

To enable installation on a building surface, veneer panel 1 is configured with (1) J-shaped fastening member 30 disposed along the top panel body 10, (2) flange 50 disposed along the bottom of panel body 10 adjacent rear face 10, and (3) orthogonal support member 60 extending rearwardly from veneer body 10. J-shaped fastening member 30 has an elongated structure that extends laterally adjacent the rear edge of first plane parallel side 10T of veneer panel 1. J-shaped fastening member 30 is configured with groove 30G, which extends from a first end of J-shaped fastening member 30 to a second end to accommodate the exposed flange of another veneer panel stacked directly above further discussed below. Flange 50 an elongated structure that extends laterally at the rear of veneer body 10 along the bottom edge of rear face 10R. Flange 50 is configured to align with groove 30G to allow flange 50 of a first veneer panel 1 to rest within groove 30G of another veneer panel 1 installed directly below as discussed below. Orthogonal support member 60 is a male connector integrally formed with stem 60S and button-shaped support head 60H as shown in FIG. 3. Orthogonal support member 60 engages with a female connector fastened to the surface of a building to further support attachment of veneer panel 1 to the building surface.

An embodiment of a female connector that can be used with orthogonal support member 60 is illustrated in FIG. 4A-4D, which provide a front, side and front perspective view of mounting strip 100. Mounting strip 100 can be secured to a building surface through use of fastening holes 100H in preparation for installation of veneer panel 1. Mounting strip 100 is integrally formed with three female snap connector 102 configured to engage with and form a snap joint with orthogonal support member 60. Each female snap connector 102 is a cantilever snap integrally formed with four cantilever hooks 102H. The four cantilever hooks 102H are oriented so the hooks are inward facing to define a space within which orthogonal support member 60 can be retained thereby forming a snap joint.

Though each female snap connector 102 is integrally formed with four cantilever hooks 102H, the invention provides for use of a female snap connector that have fewer than four cantilever hooks or more than four cantilever hooks. A female snap connector can have two or three cantilever hooks so long as the hooks are effective to retain a male connector inserted therebetween. A female snap connector can have five, six or more cantilever hooks that engages with the inserted male connector to form a joint.

Veneer Panel 3

Figure 5:
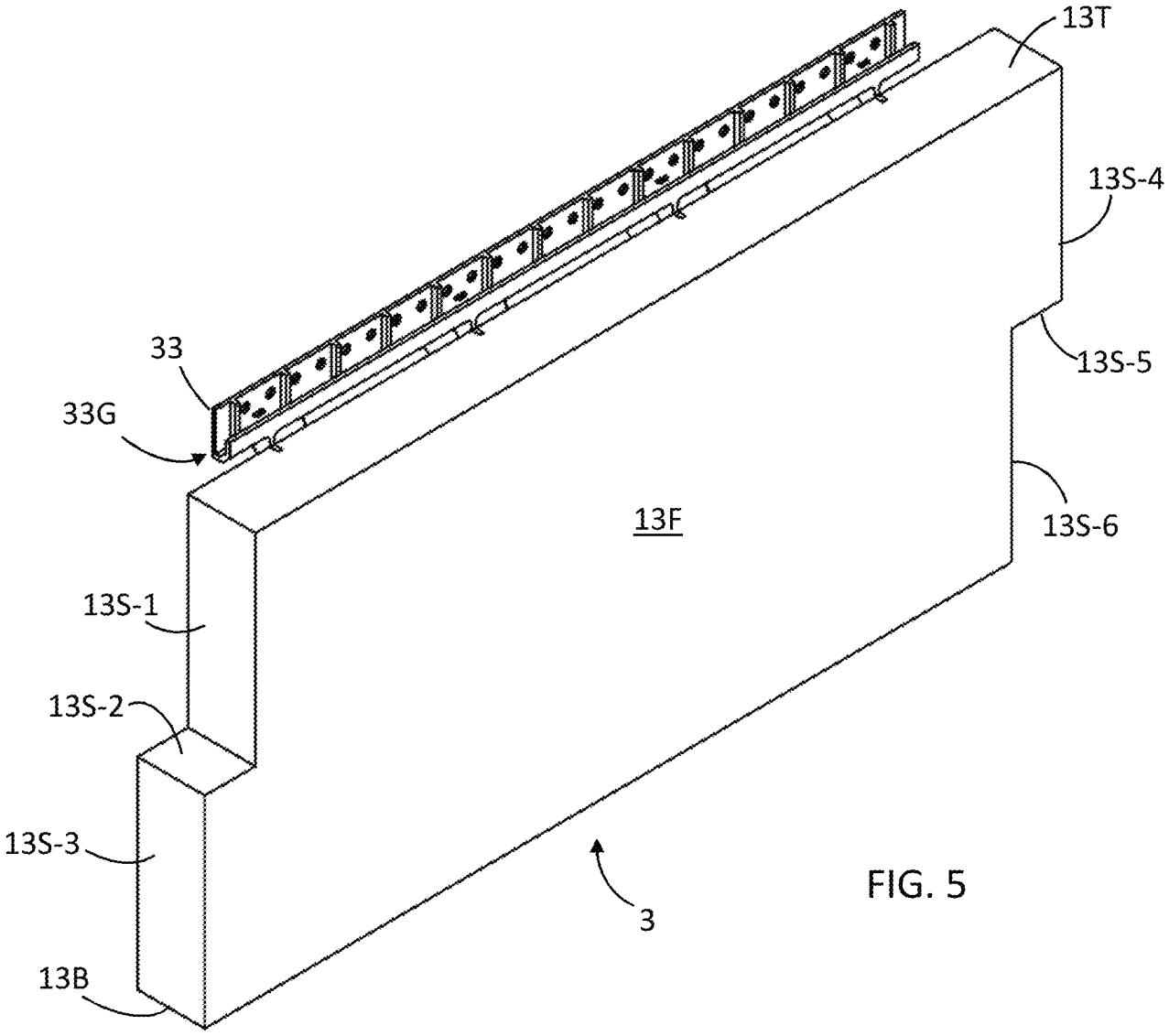
FIG. 5 is a front perspective view of a veneer panel incorporating the molded frame of FIG. 20-22.
Figure 6:
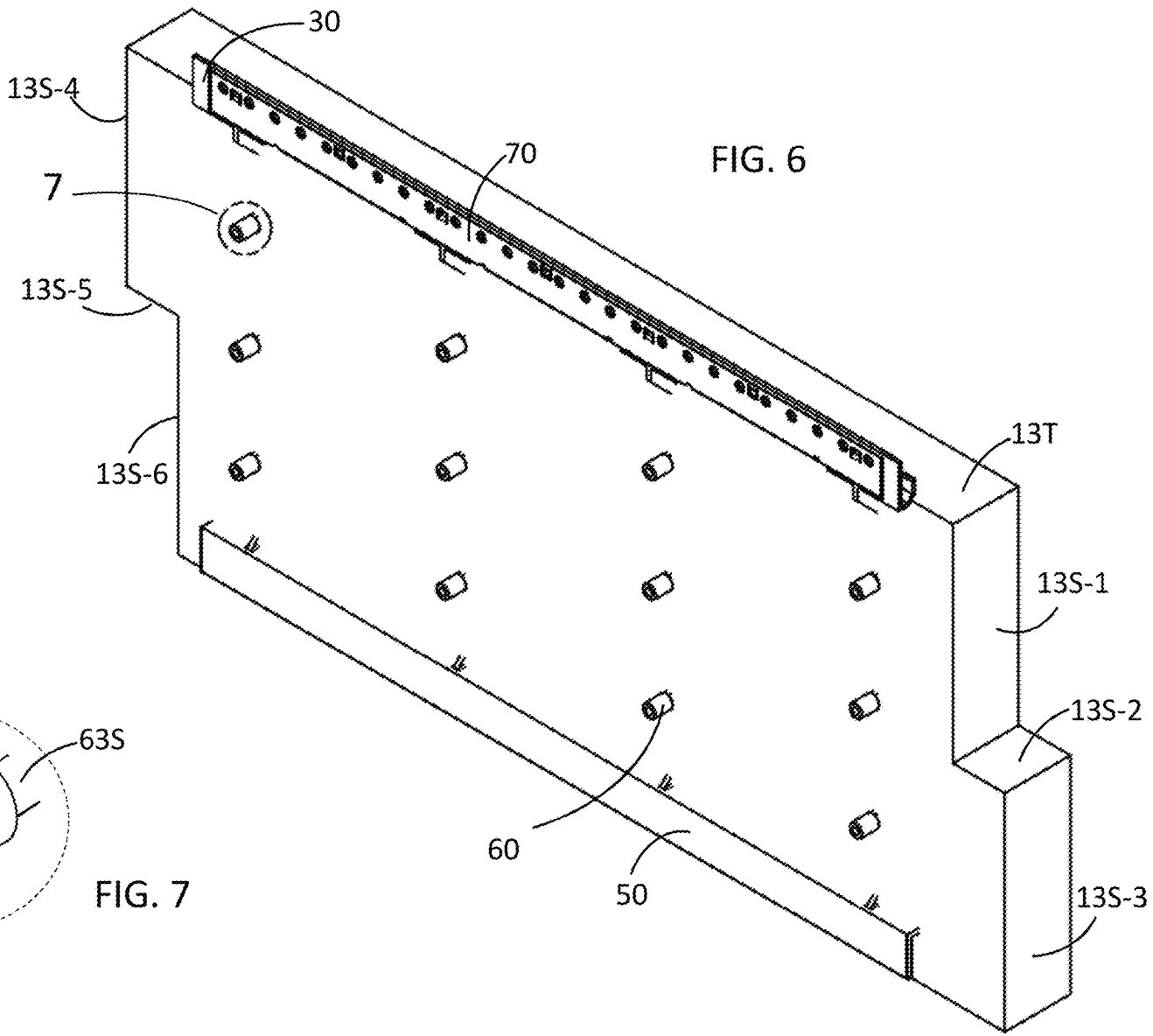
FIG. 6 is a rear perspective view of the veneer panel shown in FIG. 5.

FIG. 5-6 illustrate an embodiment of another veneer panel provided by the invention. FIG. 5 provides a front perspective view, and FIG. 6 provides a rear perspective view of veneer panel 3.

Veneer panel 3 includes veneer body 13 with front face 13F, rear face 13R, and an intermediate thickness defining first plane parallel side 13T and second plane parallel side 13B. Veneer body 13 also has staggered left and right sides form by side faces 13S-1, 13S-2 and 13S-3 on the left and side faces 13S-4, 13S-5 and 13S-6 on the right, of which 13S-1 and 13S-4 are plane parallel sides, and 13S-3 and 13S-6 are plane parallel sides.

Figure 7:
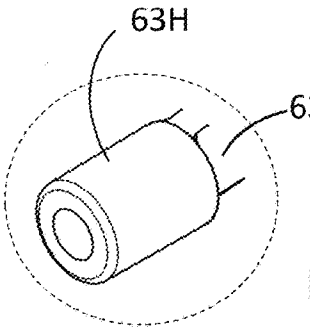
FIG. 7 is an enlarged view of another embodiment of an orthogonal support member extending from the rear of the veneer panel of FIG. 6

For installation on a building surface, veneer panel 3 is configured with (1) J-shaped fastening member 30 disposed along the top panel body 13, (2) flange 50 disposed along the bottom of panel body 13 adjacent rear face 13R, and (3) orthogonal support member 63 extending rearwardly from veneer body 13. Elongated J-shaped fastening member 30 extends laterally adjacent the rear edge of first plane parallel side 13T of veneer panel 3 as further discussed below. J-shaped fastening member 30 is configured with groove 30G, which extends from a first end of J-shaped fastening member 30 to a second end to accommodate the exposed flange of another veneer panel stacked directly above. Elongated flange 50 extends laterally at the rear of veneer body 13 along the bottom edge of rear face 13R. Flange 50 is configured to align with groove 30G to allow flange 50 of a first veneer panel 3 to rest within groove 30G of another veneer panel 3 installed directly below as further discussed below. Orthogonal support member 63 is a male connector integrally formed with stem 63S and cylindrical support head 63H as illustrated in FIG. 7. Orthogonal support member 63 engages with a female connector fastened to the surface of a building to further support attachment of veneer panel 3 to the building surface.

Figure 8C:
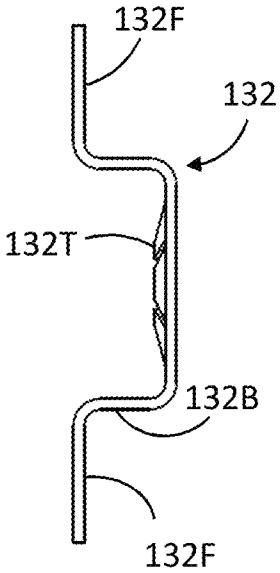
FIG. 8A-8C are a perspective view, a rear view and an end view, respectively, of a push connector according to the invention.
Figure 8B:
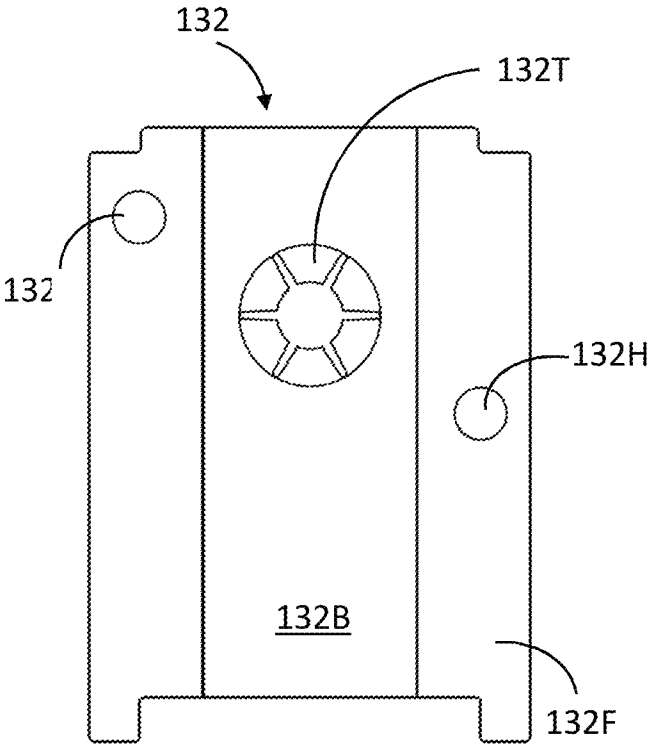
Figure 8A:
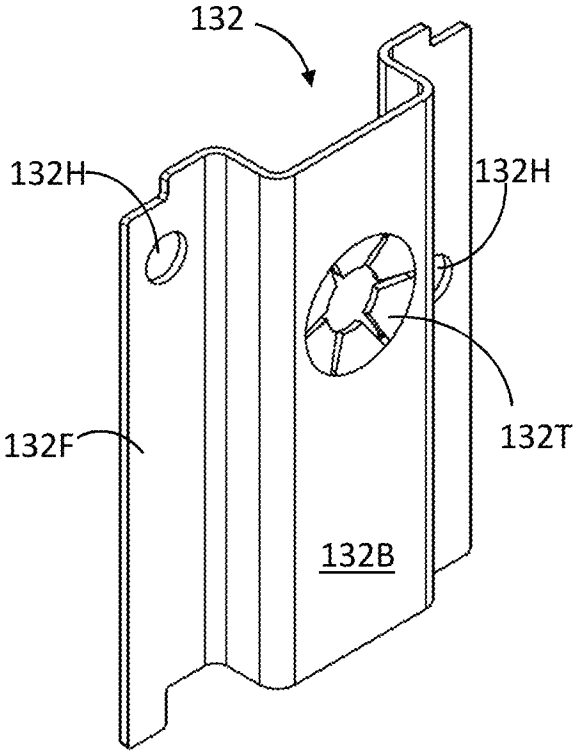

An embodiment of a female connector that can be used with orthogonal support member 63 is illustrated in FIG. 8A-8C, which provide a front perspective view, rear side view and an end view of female connector 132. Female connector 132 can be secured to a building surface through fastening holes 132F in preparation for installation of veneer panel 3. Female connector 132 is formed with raised body portion 132B and six radial retention tab 132T. The six radial retention tabs 132T define a space within which orthogonal support member 63 can be retained when pushed in.

Though female push connector 132 has six radial retention tab 132T, the invention provides for use of a female push connector that have fewer than six radial retention tabs or more than six retention tabs. A female push connector can have five, four, three or two radial retention tabs so long as the tabs are effective to exert a force that retains a male connector inserted therebetween. A female push connector can have six, seven, eight, nine or more radial retention tabs or can also be fitted with a ring of teeth effective to grip the inserted male connector to form a joint.

Figure 10:
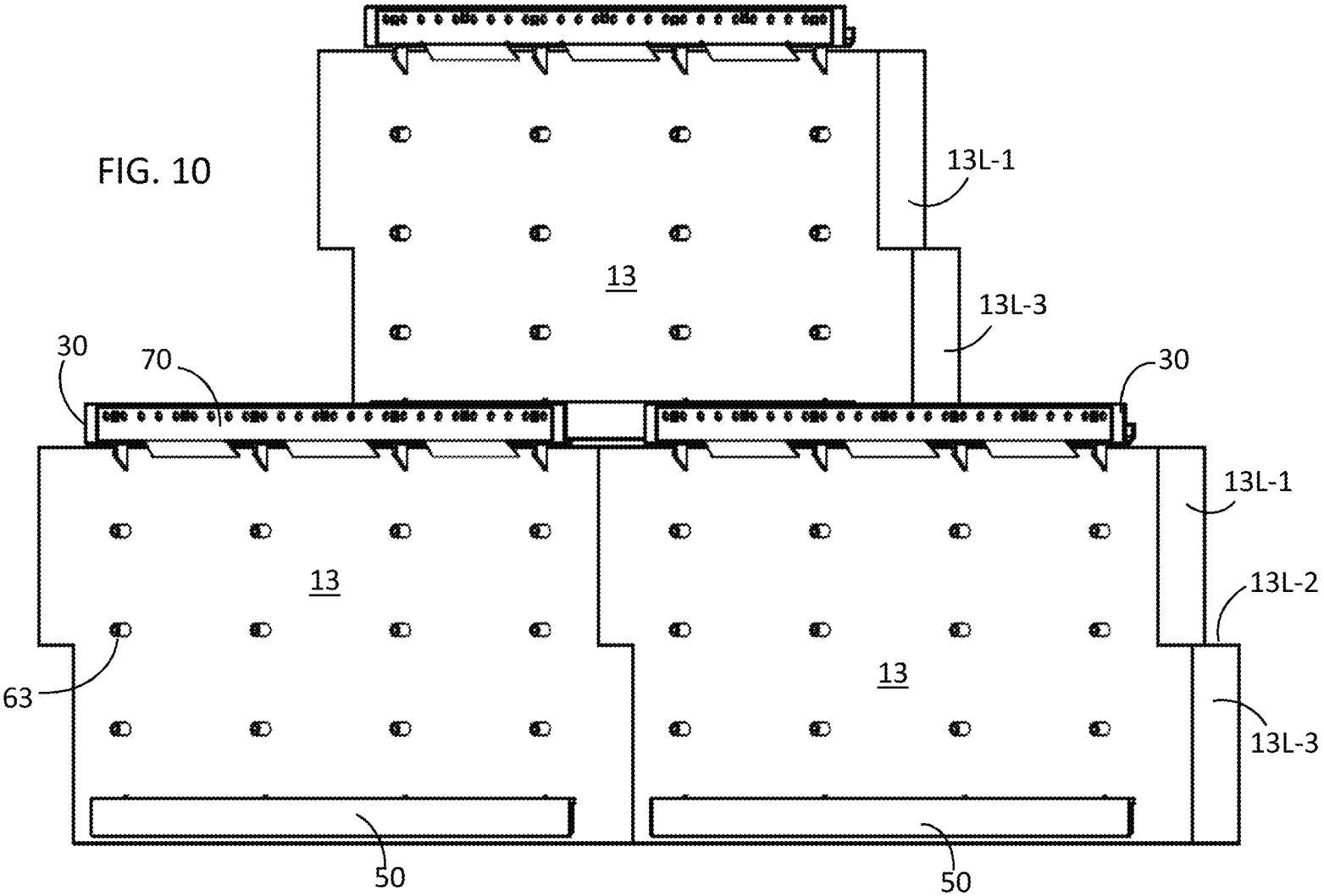
FIG. 10 is a rear view of three stacked veneer panels of the invention.

FIG. 9A-9C illustrate the vertical stacking of veneer panel 3 one above the other. FIG. 9A provides a left side view and FIG. 9B is an enlarge view of the relative positions of flange 50 of the upper panel in groove 30G of the lower panel, which is formed between tall planar rear section 30R, base section 30B, and short planar forward section 30F of the J-shaped fastening member 30. As illustrated in FIG. 9B, tall planar rear section 30R is represented by plane T, short planar forward section 30F is represented by plane S, and flange 50, represented by plane F, is in between plane T and plane S. FIG. 10 provides a view of three veneer panel 3 in stacked relation.

Corner-Less Veneer Panels Generally

Though veneer panels 1 and 3 have staggered left and right sides, in other embodiments of the invention, a veneer panel can have left and right sides that are not staggered. For example, the left and right sides can be generally plane parallel forming a veneer panel with two pairs of opposite plane parallel sides: (1) a first set of opposite plane parallel sides forming the top and bottom of the veneer panel, (2) a second set of opposite plane parallel sides forming the left and right sides of the veneer panel. In yet other embodiments, the left and right sides can have an undulated edge, which can be regular or irregular such as that resembling the vertical stacking of one or more stones or bricks of varying sizes and shapes.

In veneer panels 1 and 3, J-shaped fastening member 30 extends substantially the width of veneer panels 1 and 3. As used herein, the term "substantially" in reference to a numeric value means a quantity that is at least 80% of the numeric value, for example, 80%, 85%, 90%, and 95%. A veneer panel can be fabricated with a J-shaped fastening member that extends the full width of the veneer panel or less than the full width of the veneer panel, for example, about 20%, about 30%, about 40%, about 50%, about 60%, about 70%, about 80% of the width of the veneer panel or any value in between.

Similarly, flange 50 extends substantially the width of veneer panels 1 and 3. A veneer panel can be fabricated with a flange that extends the full width of the veneer panel or less than the full width of the veneer panel, for example, about 10%, about 20%, about 30%, about 40%, about 50%, about 60%, about 70%, about 80%, about 90%, or about 95% of the width of the veneer panel or any value in between.

The length of J-shaped fastening member and flange can be similar or different. The J-shaped fastening member can be longer than the flange or shorter than the flange so long as the flange can rest in the groove in a panel stacked directly below. Thus, the flange can be longer or shorter than the J-shaped fastening member.

Veneer panels 1 and 3 illustrated in FIGS. 2 and 6 are fabricated with three rows of four orthogonal support members extending from the rear of the veneer panel body. A veneer panel of the invention can be fabricated with any number of rearwardly-extending orthogonal support members, which can be uniformly spaced or otherwise. For example, a veneer panel of the invention can be fabricated with one, two, three, four or more than four rows of one, two, three, four or more than four orthogonal support members. The uniform spacing of the orthogonal support members allow the panel to be trimmed to a select height to fit a particular area during installation.

In veneer panels 1 and 3, orthogonal support members 60 and 63 are both male connectors that engage with a female connector mounted on a building surface. In other embodiments of the invention, the veneer panel can be fabricated with one or more female connectors, while the corresponding male connector can be mounted on a building surface prior to installation of the veneer panel. The male and female connectors used in a veneer panel of the invention are components of a mating pair or mating connectors that form a separable or inseparable joint.

The invention also provides a veneer panel without a J-shaped fastening member, without a flange, or without a J-shaped fastening member and without a flange.

Figures 31, 32, 33:
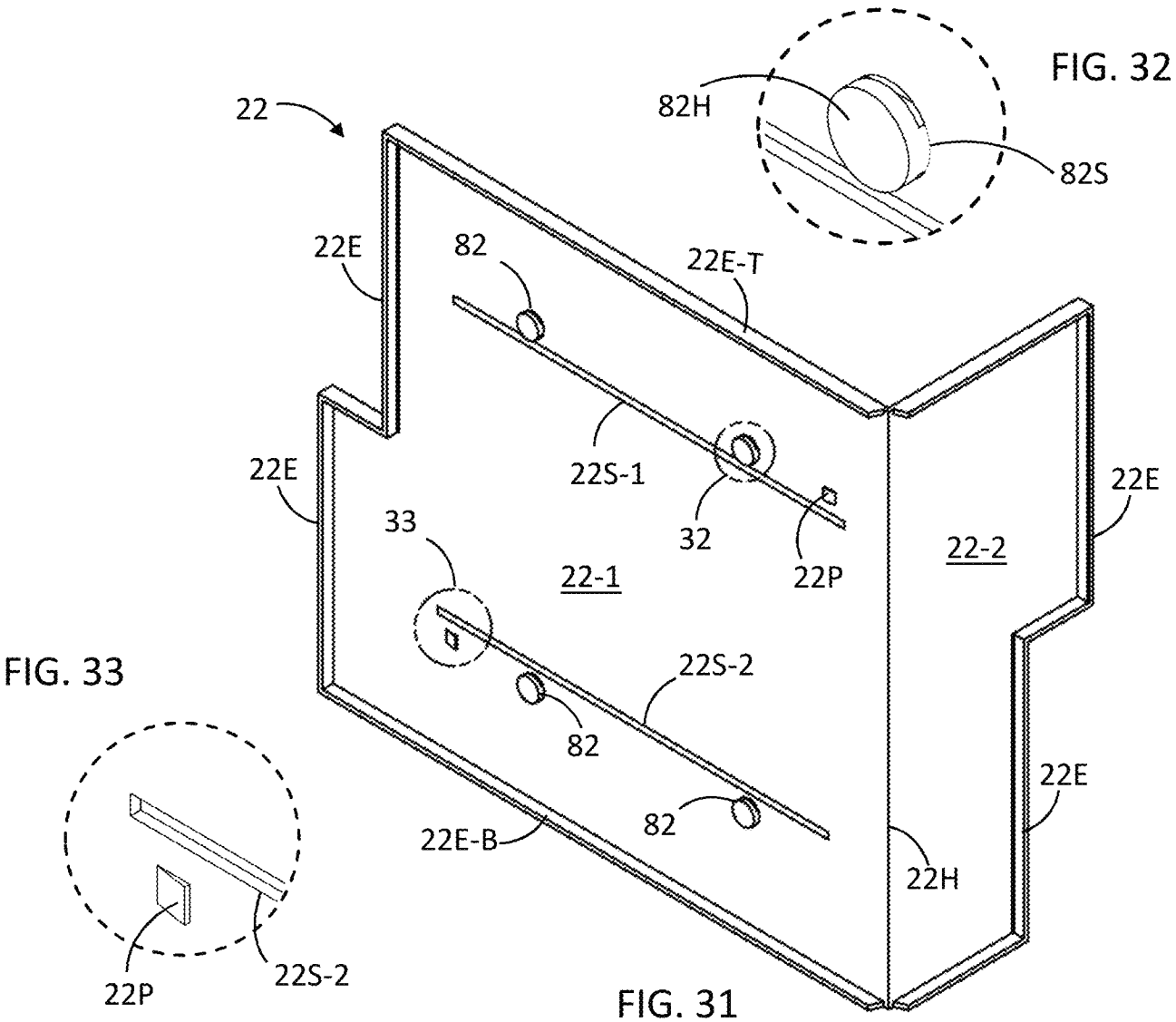
FIG. 31 is a perspective view (from the concrete facing side) of a two-section backing for a veneer corner according to an embodiment of the invention, the view illustrating the primary and secondary orthogonal sections of the two-section backing.
FIG. 32 is an enlarged view of a mounting member attachment means used for securing a three-section mounting member to the two-section backing of FIG. 31.
FIG. 33 is an enlarged view of one end of an elongated slot and a stop for retaining a three-section mounting member on the backing shown in FIG. 31.
Figure 36:
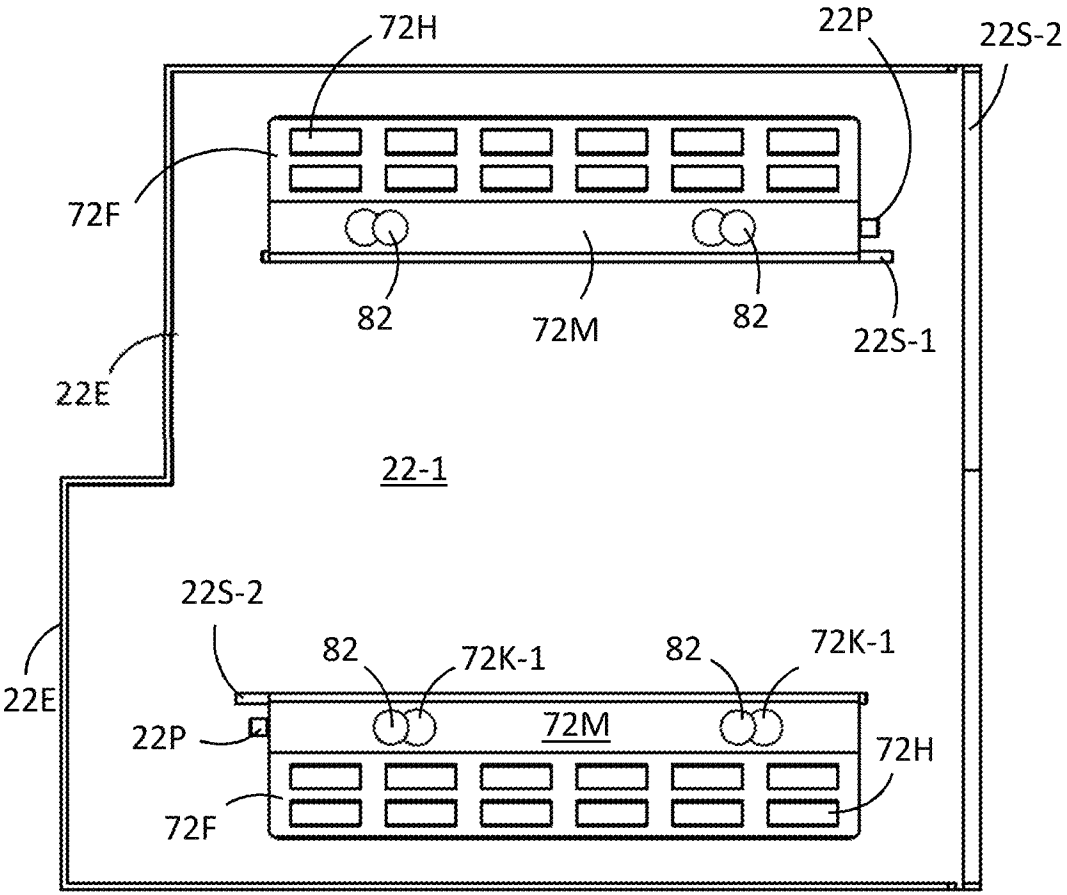
FIG. 36 is a front side view (from the concrete facing side) of the subassembly shown in FIG. 35.

In these embodiments the backing can have the structure of the primary backing section 22-1 illustrated in FIG. 31—though hinge 22H would be replaced by peripheral edges akin to the left peripheral edges (22-E). As such, when assembled with the mounting components configured for use with a backing of the invention—the backing would resemble the subassembly for 22-1 shown in FIG. 36—though component 22-2 would be replaced by peripheral edges akin to the left peripheral edges 22E (FIG. 36).

Thus, the backing can be a single section backing with a structure resembling the primary backing section and having no secondary section.

Figure 35:
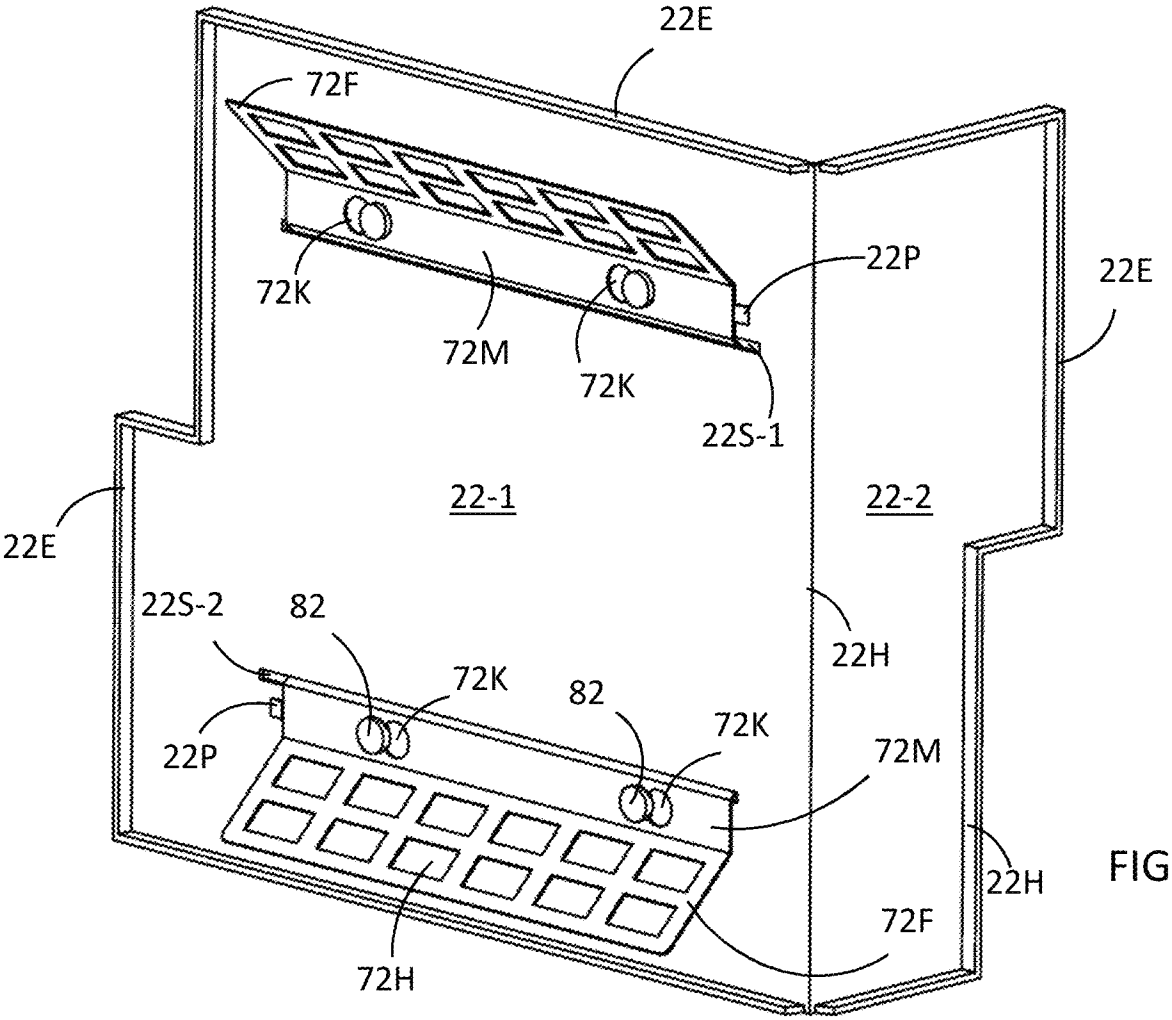
FIG. 35 is a front perspective view (from the concrete facing side) of a subassembly that includes the two-section backing shown in FIG. 31 and the three-section mounting member shown in FIG. 34A-34C—illustrated in combination with a two-section mounting rail with hanging rail for use on a building and a single unit push connector.

Alternatively, the backing can have a structure formed when backing 22 (FIG. 31) is "flattened" through operation of hinge 22H, i.e. primary backing section 22-1 and secondary backing section 22-2 can be positioned to form a 180 degree, i.e. lay flat. As such, when assembled with the mounting components configured for use with a backing of the invention—the backing would have a structure formed when the subassembly shown in FIG. 35 is "flattened" through operation of hinge 22H, i.e. primary backing section 22-1 and secondary backing section 22-2 are arranged to lay flat.

In these embodiments, the mounting components include a three-section mounting member inserted through a slot in the backing and secured in place such that the anchoring fin is forward of the backing within the setting space defined by the backing and raised peripheral edges and the hanger section extends through a slot in the backing to the rear of the backing.

II. Veneer Panels with Two-Section Body

Figure 12:
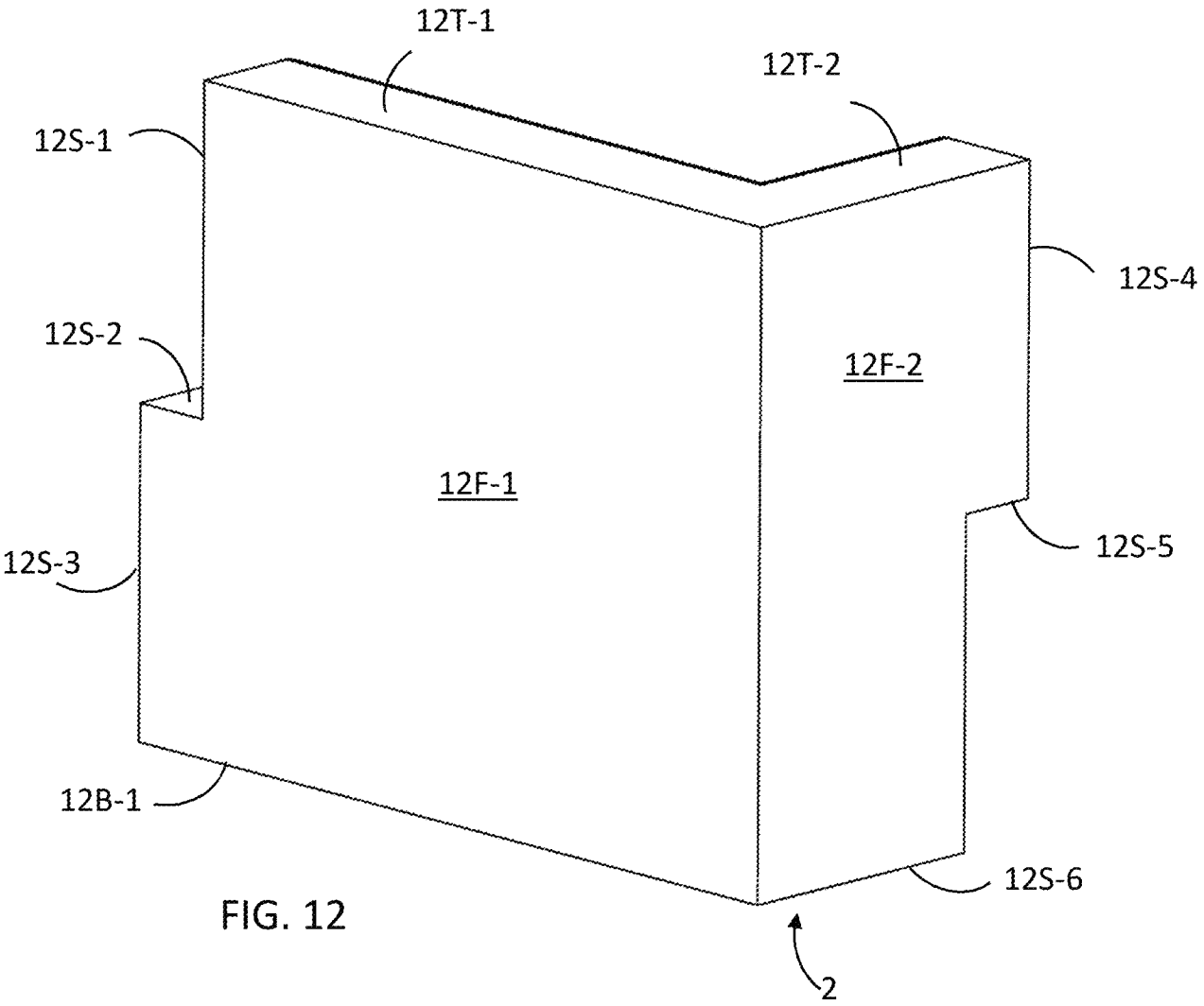
FIG. 12 is a front perspective view of the body of a veneer corner according an embodiment of the invention (fastening strip or backing not shown).
Figure 13:
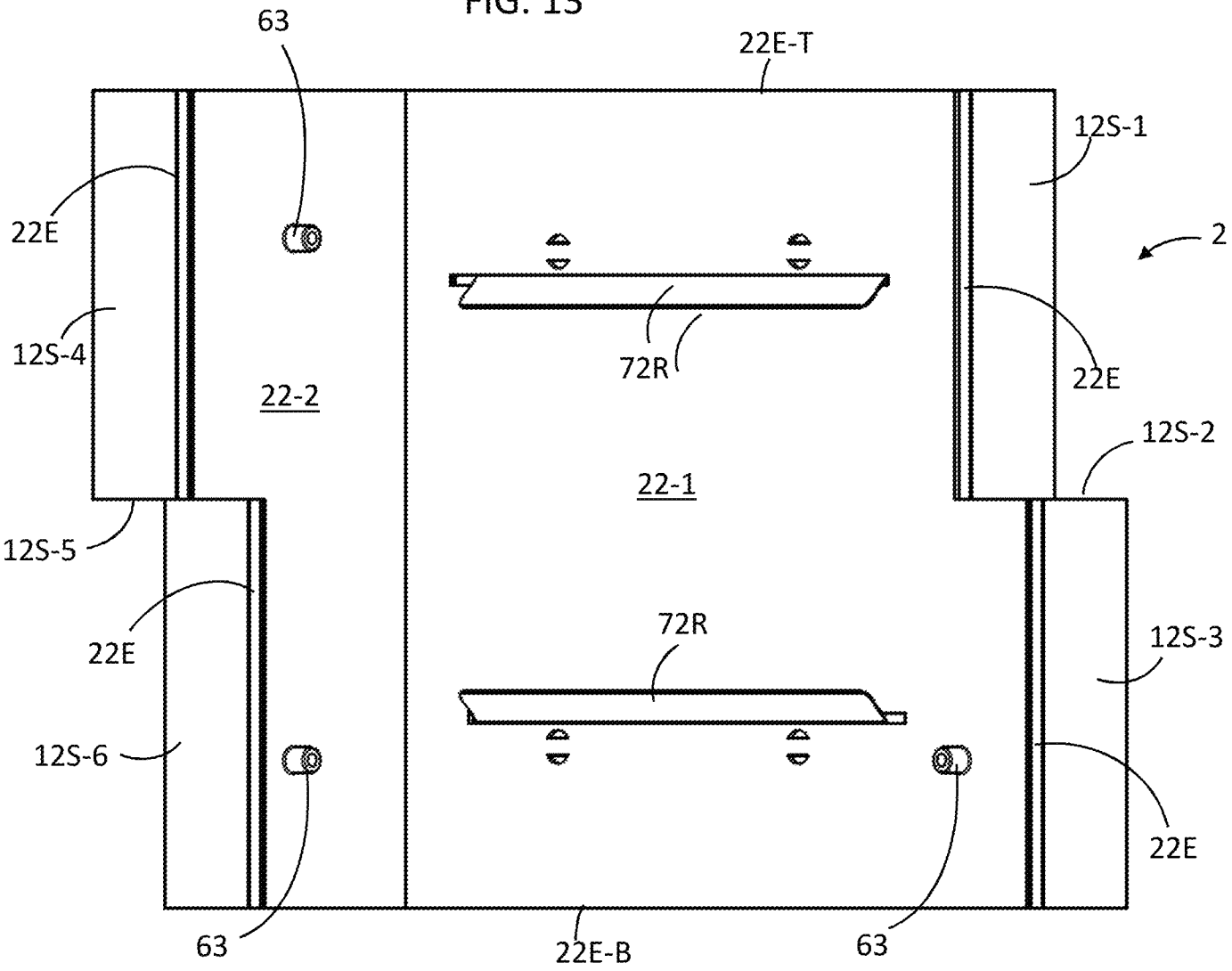
FIG. 13 is a rear view of the veneer corner of FIG. 12 illustrating the veneer corner backing and hanger for supporting and installation of the veneer corner.

FIG. 11A-11B illustrate a veneer panel with a two-section body forming a veneer corner that are installed on a corner or a square post, respectively. FIG. 12-13 illustrate an embodiment of a veneer corner provided by the invention. FIG. 12 provides a front perspective view and FIG. 13 provides a rear view of veneer corner 2.

Veneer corner 2 is formed with a two-section veneer body 12 defined by a primary veneer body section 12-1 and a secondary veneer body section 12-2. Primary veneer body section 12-1 has front face 12F-1, rear face 12R-1, and an intermediate thickness defining first plane parallel side 12T-1 and second plane parallel side 12B-1. First plane parallel side 12T-1 and second plane parallel side 12B-1 are a pair of opposite plane parallel sides. Similarly, secondary veneer body section 12-2 has front face 12F-2, rear face 12R-2, and an intermediate thickness defining first plane parallel side 12T-2 and second plane parallel side 12B-2. First plane parallel side 12T-2 and second plane parallel side 12B-2 are a pair of opposite plane parallel sides.

Two-section veneer body 12 also has staggered left and right sides defined by left side-sections 12S-1, 12S-2, 12S-3 and right side-sections 12S-4, 12S-5 and 12S-6 as illustrated in FIG. 12-13.

For installation on an exterior building corner, veneer corner 2 is configured with two-section backing 22 with raised peripheral edges 22E that form a setting enclosing rear face 12R of veneer body 12 (FIG. 13). Two-section backing 22 is formed with primary backing section 22-1 and secondary backing section 22-2 that adjoin at hinge 22H. Primary backing section 22-1 and secondary backing section 22-2 are oriented at right angle or at any select angle including an angle of 180 degrees. Primary backing section 22-1 is fitted with two of hanger 72R to allow veneer corner 2 to be installed in a first orientation or in a second orientation, the second orientation being a 180-degree inversion of the first orientation. Two-section backing 22 is formed with three orthogonal support member 63 extending rearwardly. One of the orthogonal support members 63 is attached to primary backing section 22-1 and two are of the three orthogonal support members 63 are attached to secondary backing section 22-2 (FIG. 13).

In other embodiments of a veneer corner of the invention, the two-section backing, i.e. primary backing section, secondary backing section or both primary and secondary backing sections can be fabricated with one or more orthogonal support member 63 or any combination of one or more orthogonal support members 60 and 63. The orthogonal support members can be integrally formed parts of the frame or attached to the frame using any method known in the art. The primary backing section can include one, two, three, four, five or more than five formed orthogonal support member extending rearwardly. Alternatively, the primary backing section can include no orthogonal support members. Similarly, the secondary backing section can include one, two, three, four, five or more than five orthogonal support members extending rearwardly. Alternatively, the secondary backing section can include no orthogonal support member. The orthogonal support member can be configured with a stem-cylindrical head such as that of orthogonal support member 63 or with a stem-button head such as that of orthogonal support member 60. A veneer corner of the invention can also be fabricated to include a mix of both orthogonal support members 60 and 63.

Veneer Corners Generally

Veneer corner 2 is fabricated with a larger primary section and a narrower secondary section. In alternative embodiments, a veneer corner of the invention can have similar sized primary and secondary sections.

Though veneer corner 2 has staggered left and right sides, in other embodiments of the invention, a veneer corner can have left and right sides that are not staggered. For example, the left and right sides can be generally plane parallel forming a veneer corner with two pairs of opposite plane parallel sides: (1) a first set of opposite plane parallel sides forming the top and bottom of the veneer corner, (2) a second set of opposite plane parallel sides forming the left and right sides of the veneer corner. In yet other embodiments, the left and right sides can have an undulated edge, which can be regular or irregular such as that resembling the vertical stacking of one or more stones or bricks of varying sizes and shapes.

Though veneer corner 2 is configured for use with an outside corner, the invention provides a veneer corner that can be installed on an inside corner. In these embodiments, backing 22, shown in FIG. 31 in a configuration for manufacturing an veneer outside corner, can be adjusted through its hinge for use in manufacturing a veneer inside corner. For example, to support a veneer outside corner, backing 22 is used in the orientation shown in FIG. 31, in which primary backing sections 22-1 and secondary backing sections 22-2 are arranged so their front faces are about 270 degrees apart and their rear faces are about 90 degrees apart. To support a veneer inside corner, backing 22 can be adjusted through the hinge so the front faces of primary section 22-1 and secondary section 22-2 form an obtuse or right angle, while their rear faces form a reflex angle.

A veneer corner of the invention can also be fabricated without a backing. For example, a veneer corner of the invention can be fabricated with a J-shaped fastening member extending along the top edge of the veneer corner and a flange extending along the bottom rear face of the veneer corner. The J-shaped fastening member can (1) extend along the top, rear edge of the primary section, (2) extend along the top, rear edge of the secondary section, or (3) extend along the top rear edges of the primary and secondary sections. Where the J-shaped fastening member extends along the top, rear edges of the primary and secondary sections, the J-shaped fastening member could be formed with a bend, for example, a right-angle bend. Alternatively, the veneer corner can be fabricated with two separate J-shaped fastening members one for each of the primary and secondary sections.

Similarly, the flange can (1) extend along the bottom edge of the rear face of the primary section, (2) extend along the bottom edge of the rear face of the secondary section, or (30 extend along the bottom edge of the rear faces of the primary and secondary sections. Where the flange extends along the bottom edge of the rear faces of the primary and secondary sections, the flange could be formed with a bend, for example, a right-angle bend. Alternatively, the veneer corner can be fabricated with two separate flanges.

The invention encompasses a veneer corner having any combination of J-shaped fastening member and flange configurations discussed in the preceding two paragraphs.

As discussed above, the J-shaped fastening member and flange can extend substantially the full width of the primary, secondary, or primary and second sections of the veneer corner or the J-shaped fastening member and flange can extend less than the full width of the primary, secondary, or primary and second sections of the veneer corner, or any combination thereof by any amount as discussed above for the veneer panels.

Any combination of the above discussed lengths or configuration of J-shaped fastening member and flange can be incorporated in a veneer with a corner.

A veneer corner can be fabricated with a J-shaped fastening member that extends the full width of the primary and secondary sections of the veneer corner or less than the full width of the primary section, secondary section, or both primary and secondary sections of a veneer corner, for example, about 20%, about 30%, about 40%, about 50%, about 60%, about 70%, about 80%, or any value in between, of the width of the primary section, secondary section, or both primary and secondary sections of a veneer corner, or any combination thereof.

Similarly, flange 50 extends substantially the width of veneer panels 1 and 3. A veneer panel with a corner can be fabricated with a flange that extends the full width of the primary and secondary sections of the veneer corner or less than the full width of the primary section, secondary section, or both primary and secondary sections of the veneer corner. For example, a veneer corner can be fabricated with a flange that extends about 10%, about 20%, about 30%, about 40%, about 50%, about 60%, about 70%, about 80%, about 90%, or about 95% of the width of the veneer corner or any value in between.

The length of J-shaped fastening member and flange can be similar or different if present in a veneer corner. The J-shaped fastening member can be longer than the flange or shorter than the flange so long as the flange can rest in the groove in a corner stacked directly below. Thus, the flange can be longer or shorter than the J-shaped fastening member. The J-shaped fastening member, flange or both J-shaped fastening member and flange can include a bend, for example, a right-angle bend.

Where no backing is used, a frame as described herein can be used in the primary section, secondary section or both primary and secondary sections of a veneer corner. As such, the primary section, secondary section or both primary and secondary sections of a veneer panel with a corner can resemble veneer panel 1 or 3 and can have any number of rearwardly-extending orthogonal support members, which can be uniformly spaced as shown for veneer panels 1 and 3 or otherwise. For example, the primary section, secondary section or both primary and secondary sections of a veneer corner of the invention can be fabricated with one, two, three, four or more than four rows of one, two, three, four or more than four orthogonal support members.

In veneer corner 2, orthogonal support member 63 is a male connector that engages with a female connector mounted on a building surface. In other embodiments of the invention, the veneer corner can be fabricated with one or more female connectors, while the corresponding male connector can be mounted on a building surface prior to installation of the veneer corner. The male and female connectors used in a veneer corner of the invention can be components of a mating pair or mating connectors that form a separable or inseparable joint.

III. Veneer Body

A veneer panel includes a veneer body that can be constructed of any moldable material. The veneer body can be cast stone made of various cement mixtures that include, for example, Portland cement, cement concrete, architectural cement, concrete reinforcing fibers, light weight aggregates (e.g. pumice), and mineral coloring pigments (e.g. iron oxide), which can be mixed and blended in a mold during the manufacturing process.

The veneer body can have a single-section structure without a bend or corner for flush mounting against a flat surface such as a wall. The veneer body can have two body sections that join at an angle to form an angled structure for mounting to a corner of a building structure. Whether a single-section structure body or a two-section body with an angled structure, the veneer body has a front face, a rear face and an intermediate thickness extending between the front face and the rear face that defined a pair of opposite plane parallel sides.

The front face of the veneer body is the side of the veneer body that is oriented outward and thus visible when mounted to a building surface. As such, the front face of the veneer body is the face configured to include a design element selected to achieve a particular look. The design element can include one or more color, shape, or surface contours and can resemble or mimic the appearance of one or more bricks, stones, wood or other building cladding material. Where the veneer panel has a two-section body with has a first and a second front face section, the first and the second front face sections can be oriented in a converging direction to face a common space such as in a veneer panel configured for use in an inside corner. Alternatively, the first and second front face sections can be oriented in diverging directions to face different spaces such as in veneer panel configured for use in an outside corner.

The rear face of the veneer body is the side of the veneer body that is oriented towards the building surface to which the veneer is mounted. The rear face of the veneer body can be enclosed by a backing as exemplified by veneer corner 2. Alternatively, the rear face of the veneer body can interface with the building surface directly as exemplified in veneer panels 1 and 3.

As used herein the term "rear," "rearward," or "rearwardly" means in the direction of the surface to which the veneer panel is to be mounted or is mounted, or closer or closest to the surface to which the veneer panel is to be mounted or is mounted than to the front face of the veneer body. In contrast, the term "front," "forward," or "forwardly," as used herein, means outward from the surface to which the veneer panel is to be mounted or is mounted, in the same direction as the front face of the veneer body, or closer or closest to the front face of the veneer body than to the rear face of the veneer body.

The intermediate thickness is the veneer body between the front and rear faces. As such, the intermediate thickness of the veneer body defines a first and a second set of opposite sides. The first set of opposite sides are generally plane parallel sides that correspond to the top and the bottom sides of a veneer panel or corner when mounted to a vertical surface. The second set of opposite sides can correspond to the right and left sides of the veneer panel or veneer corner when mounted to a vertical surface.

Thus, a veneer panel is configured to include at least one pair of opposite plane parallel sides, of which one side functions as the top side and the other side functions as the bottom side when the veneer panel or panel with a corner is mounted to a vertical surface. The veneer body can be configured with a similar pair of plane parallel sides to form a veneer panel with straight sides. The veneer body can be configured with staggered sides, and as such, the second set of opposite sides includes more than one pair of opposite plane parallel sides, for example two pairs of opposite plane parallel sides are exemplified by sides 10S-1 and 10S-4, as well as 10S-3 and 10S-6 of veneer panel 1 (FIG. 1-2), 13S-1 and 13S-4, as well as 13S-3 and 13S-6 of veneer panel 3 (FIG. 5-6), and sides 12S-1 and 12S-4, as well as 12S-3 and 12S-6 of veneer corner 2 (FIG. 12-13).

IV. Frame

A veneer panel or veneer corner provided by the invention can be fabricated with a frame partially embedded in the veneer body to facilitate installation on a building surface. FIG. 14-16 and 21-23 illustrate two embodiments of a frame that can be incorporated into a veneer panel or a veneer corner of the invention.

Frame 20

Figure 15:
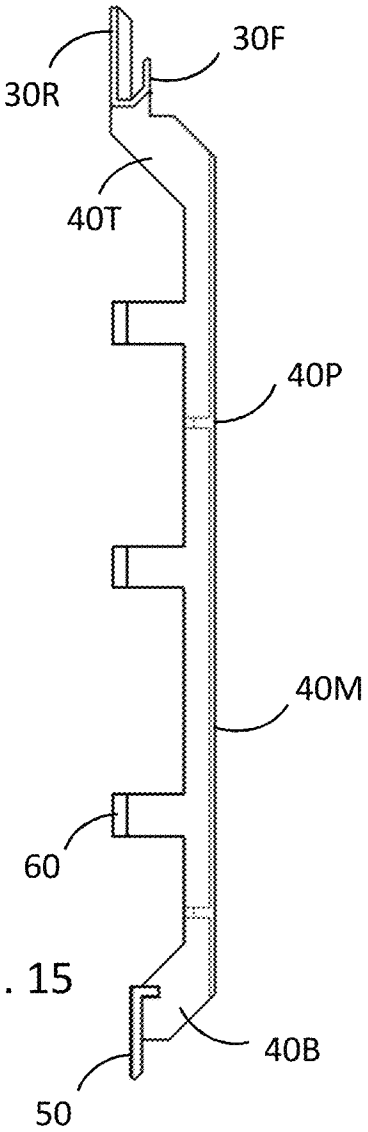
FIG. 15 is a side view of the frame shown in FIG. 14.
Figure 14:
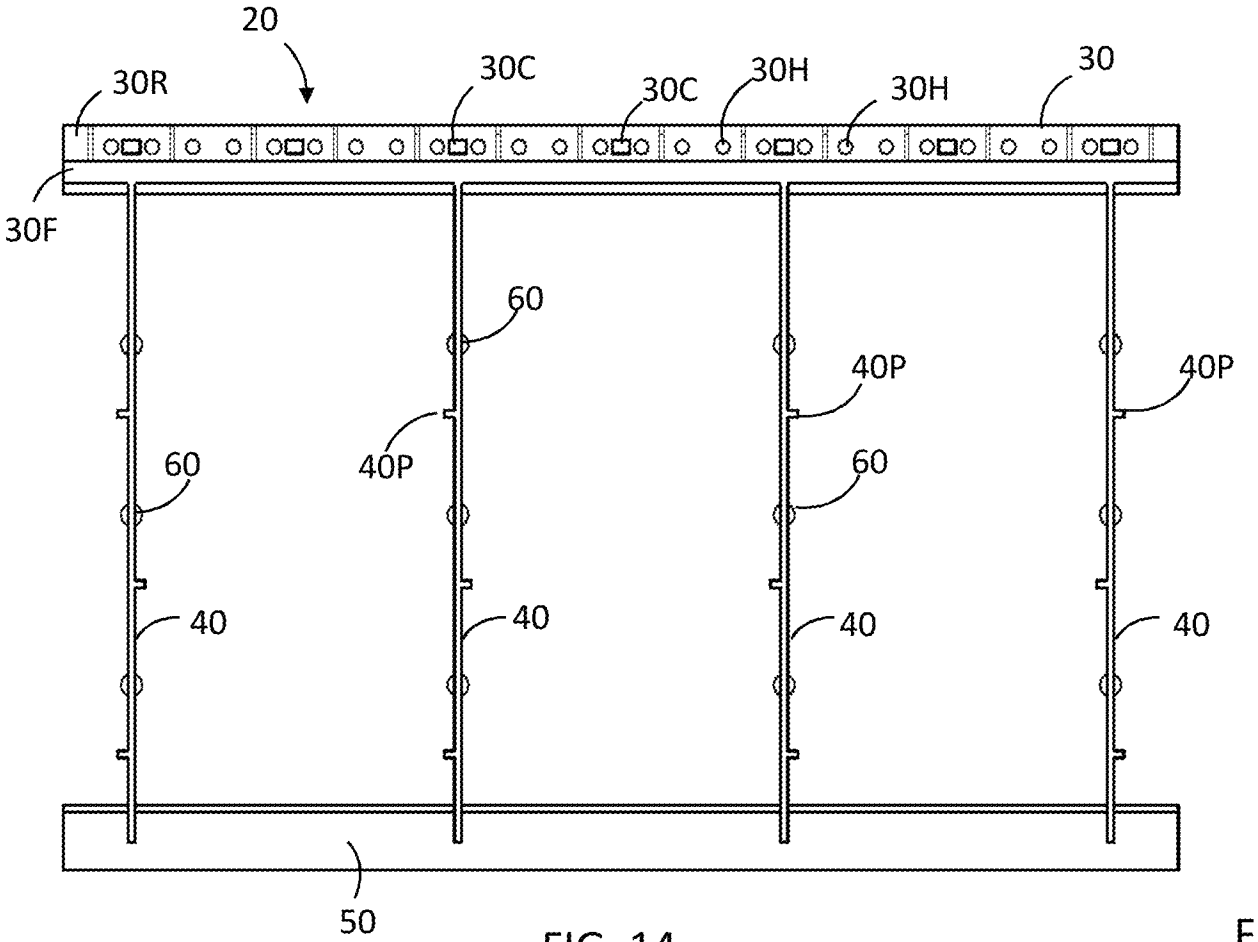
FIG. 14 is a front view of an embodiment of a frame according to the invention.
Figure 16:
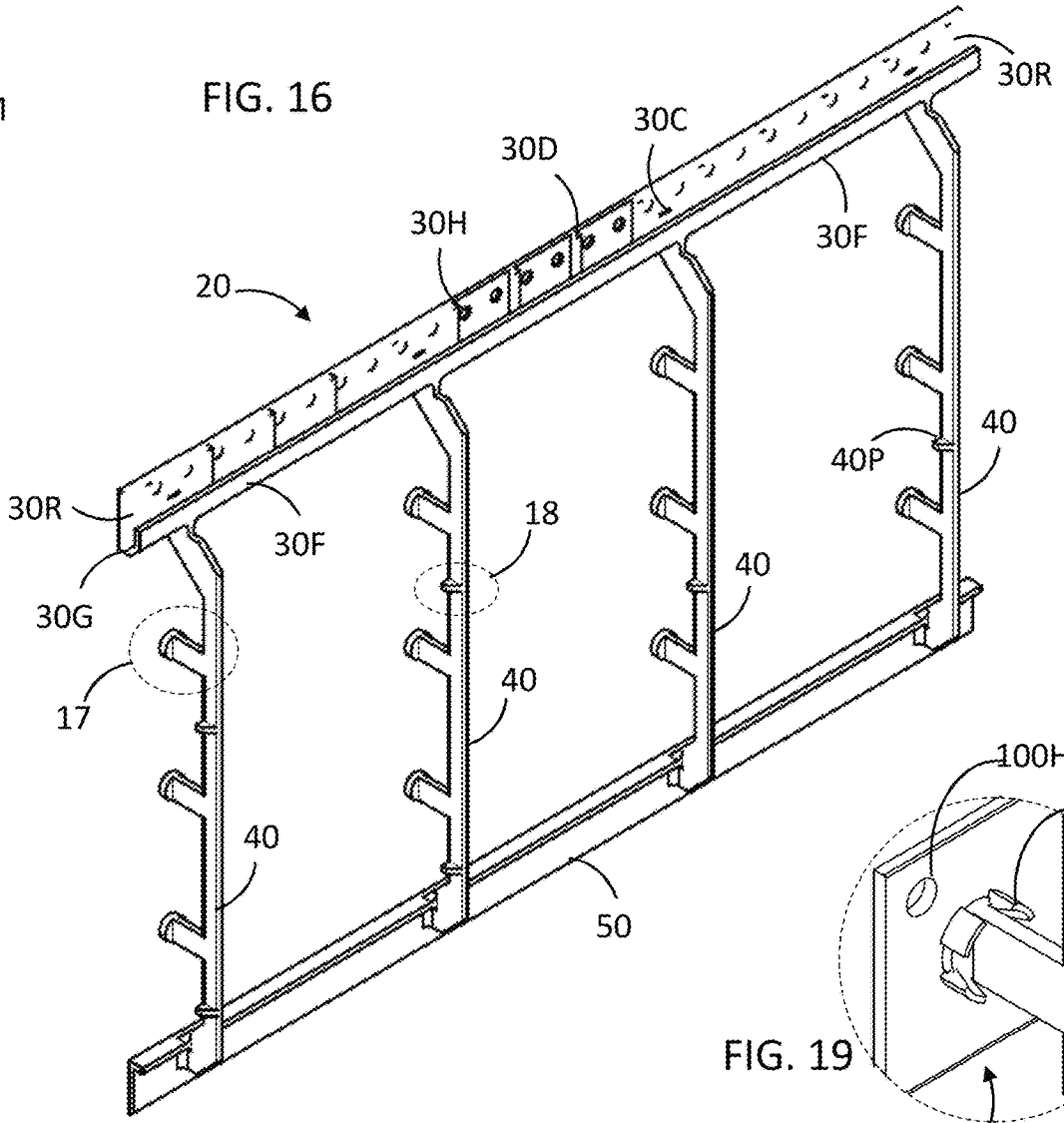
FIG. 16 is a perspective view of the molded frame shown in FIG. 14.

FIG. 14-16 provide three views of frame 20, which is shown in FIG. 2 as partially embedded in veneer panel 1. FIG. 14 provides a front view, FIG. 15 provides a side view, and FIG. 16 provides a front perspective view of frame 20. Frame 20 is formed with J-shaped fastening member 30, flange 50, and connecting rib 40 extending between J-shaped fastening member 30 and flange 50. J-shaped fastening member 30 and flange 50 form the upper horizontal member and the lower horizontal member, respectively, of frame 20. Connecting rib 40 extends vertically to connect J-shaped fastening member 30 to flange 50.

J-shaped fastening member 30 has an elongated structure formed with tall planar rear section 30R, short planar forward section 30F, and base section 30B extending therebetween from front-to-back or back-to front to form groove 30G. Groove 30G extends from a first end to a second end of J-shaped fastening member 30.

Tall planar rear section 30R is configured with a plurality of fastening holes 30H through which a fastener such as a nail, screw or bolt operates to secure frame 20 to a building surface. Tall planar rear section 30R is also configured with a plurality of short integrally formed ridges 30D uniformly spaced among fastening holes 30H. Though in frame 20, ridge 30D is integrally formed between pairs of fastening holes 30H, ridge 30D can be disposed between any number of fastening hole 30H, for example, between and separating one, two, three, four, five, more than five, or any combination thereof of fastening holes 30H, as convenient to provide clearance between the fastener (i.e. nail, screw or bolt) operating at holes 30H and flange 50 of another veneer panel or corner immediately above. As such, ridge 30D may also guide the positioning of flange 50 in groove 30G of the panel immediately below. Tall planar rear section 30R can include one or more cutout 30C through which a reinforcement member can be held to the frame 20. Though frame 20 is formed with seven of cutout 30C as shown in FIG. 14, the invention contemplates fewer than seven or more than seven of cutout 30C.

Groove 30G extends from a first end of J-shaped fastening member 30 to a second end of J-shaped fastening member 30 as shown in FIGS. 14 and 16. Groove 30G is sized to accommodate flange 50 of another frame 20 stacked directly above. Groove 30G is also positioned to vertically align with flange 50 as shown in FIG. 9A-9B. Groove 30G can include a curved bottom or a generally flat bottom.

Flange 50 has an elongated planar structure that extends laterally adjacent the bottom edge of frame 20. Flange 50 is sized to rest within groove 30G of another frame 20 stacked immediately below (FIG. 9A-9B), and thus flange 50 is sized to fit within groove 30G. Flange 50 is also positioned so the plane of flange 50, i.e. plane F, is forward of plane T (of tall planar rear section 30R) and rearward of plane S (of short planar forward section 30F) to allow flange 50 to align with and rest within groove 30G of another frame stacked immediately below (FIG. 9B).

Although J-shaped fastening member 30 extends linearly from a first end to a second end, the invention also provides a J-shaped fastening member with bend, i.e. a J-shaped fastening member formed with two sections that adjoin at an angle. Similarly, although flange 50 extends linearly from a first end to a second end, the invention also provides a flange having a bend, i.e. a flange formed with two flange sections that adjoin to form angle. In these embodiments, the first and second section of the two-section J-shaped fastening member or flange can have the same length or different lengths. For example, the two-section J-shaped fastening member and/or flange can have a first section that is longer than the second section. Alternatively, the two-section J-shaped fastening member and/or flange can have a first section that is shorter than the second section. And the two-section J-shaped fastening member and/or flange can have a first section that has the same length as the second section.

Connecting rib 40 extends between J-shaped fastening member 30 and flange 50 as shown in FIG. 14-16. Though frame 20 is formed with four connecting ribs 40, in other embodiments of the invention, the frame can be formed with fewer than four or more than four connecting ribs 40. For example, a frame for use in a veneer panel or corner can include one, two or three connecting ribs 40 as needed to secure a veneer body to a building surface. A frame for use in a veneer panel or corner also can include five, six, seven or more than seven vertical connecting ribs 40 to secure a veneer panel or veneer corner to a building surface.

For example, a frame for use with a veneer panel or veneer panel with a corner can include one connecting rib 40 extending between J-shaped fastening member 30 and flange 50 forming a shape resembling the letter "I." A frame for use with a veneer panel or veneer panel with a corner can be formed with two connecting ribs 40 extending between J-shaped fastening member 30 and flange 50. In a veneer panel with a corner, each orthogonal section of can be supported using one, two, three, four or more than four formed connecting rib 40 extending between a two-section J-shaped fastening member and a similar two-section flange, the two sections of the J-shaped fastening member and flange being at an angle. A frame for use with a veneer panel with a corner can be formed with a first connecting rib 40 where the two orthogonal sections adjoin and a second and third connecting rib 40, one within the veneer body of each orthogonal section. A plurality of connecting ribs 40 extending between J-shaped fastening member 30 and flange 50 can be used in larger panels or veneer corners with larger sections. The invention contemplates any number of connecting ribs 40 extending between J-shaped fastening member 30 and flange 50 as convenient to support the veneer panel or panel with a corner.

Connecting rib 40 (FIG. 15) is formed with main rib body section 40M and a first and a second rearward angled rib end portion 40T and 40B. Main rib body section 40M extends upwardly to a first end, where it bends rearwardly and continues to extend upwardly at an angle of about 45 degrees to from rib end portion 40T. As used herein, the term "rear" or "rearward" means towards or facing the building surface to which the veneer panel or corner is to be mounted. As illustrated in FIG. 15, rib end portion 40T adjoins main rib body portion 40M at a first end and extends rearwardly and upwardly to J-shaped fastening member 30, where the other end of rib end portion 40T adjoins the exterior and/or underside of groove 30G. Main rib body section 40M extends downwardly to a second end, where it also bends rearwardly and continues to extend downwardly at an angle of about 45 degrees to form rib end portion 40B. Rib end portion 40B adjoins main rib body section 40M at a first end and extends rearwardly and downwardly to flange 50, where rib end portion 40B adjoins flange 50. Rib end portion 40T is configured to position J-shaped fastening member 30 at first planar position (defined by the plane T of tall rear section 30R) above and rearward of the rear edge of first plane parallel side 10T of veneer body 10 within which frame 20 is embedded as shown in FIG. 9A. Rib end portion 40B is configured to position flange 50 at a second planar position (defined by the plane F of flange 50) forwardly of the first planar position, i.e. plane T, as shown in FIG. 9B. Rib end portion 40B is configured to position flange 50 adjacent and rearward of the bottom edge of rear face 10R of veneer body 10 within which frame 20 is embedded as shown in FIG. 9A. In short, rib end portions 40T and 40B are configured to achieve the relative positions of the J-shaped fastening member 30 and flange 50 to enable flange 50 to align with groove 30G thereby enabling flange 50 to sit in groove 30G of a veneer panel or corner directly below (FIG. 9A-9B).

Figure 18:
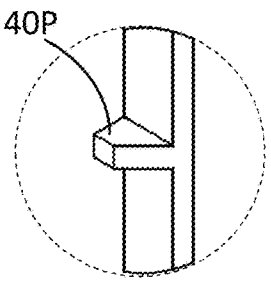
FIG. 18 is an enlarged view of an anchoring protrusion on the frame shown in FIG. 16.

Connecting rib 40 is also configured with at least one or a plurality of integrally formed protrusion 40P (FIG. 18) to improve adhesion and retention in veneer body 10 within which frame 20 is embedded. In frame 20 (FIG. 16), the plurality of protrusion 40P are located along the left and right sides of connecting rib 40; each protrusion 40P projecting laterally from main rib body section 40M alternating between the left or right side of main rib body section 40M. In other embodiments, protrusion 40P can be located at any embedded portion of the frame. Protrusion 40P is an integrally formed part of frame 20 and functions to increase the surface area of contact between frame 20 and veneer body 10, thereby enhancing adhesion and retention of frame 20 within the veneer body 10. Although protrusion 40P in frame 20 is formed with a three dimensional structure resembling a trapezoidal prism (FIG. 18), in a frame of the invention, the protrusion anchors, of which protrusion 40P is an example, can have any regular or irregular shape or three-dimensional structure so long as they maintain an embedded position within the veneer body to improve adhesion and retention of the frame in the veneer body. Thus, the protrusion anchors in a frame of the invention can have any number of sides that meet at right angle, at an obtuse angle or at an acute angle and can have jagged or smooth edges.

Figure 17:
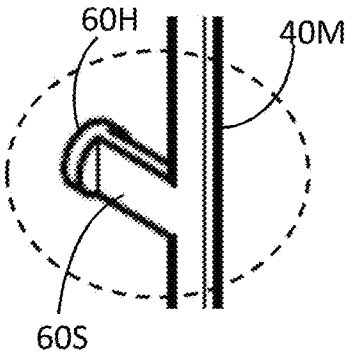
FIG. 17 is an enlarged view of the orthogonal support member on the frame shown in FIG. 16.
Figure 19:
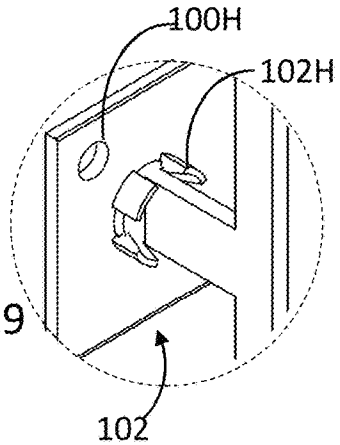
FIG. 19 is an enlarged view of a mating pair formed by the orthogonal support member of FIG. 17 and the snap fastener shown in FIG. 4A for supporting a veneer panel or corner fabricated with the frame shown FIG. 16.

Connecting rib 40 is also fabricated with at least one male connector in the form of orthogonal support member 60 (FIG. 19). In frame 20, orthogonal support member 60 is a male connector that facilitate mounting of veneer panel 1 with embedded frame on a surface of a building. Orthogonal support member 60 extends rearwardly from an embedded portion of frame 20, for example, from main rib body section 40M (FIG. 16-17). Orthogonal support member 60 extends to the exterior of veneer body 10 within which frame 20 is embedded (FIG. 2). As shown in FIG. 17, each orthogonal support member 60 has stem 60S extending rearwardly to button-shaped support head 60H. Button-shaped support head 60H is a disk-shape structure that adjoins stem 60S to form a notch where the stem 60S and button-shaped support head 60H connects to allow it to operate as a male snap fastener. For example, orthogonal support member 60 can form a snap-in joint with a female connector that includes two or more inward facing cantilever hook 102H as shown in FIG. 4A-4D. In these embodiments, the two or more inward facing cantilever hook 102H define a space that can be occupied by orthogonal support member 60 (FIG. 19) or another orthogonal support member of the invention. During installation, the two or more inward facing cantilever hook 102H deflect to create an opening effective to receive, or for insertion of, orthogonal support member 60 between the two or more inward facing cantilever hook 102H. When returned to their original, undeflected positions, the two or more inward facing cantilever hook 102H catch in the notch behind button-shaped support head 60H, where button-shaped support head 60H connects with stem 60S, thereby retaining the inserted orthogonal support member 60 and forming a snap in joint.

Though frame 20 is configured to include three orthogonal support member 60 on each connecting rib 40 (FIG. 15-16), a frame of the invention can be formed with any number of orthogonal support member 60, which can be on connecting rib 40 or on any other embedded portion of frame 20. For example, a frame of the invention can be formed with one, two, three, four or more than four orthogonal support member 60 on each connecting rib 40. In some embodiments, frame of the invention can be formed with a connecting rib that has no orthogonal support member 60.

Frame 23

Figure 21:
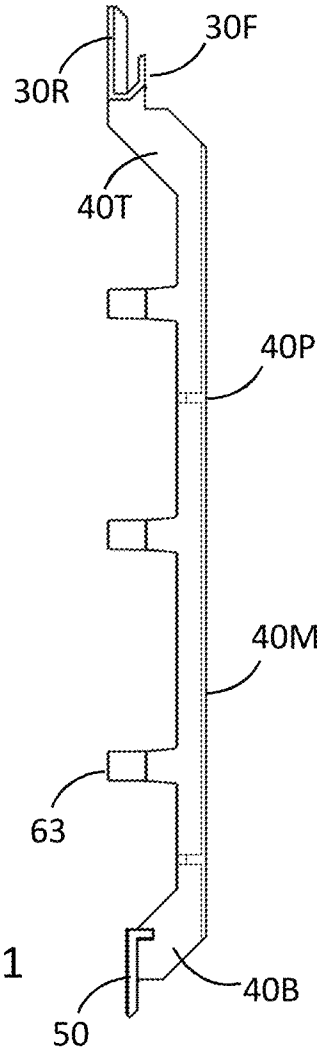
FIG. 21 is a side view of the frame shown in FIG. 20.
Figure 20:
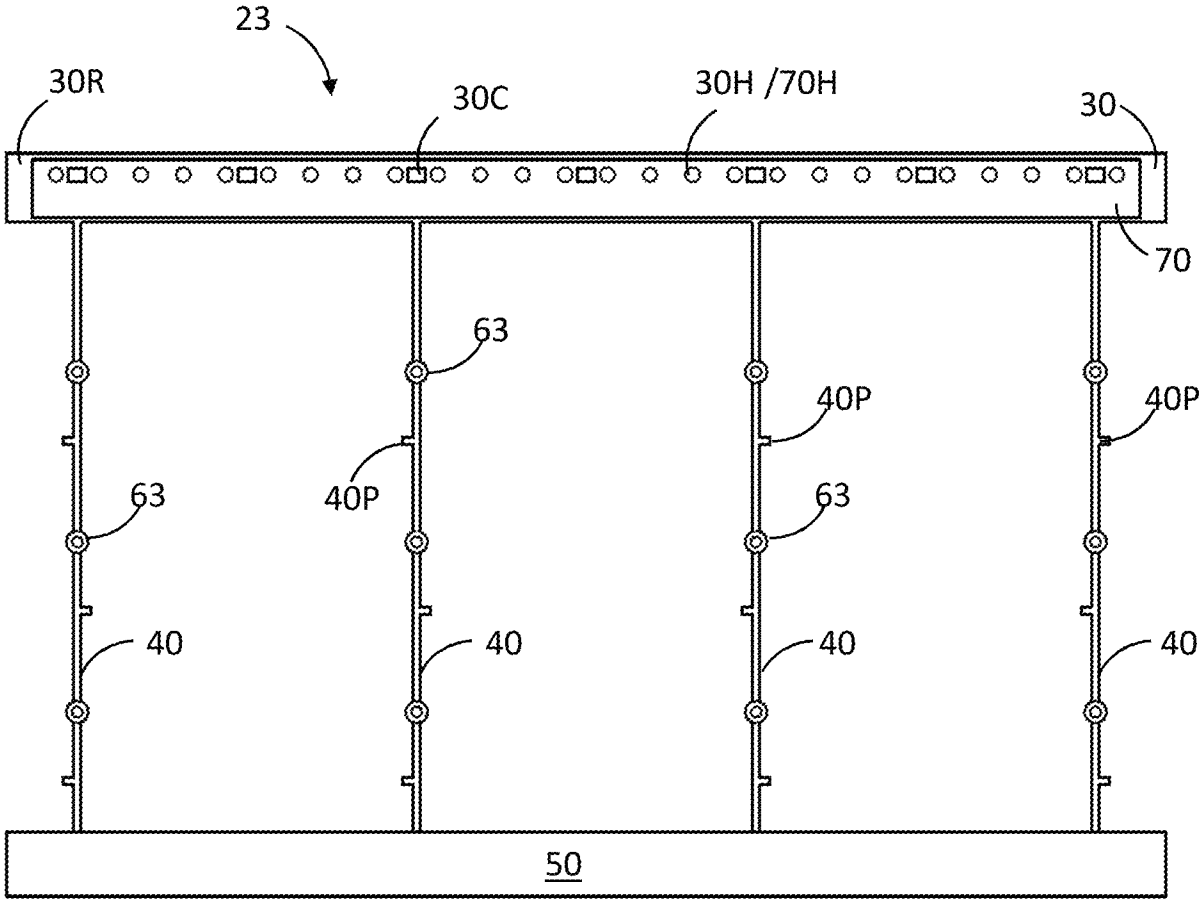
FIG. 20 is a rear view of another embodiment of a frame according to the invention.
Figure 22:
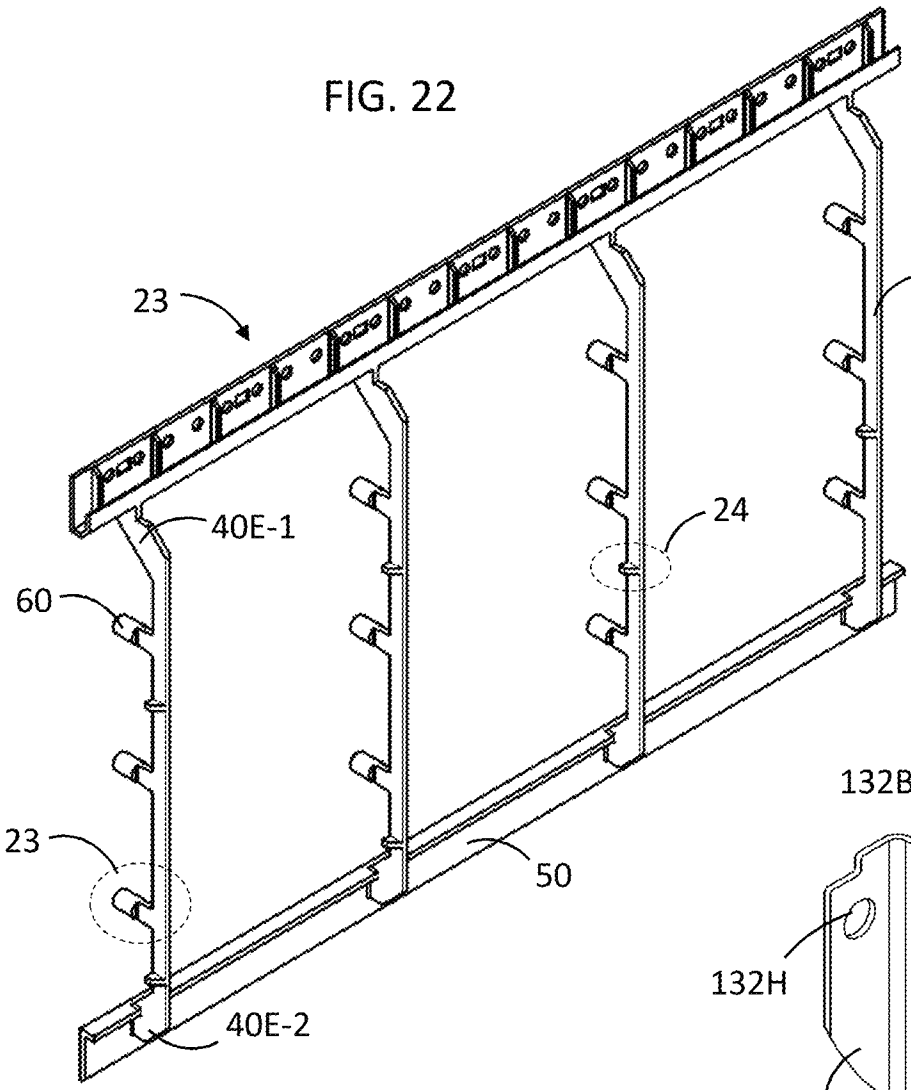
FIG. 22 is a perspective view of the frame shown in FIG. 20.

Frame 23 illustrated in FIG. 20-22 is another embodiment of a frame of the invention. Frame 23 is fabricated with a different male connector in the form of orthogonal support member 63.

FIG. 20-22 provide three views of frame 23, which is shown partially embedded in veneer panel 3 in FIG. 5-6. FIG. 20 provides a rear view, FIG. 21 provides a side view, and FIG. 22 provides a front perspective view of frame 23. Like frame 20, frame 23 is formed with J-shaped fastening member 30, flange 50, and connecting rib 40 extending between J-shaped fastening member 30 and flange 50. J-shaped fastening member 30 and flange 50 form the upper horizontal member and the lower horizontal member, respectively, of frame 23. Connecting rib 40 extends vertically to connect J-shaped fastening member 30 to flange 50. The structure of J-shaped fastening member 30, flange 50 and connecting rib 40 are as described above.

Figure 25:
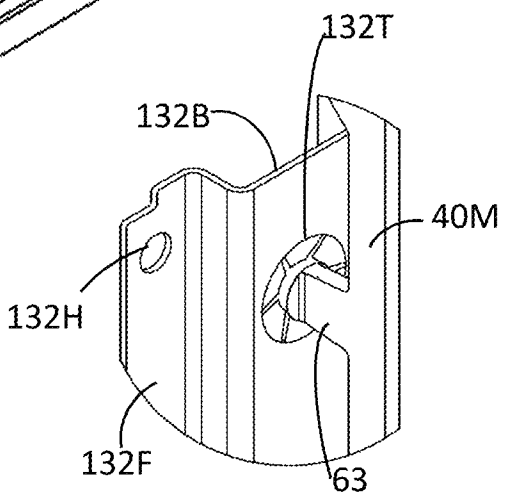
FIG. 25 is an enlarged view of a mating pair formed by the orthogonal support member of FIG. 23 and the push-in fastener shown in FIG. 8A for supporting a veneer panel or corner fabricated with the frame shown FIG. 22.
Figure 23:
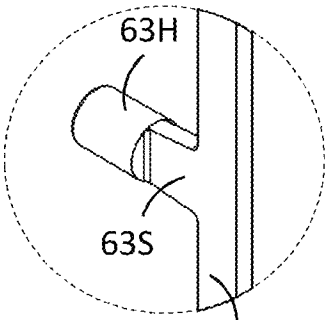
FIG. 23 is an enlarged view of the orthogonal support member on the frame shown in FIG. 22.
Figure 24:
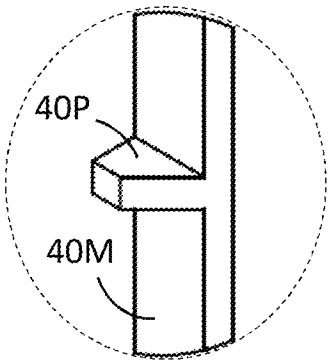
FIG. 24 is an enlarged view of an anchoring protrusion on the frame shown in FIG. 22.

Frame 23 differs from frame 20 in that frame 23 incorporates a modified male connector in the form of orthogonal support member 63 as shown in FIG. 23. Like orthogonal support member 60 in frame 20, orthogonal support member 63 provide support for installation of veneer panel 3 on a surface of a building. Orthogonal support member 63 extends rearwardly from an embedded portion of frame 23, for example, main rib body section 40M (FIG. 21-23). Orthogonal support member 63 extends to the exterior of veneer body 10 within which frame 23 is embedded. As shown in FIG. 23, each orthogonal support member 63 has stem 63S extending rearwardly to cylindrical support head 63H. Cylindrical support head 63H adjoins stem 63S to form a male connector that can be used to establish a push in joint. For example, orthogonal support member 63 can form a push-in joint with a female push connector such as female push connector 102 shown in FIG. 8A-8C. In these embodiments, retention tabs such as 132T define a space that can be occupied by orthogonal support member 63. During installation, the edges of two or more radial retention tab 132T deflect inward in the direction of insertion to create an opening effective to receive, or for insertion of, orthogonal support member 63 between two or more radial retention tab 132T (FIG. 25). Once inserted, the two or more radial retention tabs 132T clamps into cylindrical support head 63H to prevent movement of orthogonal support member 63 in the reverse direction, thereby retaining the inserted orthogonal support member 63 in a push in joint.

Though frame 23 illustrated in FIG. 20-22 is configured to include three orthogonal support member 63 on each connecting rib 40, a frame of the invention can be formed with any number of orthogonal support member 63, which can be on connecting rib 40 or on any other embedded portion of frame 23. For example, a frame of the invention can be formed with one, two, three, four or more than four orthogonal support member 63 on each connecting rib 40. In some embodiments, frame of the invention can be formed with a connecting rib that has no orthogonal support member 63. In other embodiments, frame of the invention can be formed with a connecting rib that has any combination of orthogonal support member 60 and 63.

Frame—Generally

The frame can be constructed of a variety of materials including metal, metal alloy, steel, plastic, thermoplastic, or a natural or synthetic polymer.

A frame for use in a veneer panel of the invention can be integrally formed with a J-shaped fastening member, one or more connecting rib, flange and one or more orthogonal support members. Alternatively, the frame can be formed by assembling one or more separately formed components. Anyone one or more of the components of the frame can be separately formed and then attached using a methods known in the art. Components can be attached using an adhesive, other chemical bonding methods, heat bonding, welding, brazing, soldering, through one or more mechanical connectors or mechanical connecting means snap fitting components in which one member deflects to engage a second member at a notched area.

V. Two-Section Reinforcement Member

Figure 26:
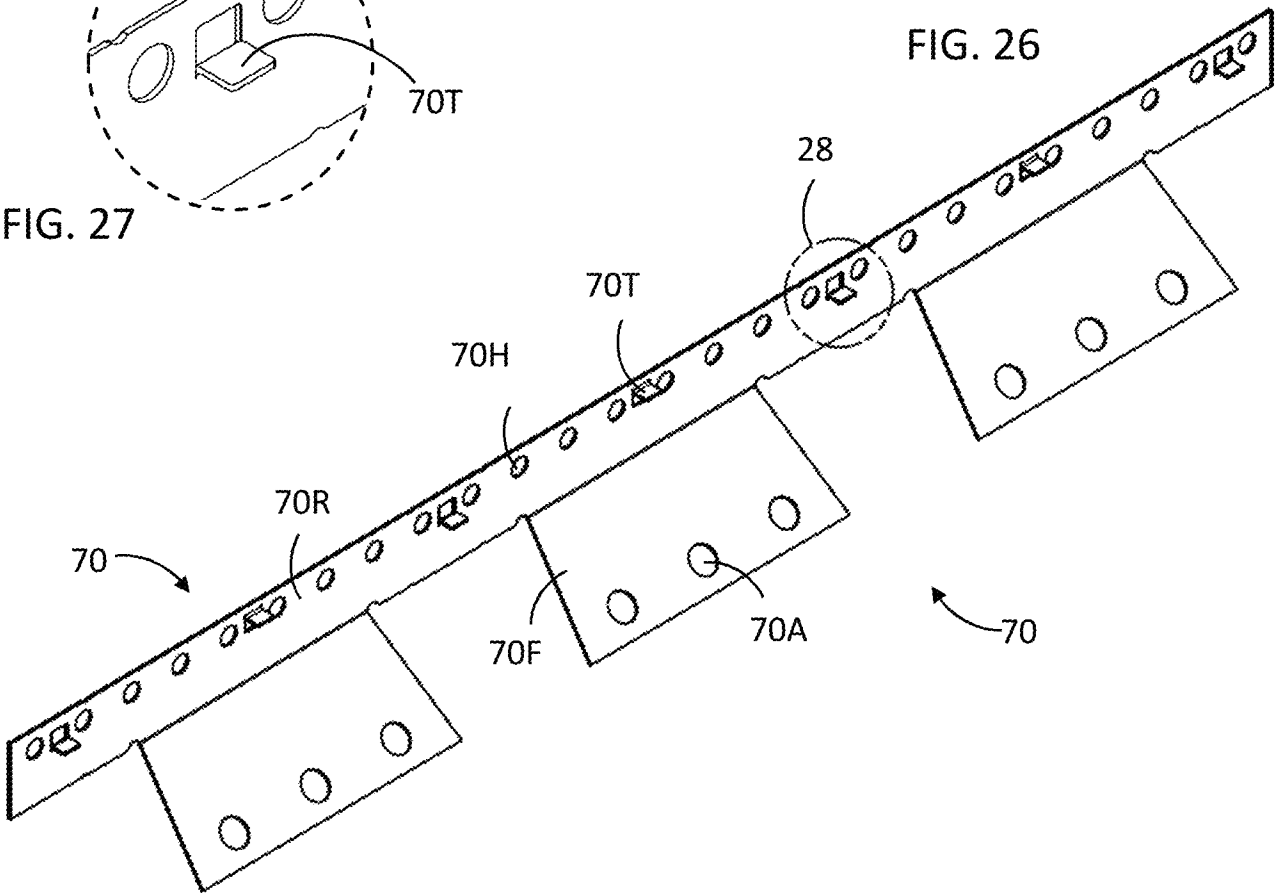
FIG. 26 is a perspective view of a two-section reinforcement member for use with the frame of FIG. 14 or 20.
Figure 43:
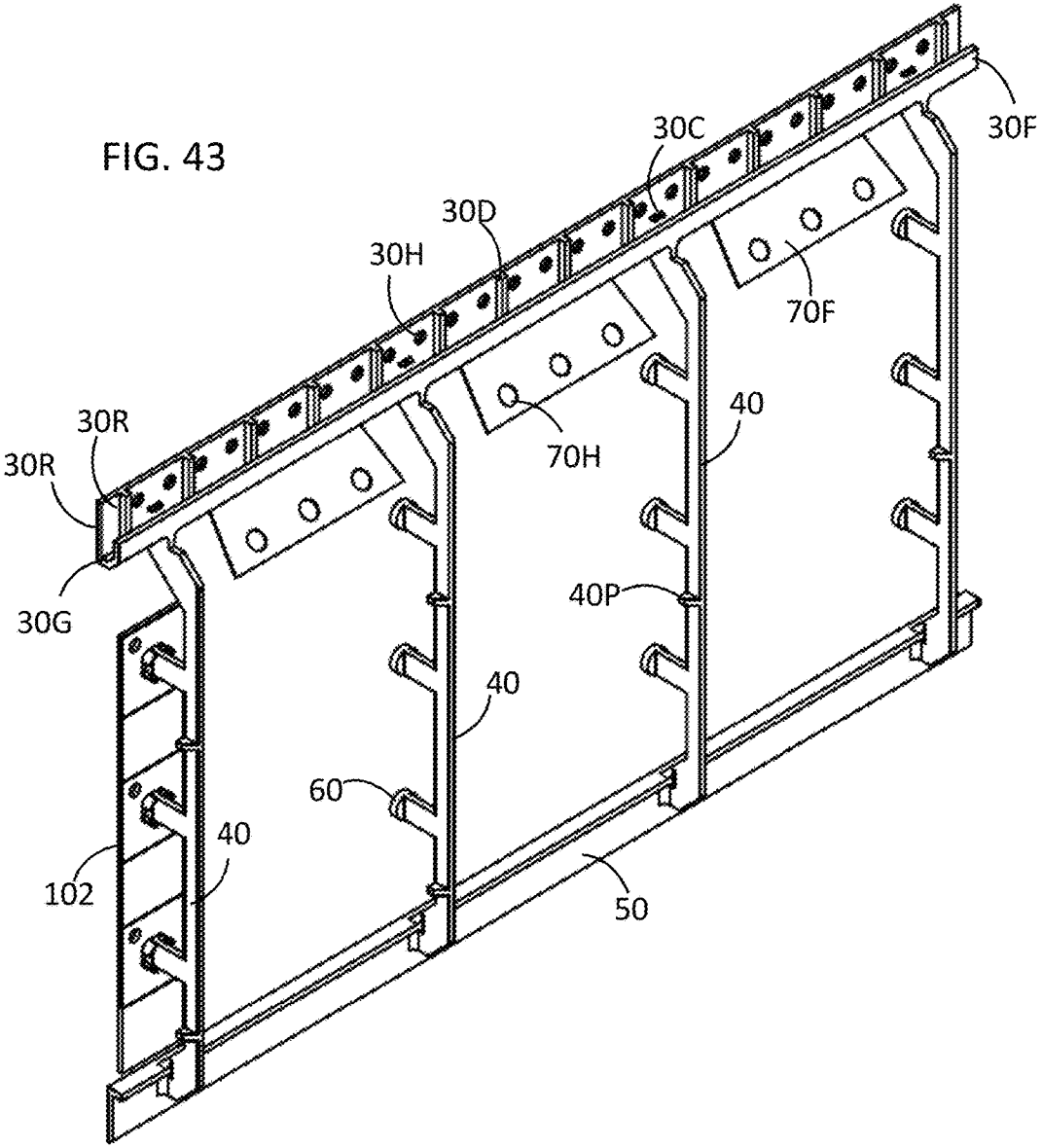
FIG. 43 is a perspective view of a sub-assembly that includes the frame of FIG. 14 and the two-section reinforcement member of FIG. 26, shown with mounting strip of FIG. 4A-4C.
Figure 44:
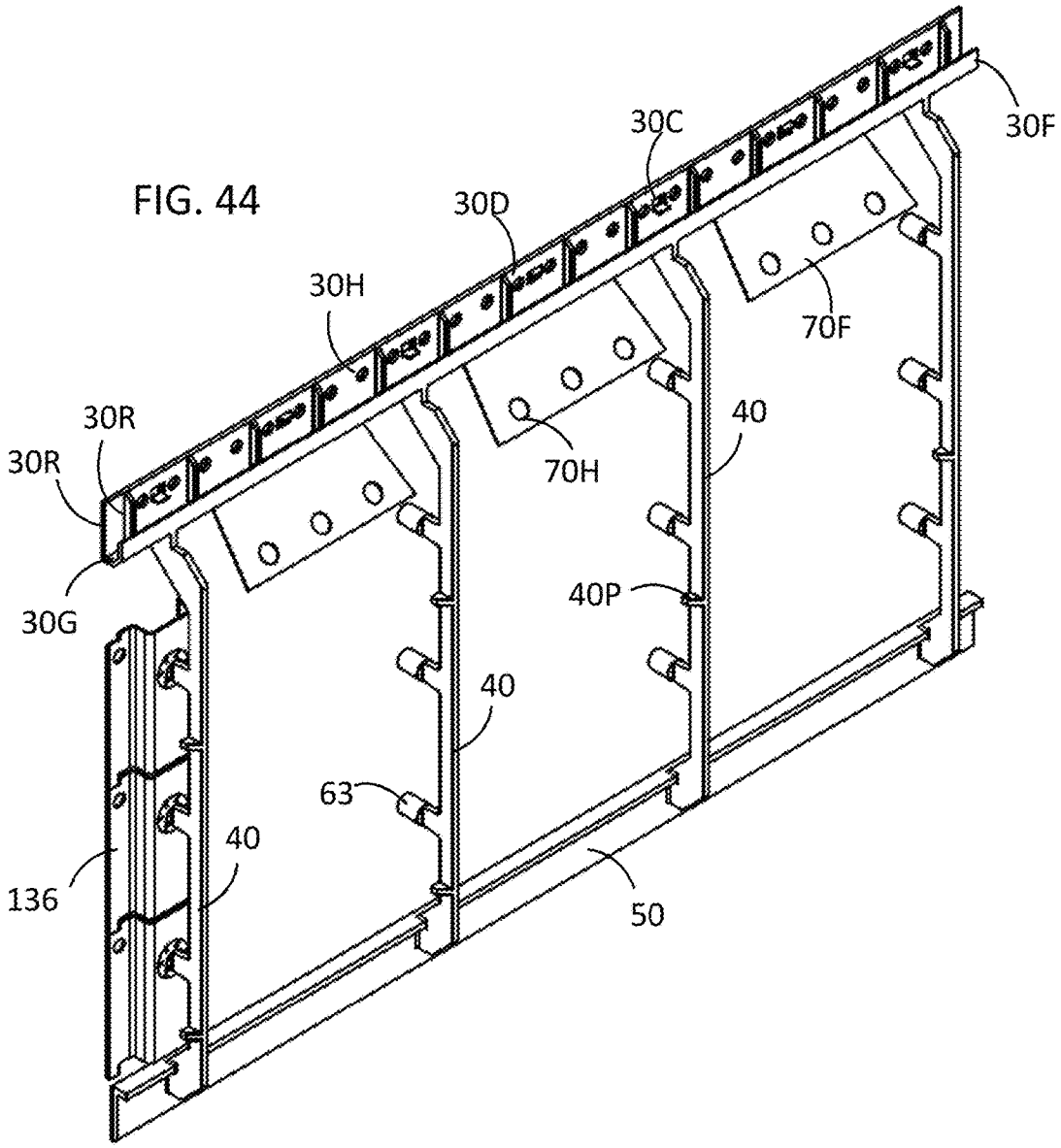
FIG. 44 is a perspective view of a sub-assembly that includes the frame of FIG. 20 and the two-section reinforcement member of FIG. 26, shown with mounting strip of FIG. 8A-8C

In some embodiments of the invention, a two-section reinforcement member can be used to provide added support to the frame in a veneer panel or veneer corner of the invention. FIG. 26 provides a perspective view from the front of two-section reinforcement member 70, and FIG. 28B provides a top view. Reinforcement member 70 is configured to operate with and reinforce J-shaped fastening member 30 of frame 20/23. Reinforcement member 70 is formed with elongated reinforcement section 70R and three evenly spaced anchoring fin 70F (FIG. 26). Reinforcement section 70R is configured to fit behind the rear of J-shaped fastening member 30, laying flush against the rear of tall planar rear section 30R as shown in FIG. 20. Anchoring fin 70F adjoins reinforcement section 70R at an angle of about 45 degrees such that when reinforcement section 70R is fixed to the rear of J-shaped fastening member 30, anchoring fin 70F extends forwardly folding beneath a portion of J-shaped fastening member 30 (FIG. 43-44). As such, the three evenly spaced anchoring fin 70F are embedded in the veneer body of a veneer panel or veneer corner when used with a frame of the invention.

Figure 27:
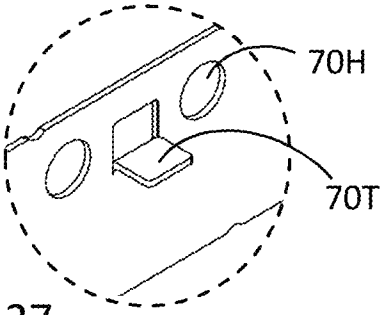
FIG. 27 is an enlarged perspective view of a flexural, fold-over frame connector according to the invention.
Figure 30A:
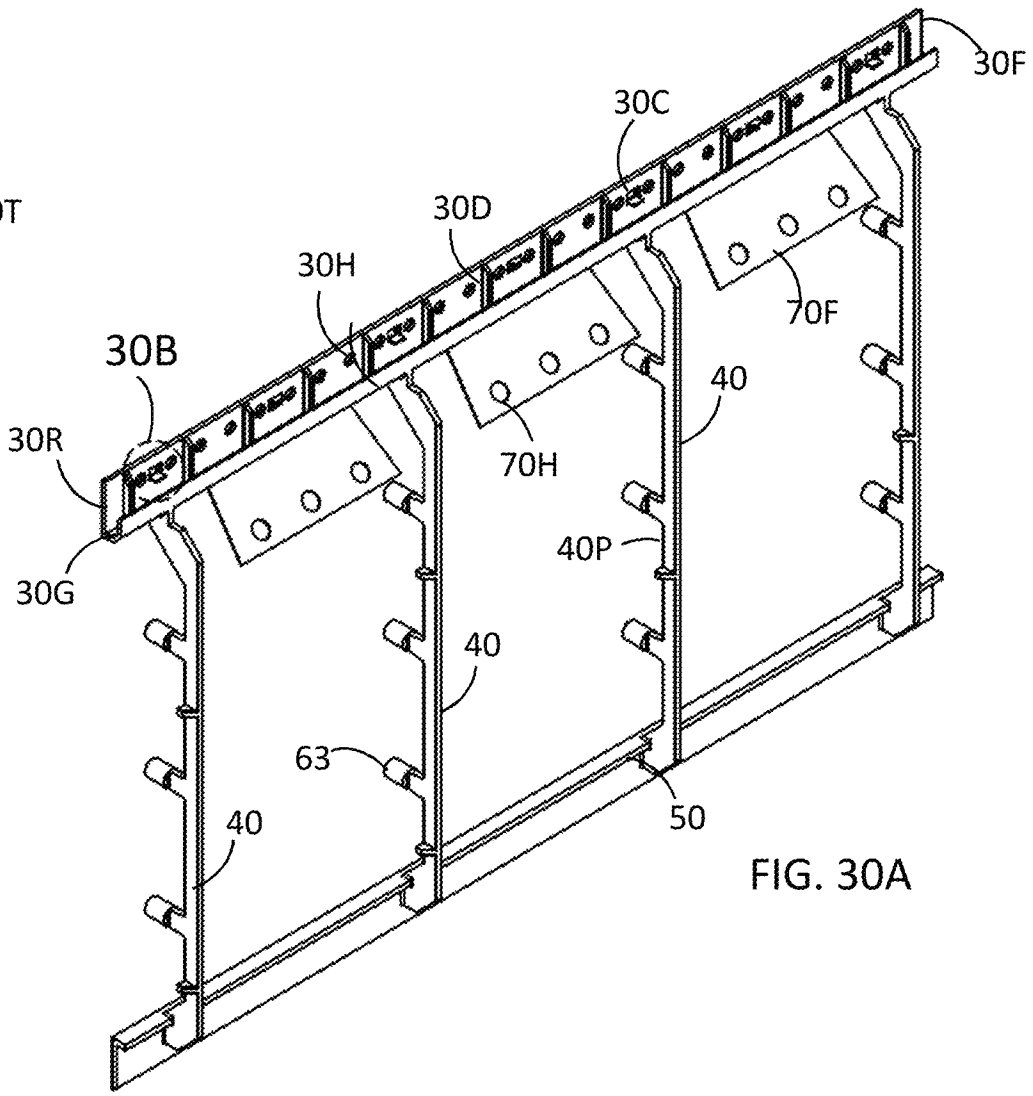
FIG. 30A-30B are a front perspective view of a subassembly (30A) that includes a frame of the invention in combination with a two-section reinforcement member of FIG. 26 secured to the rear of the J-shaped fastening member of the frame, and an enlarged view of a flexural frame connector folded-over a cutout in the J-shaped fastening member (30B).
Figure 30B:
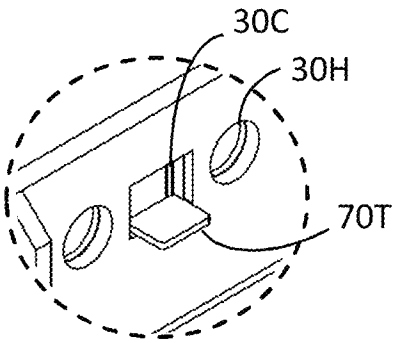

Reinforcement section 70R is configured with a plurality of fastening holes 70H spaced to align with plurality of fastening holes 30H on tall planar rear section 30R of J-shaped fastening member 30 when reinforcement section 70R is placed flush against the rear of tall planar rear section 30R. Reinforcement section 70R is formed with fold-over tab frame connector 70T that aligns with cutout 30C on tall planar rear section 30R of J-shaped fastening member 30. FIG. 27 provides a perspective view of fold-over tab frame connector 70T, and FIG. 29 provides a top view. Tab frame connector 70T is configured to extend through cutout 30C to limit movement and prevent separation of reinforcement member 70 from J-shaped fastening member 30.

Anchoring fin 70F is an embedded portion of reinforcement member 70. Anchoring fin 70F is angled with respect to reinforcement section 70R to allow anchoring fin 70F to be embedded in the veneer body when utilized in a veneer panel or corner of the invention. Anchoring fin 70F includes three opening 70A through which veneer body material can be extruded to improve anchor the two-section reinforcement member 70 in the veneer body. Reinforcement member 70 can be used to reinforce J-shaped fastening member 30 of frame 20 or 23 as shown in the subassembly of FIG. 5.

In another embodiment of a reinforcement member of the invention, frame connector of which 70T is an example, can be a snap-in connector rather than fold-over tab 70T. The snap-in connector can be configured to include a flexible stem extending to a hook, the flexible stem enabling the connector to deflect and fit through cutout 30C on J-shaped fastening member 30 and the terminal hook catching on the other side cutout 30C to secure reinforcement member 70 to J-shaped fastening member 30.

Though two-section reinforcement member 70 is formed with three anchoring fins, a two-section reinforcement member of the invention can have one, two, three, four or more than four anchoring fins as needed. Each fin in a reinforcement member of the invention can have any number of openings to improve anchor in the veneer body. Each fin in a reinforcement member of the invention can have no opening, one opening or a plurality of openings, uniformly or non-uniformly spaced on each fin. A two-section reinforcement member of the invention can have a fin with no opening or a fin with one or more openings, for example, two, three, four, five or more than five openings. A two-section reinforcement member of the invention can have one or more fins, for example, two, three, four, or more than four fins. In these embodiments the fins can have the same or different number of holes. In a two-section reinforcement member of the invention the reinforcement section and fin form an angle greater 90° and less than 180°, for example, an angle of about 95°, 100°, 105°, 110° 115°, 120°, 125°, 130°, 135°, 140°, 145°, 150°, 155°, 160°, 165°, 170° or 175°. Where a two-section reinforcement member of the invention is has more than one fin, the angle formed between each fin and reinforcement section can be the same or different than the angle formed by one or more of the other fins and the reinforcement section.

Where present, the two-section reinforcement member can be attached to the J-shaped fastening member using any means known to the art including, for example, the use of mating connectors in which one member of a pair of mating connector is an integrally formed part of the two-section reinforcement member and the other member of the pair of mating connector is integrally formed part of the J-shaped fastening member. The members of the pair of mating connectors are situated on the two-section reinforcement member and the J-shaped fastening member such that they are aligned and operable to form a mating pair when the two-section reinforcement member and the J-shaped fastening member are positioned so their respective fastening holes align. The pair of mating connectors can be any snap-in connectors, which are well known in the art, as well as a flexural or foldable component. Alternatively, the two-section reinforcement member can be attached to the J-shaped fastening member using an adhesive.

IV. Backing & Mounting Components

A veneer panel or veneer corner provided by the invention can be fabricated with a backing to facilitate installation on a building surface. FIG. 31 provide a front perspective view of a two-section backing shown without veneer body 12. As used herein, the term "front" used in reference to a backing of the invention refers to the side of the backing facing the veneer body.

Two-section backing 22 is formed with primary backing section 22-1, secondary backing section 22-2, and raised peripheral edges 22E resulting in a setting space enclosing rear face 12R of veneer body 12. Primary backing section 22-1 and secondary backing section 12-2 are attached at hinge 22H, which enable backing 22 to form a veneer panel with a corner having any useful angle. Primary backing section 22-1 is formed with: (1) two horizontally extending parallel slots 22S (i.e. a higher positioned slot 22S-1 and a lower positioned slot 22S-2); (2) two mounting member attachment means 82 above slot 22S-1, (3) two mounting member attachment means 82 below slot 22S-2, and (4) two stop 22P, one above the right end of slot 22S-1 and one stop 22P below the left end of slot 22S-2 to limit movement of a three-section mounting member. The horizontally extending parallel slots 22S are elongated structures that are parallel to a peripheral edge of a pair of opposite and parallel peripheral edges at the top and bottom of the backing (FIG. 31, 22E-T, 22E-B).

FIGS. 32 and 33 illustrate the structures of mounting member attachment means 82 and stop 22P, respectively. Mounting member attachment means 82 has round button head 82H supported by a narrow stem 82S adjoining head 82H and backing 22. Stop 22P has a wedge shape structure that functions to maintain a three-section mounting member in a lock position against backing section 22-1 as further discussed below. The positions of mounting member attachment means 82 and stop 22P define a first mounting region above slot 22S-1 and a second mounting region below slot 22S-2. Configured as such, backing 22 shown in FIG. 31 can be used orientation shown in FIG. 31, or in an inverted orientation relative to that in FIG. 31, i.e. turned 180 degrees. Backing 22 can also be used to form a veneer panel with no angle or an angle of 180 degrees. Veneer panels such as panel 1 and 3 can be formed by pivoting sections 22-1 and 22-2 about hinge 22H to so sections 22-1 and 22-2 are about 180 degrees apart.

An example of a three-section mounting member provided by the invention is illustrated in FIG. 34A-34C. FIG. 34A provide a front view, FIG. 34B provide a side view, and FIG. 34C provide a right perspective view of three-section mounting member 72 for use with backing 22.

Figure 37:
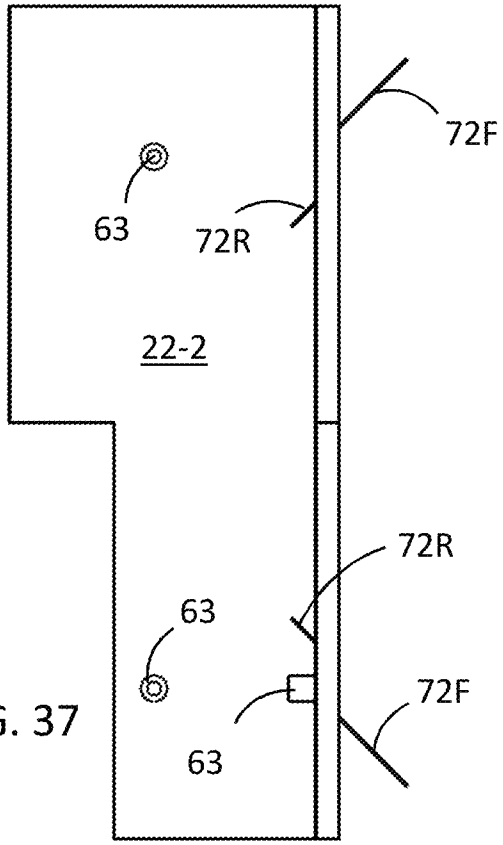
FIG. 37 is a left side view of the rear of the subassembly shown in FIG. 35.

Three-section mounting member 72 includes a veneer body anchoring fin 72F and hanger section 72R, each of which having a generally planar structure that adjoins a backing attachment mid-section 72M at a first obtuse angle $O_1$ and a second obtuse angle $O_2$. Respectively (FIG. 34B). Veneer body anchoring fin 72F has a plurality of rectangular openings 72H through which veneer body material is extruded to improve retention with the veneer body. Veneer body anchoring fin 72F adjoins backing attachment mid-section 72M to form a first obtuse angle $O_1$ of about 135° with backing attachment mid-section 72M. Hanger section 72R adjoins backing attachment mid-section 72M to form a second obtuse angle $O_2$ also of about 135° with backing attachment mid-section 72M. Thus, three-section mounting member 72 operates through slot 22S of primary backing section 22-1 to provide a mounting mechanism for veneer corner 2. As shown in FIG. 35-37, veneer body anchoring fin 72F and adjoining backing attachment mid-section 72M operate on the front side of primary backing section 22-1, i.e. within the setting space defined by primary backing section 22-1 with peripheral edges 22E. Adjoining hanger 72R, which extends through slot 22S, operates on the rear side of primary backing section 22-1, i.e., where a veneer panel or veneer corner faces and/or contacts a building surface as illustrated in FIG. 37. Hanger 72R extends outwardly and downwardly from the rear of backing section 22-1 to form a second acute angle or hanging angle $h_2$ of about 45° (FIG. 34B, 37).

Backing attachment mid-section 72M of three-section mounting member 72 is secured to primary backing section 22-1 through mounting member attachment means 82 operating through keyhole cutout 72K (FIG. 35-36). Backing attachment mid-section 72M is configured with two keyhole cutout 72K (FIG. 34A, 34C), which are spaced apart the same distance as mounting member attachment means 82 on primary backing section 22-1. Keyhole cutout 72K has a first cutout opening extending to a second cutout opening. First keyhole cutout opening 72K-1 is wider than second keyhole cutout opening 72K-2 (FIG. 34A, 34C) and is dimensioned to accommodate round button head 82H of mounting member attachment means 82 as three-section mounting member 72 is placed against primary backing section 22-1. Second keyhole cutout opening 72K-2 is narrower than first cutout opening 72K-1 and is dimensioned to accommodate narrow stem 82S of mounting member attachment means 82 to retain the mounting member attachment means 82 in a locked position as shown in FIG. 35-36.

To secure three-section mounting member 72 to backing 22, three-section mounting member 72 is placed in a first position such that (1) hanger 2R extends through slot 22S to the rear of primary backing section 22-1, and (2) mounting member attachment means 82 aligns with and passes through first keyhole cutout opening 72K-1. As such, backing attachment mid-section 72M lays flush against primary backing section 22 within the setting space. To firmly secure three-section mounting member 72 to primary backing section 22-1, three-section mounting member 72 is shifted left to a second, locked position shown in FIG. 35, 36 (slot 22S being wider than the width of hanger 72R). In the locked position, stem 82S of mounting member attachment means 82 occupies second keyhole cutout opening 72K-2, and the right edge of backing attachment mid-section 72M is held against stop 22P, which hinders movement of three-section mounting member 72 in the reverse direction. Positioned as such, wide head portion 82H prevents separation of three-section mounting member 72 from primary backing section 22-1 in a first direction away from the surface of primary backing section 22-1, and stop 22P prevents lateral movement of three-section mounting member 72 to a position enabling retraction of wide head portion 82H though first keyhole cutout opening 72K-1.

When secured to primary backing section 22-1 as described above, higher positioned anchoring fin 72F of three-section mounting member 72 extends outwardly and upwardly from primary backing section 22-1 to form a first acute angle $A_1$ (FIG. 34B) with the portion of the primary backing section 22-1 that is above the first mounting region (and a first obtuse structural angle $O_1$ with the backing attachment mid-section 72M). At the rear, higher positioned hanger 72R extends outwardly and downwardly from the rear of primary backing section 22-1 to form a second acute hanging angle $h_2$ with the portion of the primary backing section 22-1 below slot 22S (a second obtuse structural angle $O_2$ with backing attachment mid-section 72M). As used herein, the term "hanging angle," used in reference to a three-section mounting member of the invention, refers to the angle that is supplementary to the structural angle formed between backing attachment mid-section and hanging rail of a three-section mounting member of the invention.

In contrast, when secured to primary backing section 22-1 as described above, lower positioned anchoring fin 72F of three-section mounting member 72 extends outwardly and downwardly from primary backing section 22-1 to form an acute angle with the portion of the primary backing section 22-1 that is below the second mounting region (i.e. the portion of primary backing section 22-1 against which the backing attachment mid-section 72M is secured) and an obtuse structural angle with the backing attachment mid-section 72M as shown in FIG. 37. At the rear, lower positioned hanger 72R extends outwardly and upwardly from the rear of primary backing section 22-1 to form an acute hanging angle (i.e. with a portion of the primary backing section 22-1 above slot 22S-2) and an obtuse angle with the second mounting region or frame attachment mid-section 72M.

Figure 38:
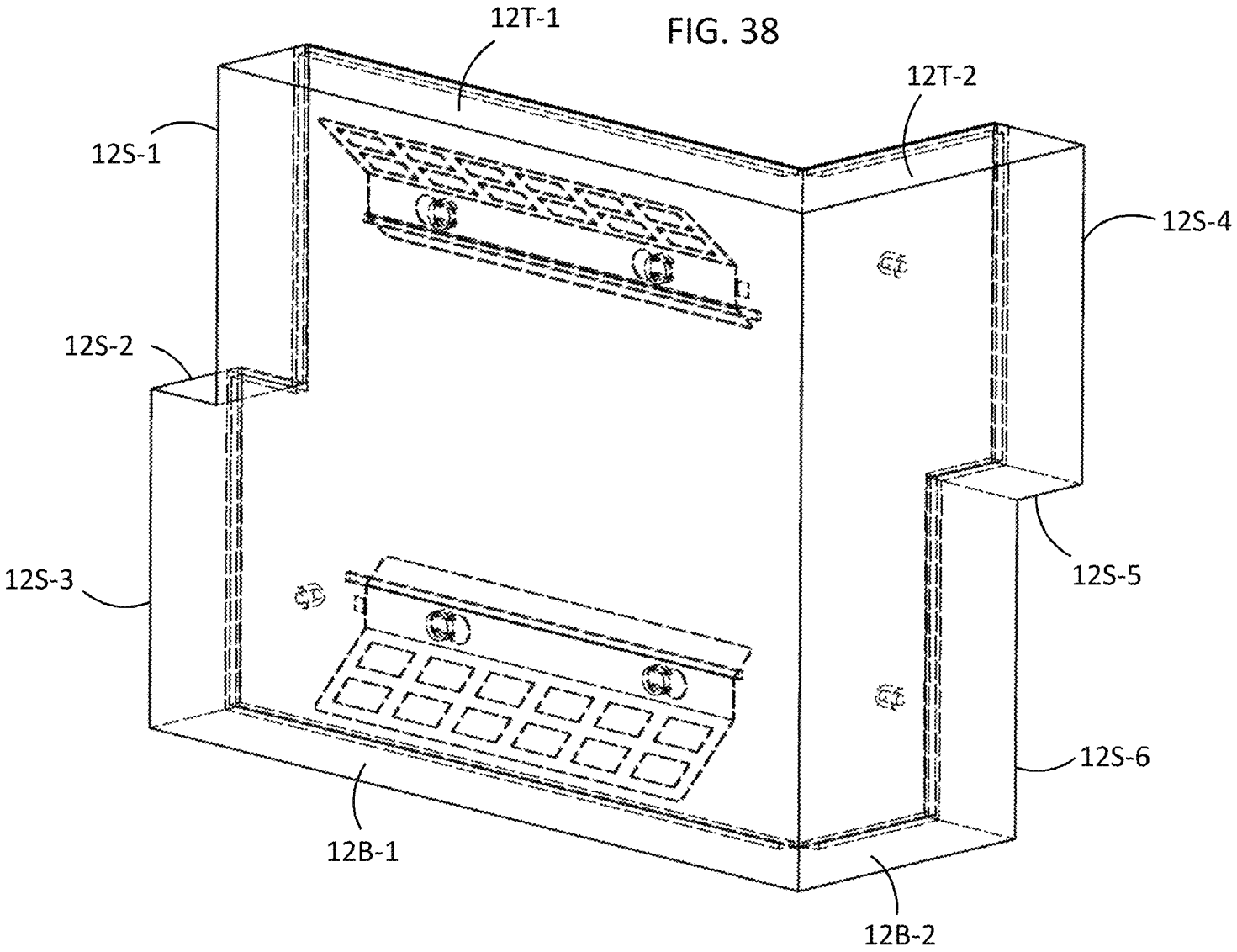
FIG. 38 is a front perspective view of the body of a veneer corner shown with embedded mounting components and rear backing in dashed lines.

FIG. 38 provides a view of a veneer corner 2 with body 12 and backing 22 depicted in broken lines enclosing the rear face of body 12.

Figure 39A:
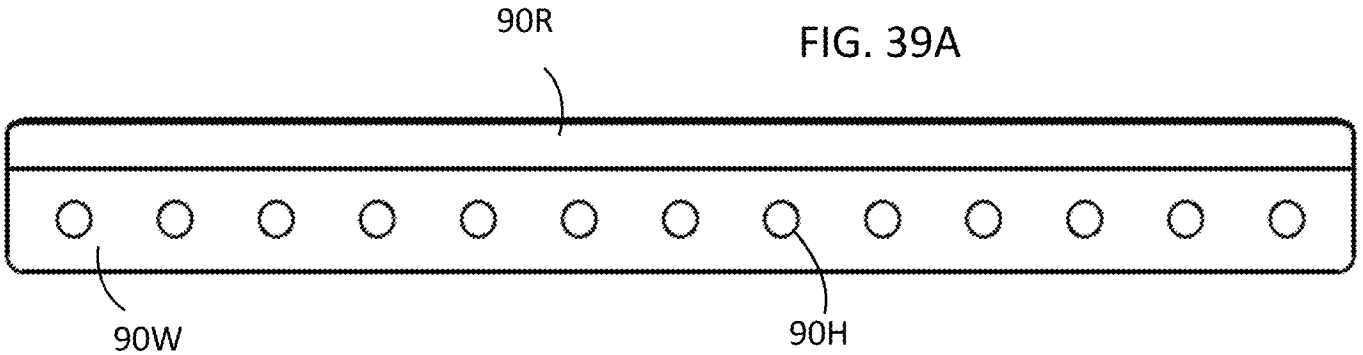
FIG. 39A-39C are a front side view, a right-side view, and a right perspective view of another embodiment of a mounting rail according to the invention.
Figure 39B:
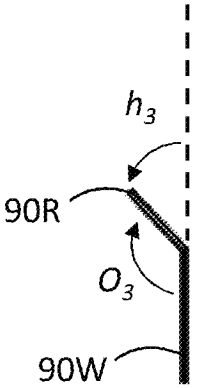
Figure 39C:
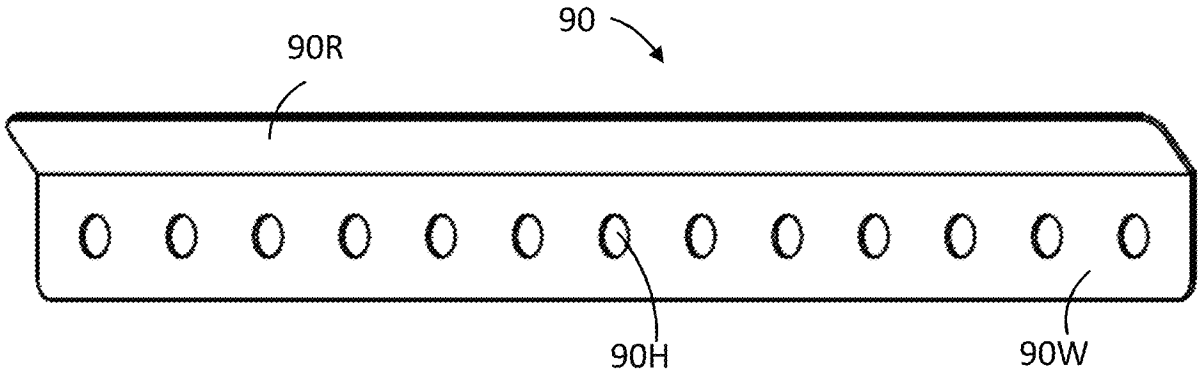
Figure 40:
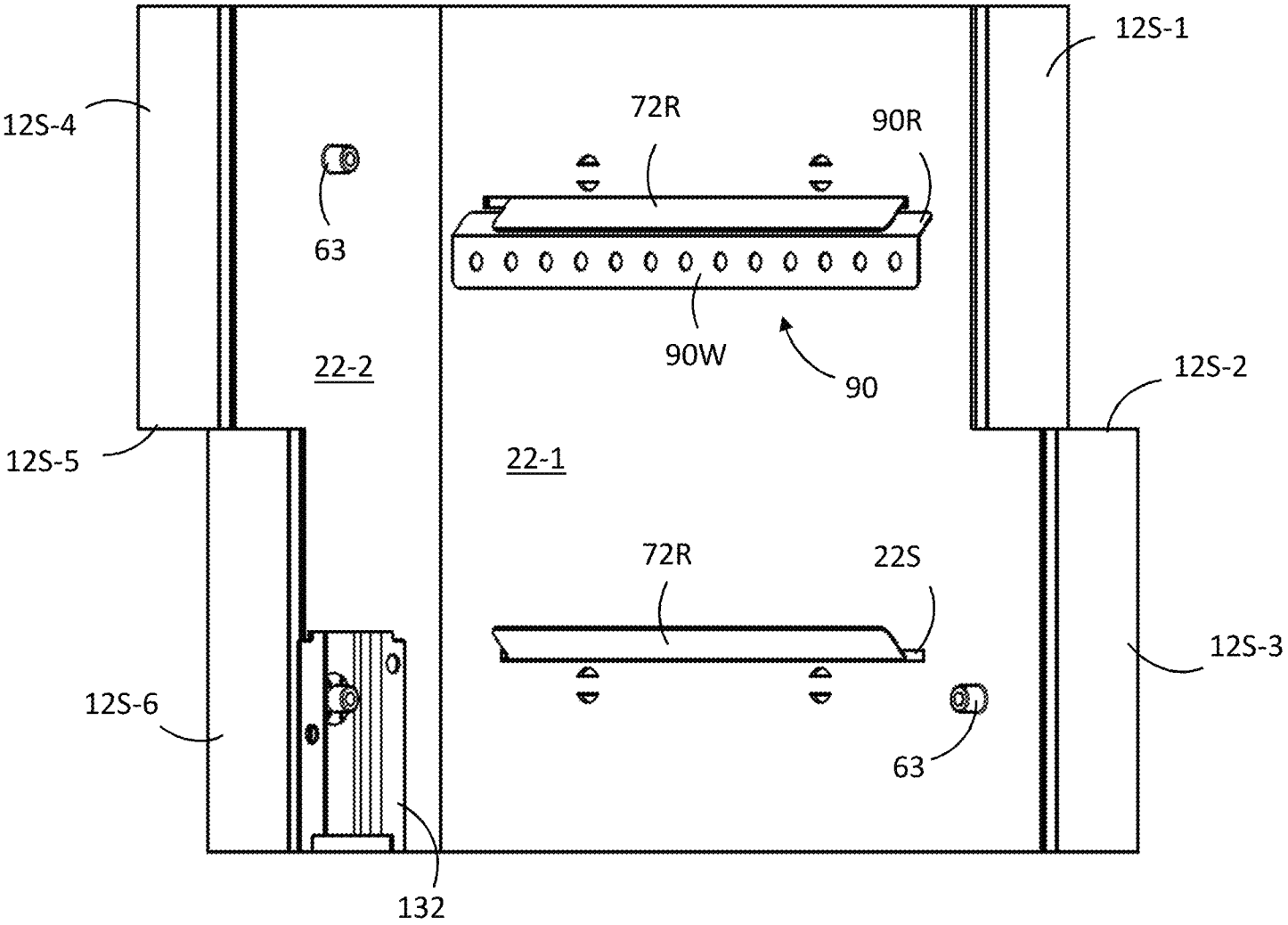
FIG. 40 is a rear view of a veneer corner configured with a backing and hanger according to the invention—shown with the mounting rail of FIG. 39A-39C and the female push fasteners of FIG. 8A-8C used for installation on a building corner according to the invention.

FIG. 39A-39C illustrate mounting rail 90 configured for use with a veneer panel or corner fabricated with backing 22 and three-section mounting member 72. FIG. 39A provides a front view, FIG. 39B provides a side view and FIG. 38C provides a right perspective view of mounting rail 90. Mounting rail 90 has an elongated structure with an upper, generally planar hanging rail section 90R adjoining a lower wall fastening section 90W. Lower wall fastening section 90W is a mounting flange configured with a plurality of fastening holes for securing mounting rail 90 to a building surface with one or more fasteners such as a nail, screw or bolt. Hanging rail section 90R adjoins wall fastening section 90W to form a third obtuse structural angle of about 135 degrees. As such, when fastened to a building surface, hanging rail section extends upwardly and outwardly to form a hanging angle of about 45 degrees from the building surface above where mounting rail 90 is secured (FIG. 39B). As used herein, the term "hanging angle," used in reference to a mounting rail of the invention, refers to the angle that is supplementary to the structural angle, the structural angle being the angle formed between wall fastening section and hanging rail section of a mounting rail of the invention. Though fabricated with a bend of 135 degrees and a hanging angle of about 45 degrees, a mounting rail of the invention for use with a veneer panel or corner fabricated with backing 22 and three-section mounting member 72 can have an acute hanging angle less than 90 degrees, such as, without limitation, about 5 degrees, about 15 degrees, about 25 degrees, about 35 degrees, about 45 degrees, about 55 degrees, about 65 degrees, about 75 degrees, about 85 degrees. As such, the mounting rail can be fabricated with an obtuse structural angle or bend of greater than 90 degrees, for example, about 95, about 105, about 115, about 125, about 135, about 145, about 155, about 165, or about 175 degrees between wall fastening section 90F and hanging rail 92R. FIG. 40 provides a rear view of an assembly illustrating the relative position of veneer corner 2 in operation with mounting rail 90 and female push connector 132, mounting rail 90 and female push connector 132 being installed on a building surface prior to mounting of veneer corner 2.

Additional Embodiments

Though backing 22 is configured with two sets of mounting components (i.e. three-section mounting member 72, horizontally extending slot 22S with two mounting member attachment means 82, and stop 22P) for use in two orientation as discussed herein, a backing of the invention can be fabricated with one set of mounting components positioned any distance from a horizontal edge of the backing. Where configured with two sets of mounting components as is the case for backing 22, the two sets of mounting components are typically disposed at similar distances from the nearest peripheral edge of a pair of opposite and parallel peripheral edges.

As discussed above, a backing of the invention is configured with a hinge joining primary backing section and a secondary backing section. As such, the backing can be employed to support a veneer panel with any angle though adjustment of the respective positions of the primary and secondary backing sections about the hinge.

Three-section mounting member 72 is configured with an anchoring fin that has twelve evenly spaced openings, a three-section mounting member provided by the invention can be fabricated with an anchoring fin that has any number of openings or no openings. Where the anchoring fin can have one or more openings, which can be uniformly spaced or spaced in select positions on the anchoring fin. The anchoring fin can be of a similar size, a larger size or a smaller size relative to the backing attachment mid-section or hanger section. A three-section mounting member of the invention can include two, three, four or more anchoring fins each with any number of openings or means for improving retention in the veneer body including anchor protrusions as shown in a frame of the invention. A anchoring fin of the invention can be configured with any regular or irregular shape including trapezoidal, triangular, rectangular. Though three-section mounting member 72 is configured with two keyhole cutouts, a three-section mounting member of the invention can have one, two or three keyhole cutouts as convenient. The mounting rail for use with the three-section mounting member 72 can include a mounting flange with any convenient number of fastening holes.

The frame, backing, reinforcement member, mounting member, mounting rail, connectors, mounting strip, orthogonal support member or any component of the veneer panel of the invention can be made of a metal, metal alloy, steel, moldable polymeric material, resins or other materials known to those of skill in the art including, without limitation, metals, metal alloys, pot metals, steel, elastomers, thermoplastics or thermosetting polymers. Examples of moldable polymeric materials include, without limitation, thermoplastics such as polyester resin, acetal resin, nylon resin and other engineering-type thermoplastics such as acetals. Additional examples include: a urethane composite, ultra-high-molecular-weight polyethylene (UHMWPE), Nylon 6, Nylon 6-6, polytetrafluoroethylene (PTFE/Teflon), acrylonitrile butadiene styrene (ABS), polycarbonates (PC), polyamides (PA), polybutylene terephthalate (PBT), polyethylene terephthalate (PET), polyphenylene oxide (PPO), polysulphone (PSU), polyetherketone (PEK), polyetheretherketone (PEEK), polyimides, polyphenylene sulfide (PPS), polyoxymethylene plastic (POM/Acetal), high-density polyethylene, polyvinyl chloride, low-density polyethylene, polypropylene, polyamides, acrylonitrile butadiene styrene, polycarbonate/acrylonitrile butadiene styrene, and polyetheretherketone. Thus, a thermoplastic such as nylon, polyethylene and polystyrene, a thermoset such as epoxy and phenolic, or an elastomer can be used.

IV. Methods of Manufacturing

Figure 47:
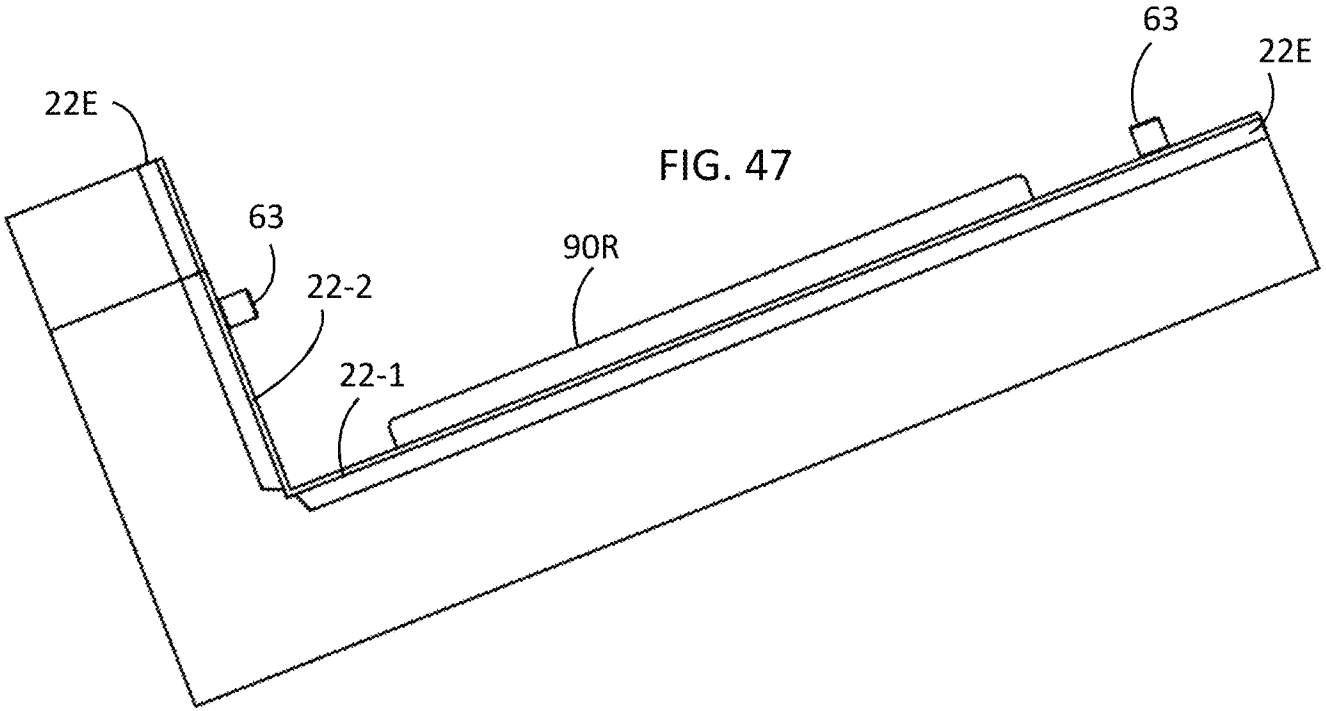
FIG. 47 is a side view of a V-shaped mold in which the backing shown in FIG. 35 has been installed for fabrication of a veneer corner according to the invention.

FIG. 47 provides a side view of backing 22 within a mold for preparing a veneer corner of the invention. The traditional method for manufacturing a veneer corner can be labor intensive as a mold cavity is first filled with an excess amount of concrete, which is then troweled to screed the concrete down to the surface of the mold and into the corner during vibration. In such a process, lower slump concrete mixes are used and excess material are troweled away after the mold cavity is filled.

A corner backing subassembly or frame subassembly provided by the invention enables for a more efficient manufacturing process for a veneer panel or corner. FIG. 35-37 provides an example of a backing a subassembly for a corner.

The term "backing subassembly," as used herein, refers to a single section or two-section backing with raised peripheral edges in combination with a three-section mounting member having a hanger section, a backing attachment mid-section and an anchoring fin, the hanger extending through a slot in the backing rearwardly for installation on a building surface, the backing attachment mid-section being secured to the side of the backing facing the veneer body within the setting space defined by the backing and raised peripheral edges of the backing thereby enabling the anchoring fin to extend into a mole cavity and become embedded in the veneer body during the manufacturing process.

The term "frame subassembly," as used herein, refers to a frame, optionally in combination with a reinforcement member having a reinforcement section with a plurality of fastening holes and at least one anchoring fin. The frame is has a horizontally extending J-shaped fastening member defining a top of the frame, a horizontally extending flange defining the bottom of the frame, and one or more connecting ribs extending between the J-shaped fastening member and the flange. The optional reinforcement member having a reinforcement section that is secured to the rear of the horizontally extending J-shaped fastening member to reinforce the fastening member and at least one anchoring fin extending forwardly at an angle below the J-shaped fastening member into the mold cavity to be embedded in the veneer body during the manufacturing process. FIGS. 43 and 44, for example, illustrate a frame subassembly with the additional mounting strip (102 in FIG. 43 and 136 in FIG. 44) with which the frame subassembly operates during installation. Thus, mounting strip, for example, 102 and 136, are secured to a building surface prior to installation and are not typically part of the frame subassembly for manufacturing.

The veneer corner backing subassembly illustrated in FIG. 35-36 as well as frame-reinforcement member subassembly shown in FIG. 43-44 (without mounting strip 136) can be pre-assembled prior manufacturing the veneer panel or corner.

In the manufacturing process provided by the invention, a predetermined volume of concrete is poured into a mold cavity. A backing subassembly is introduced from above. It is set vertically into the mold cavity during the vibration cycle in the orientation shown in FIG. 47 for the backing subassembly. As the frame or backing subassembly is pressed into the mold cavity, displacement causes the concrete to completely fill the cavity. Where a backing subassembly is used, the solid backing completely encloses the mold cavity, and as such, it captures and holds the wet concrete in place in the mold during curing. Through the manufacturing process, the subassembly becomes an integral part of the universal veneer corner, the anchoring fins of the subassembly being anchored into the concrete. This process does not require the step of troweling away excess material and avoids use of excess concrete. A veneer panel and corner of the invention can be manufactured more efficiently as the process requires less concrete and labor.

Where a frame is used in a veneer panel or panel with a corner, a frame subassembly can be formed and then set into the mold cavity such that: (1) the rear of the frame shown in FIG. 21 is oriented upwards and viewable from above the mold cavity, (2) the orthogonal support members, e.g. 60 and 63, extending out of the mold cavity, (3) the J-shaped fastening member (e.g. 30, 33) and flange (e.g. 50, 53) in positions just above the mold cavity; and (4) the connecting ribs (e.g. 40M) in the mold cavity with rib end portions (e.g. 40T-1 and 40B-1, 40T-2 and 40B-2) extending from within the mold cavity to positions above the mold cavity to maintain J-shaped fastening member and flange above the mold cavity. Where a two-section reinforcement member is used, its reinforcement section is secured to the rear of J-shaped fastening member and visible from above as shown in FIG. 20 and its anchoring fin extending into the mold cavity.

IV. Mating Connector

Figure 41B:
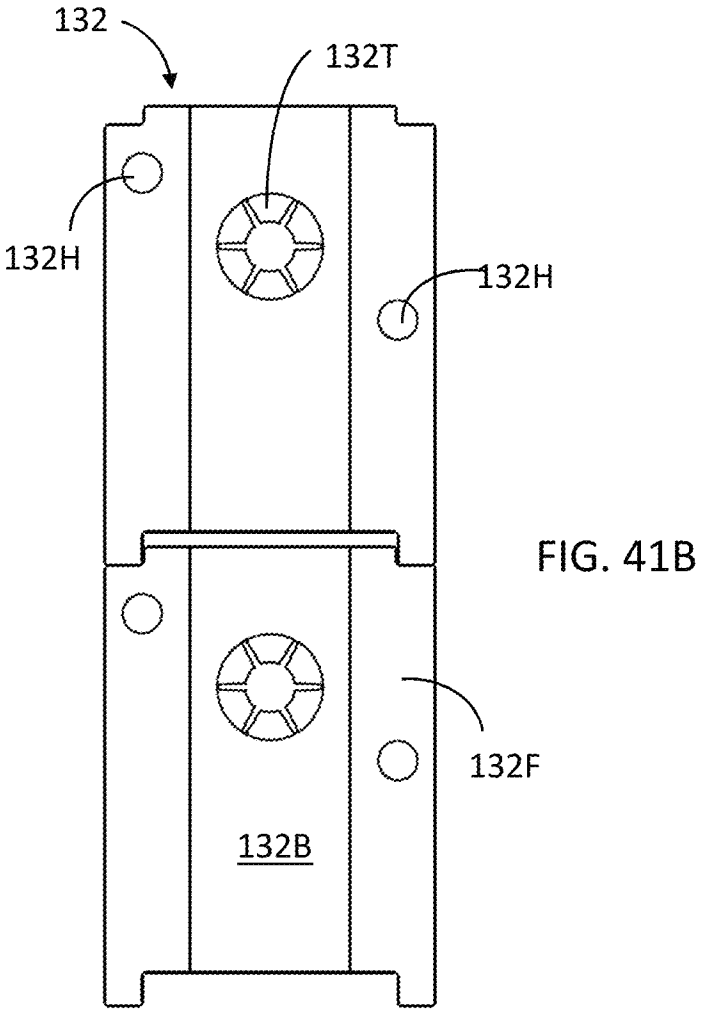
FIG. 41A-41B are a perspective view and a rear view of another embodiment of a mounting strip according to the invention.
Figure 41A:
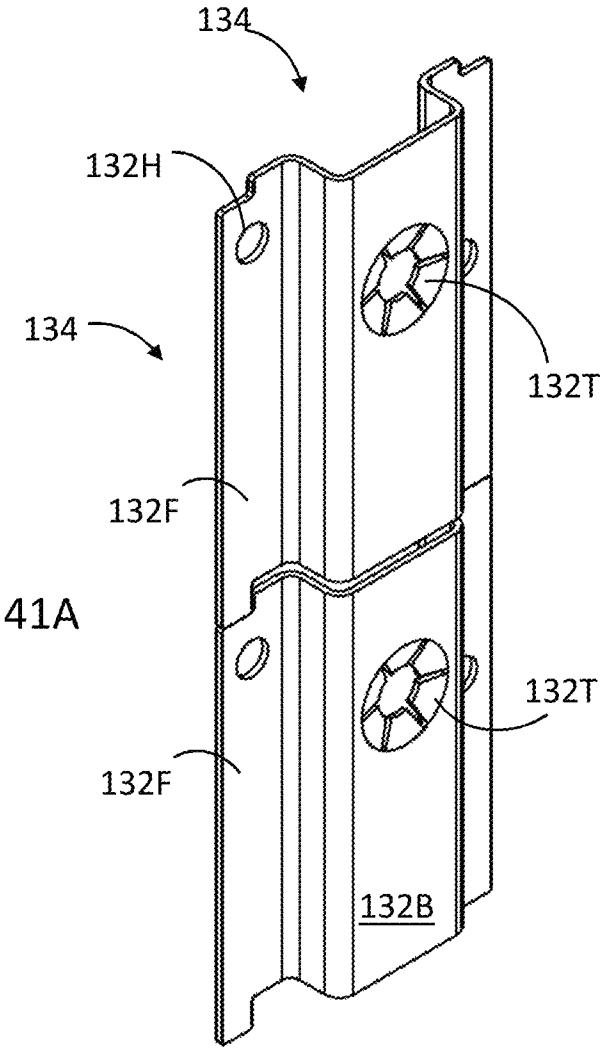
Figure 42B:
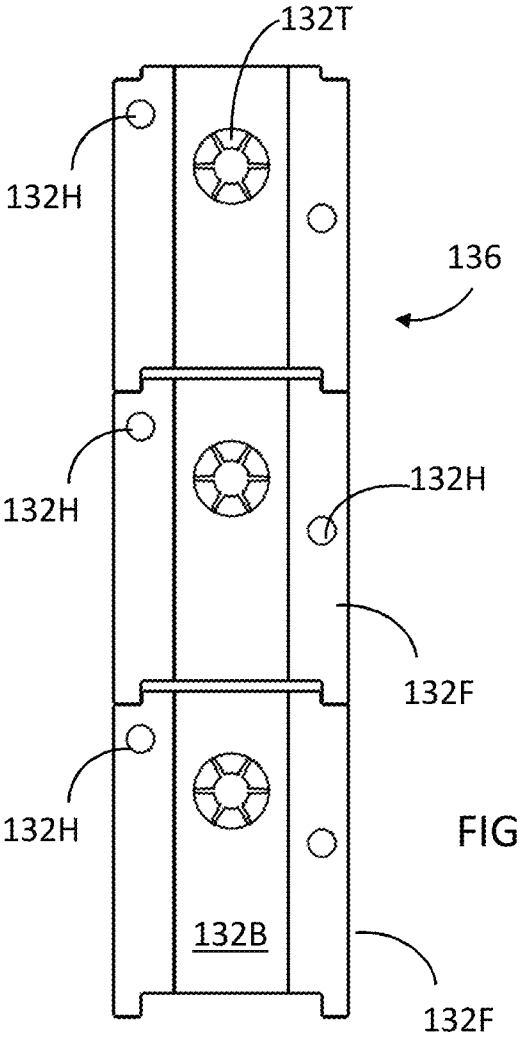
FIG. 42A-42B are a perspective view and a rear view of another embodiment of a mounting strip according to the invention.
Figure 42A:
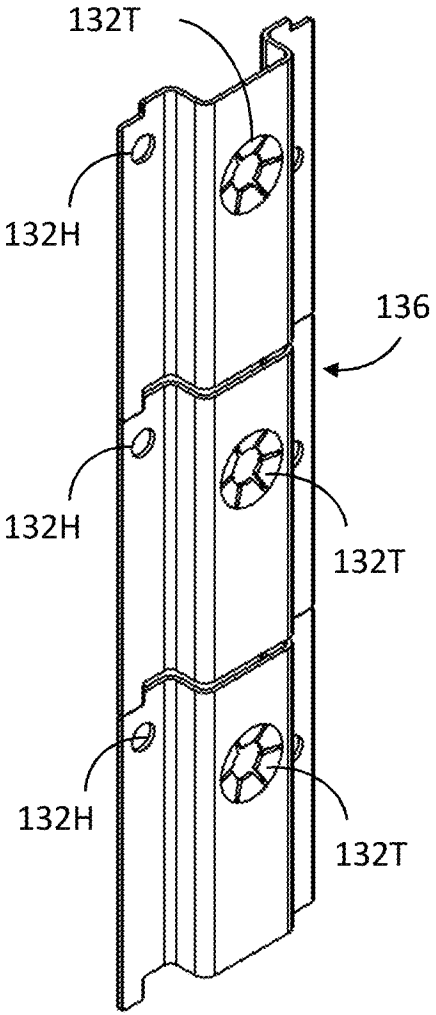
Figure 45:
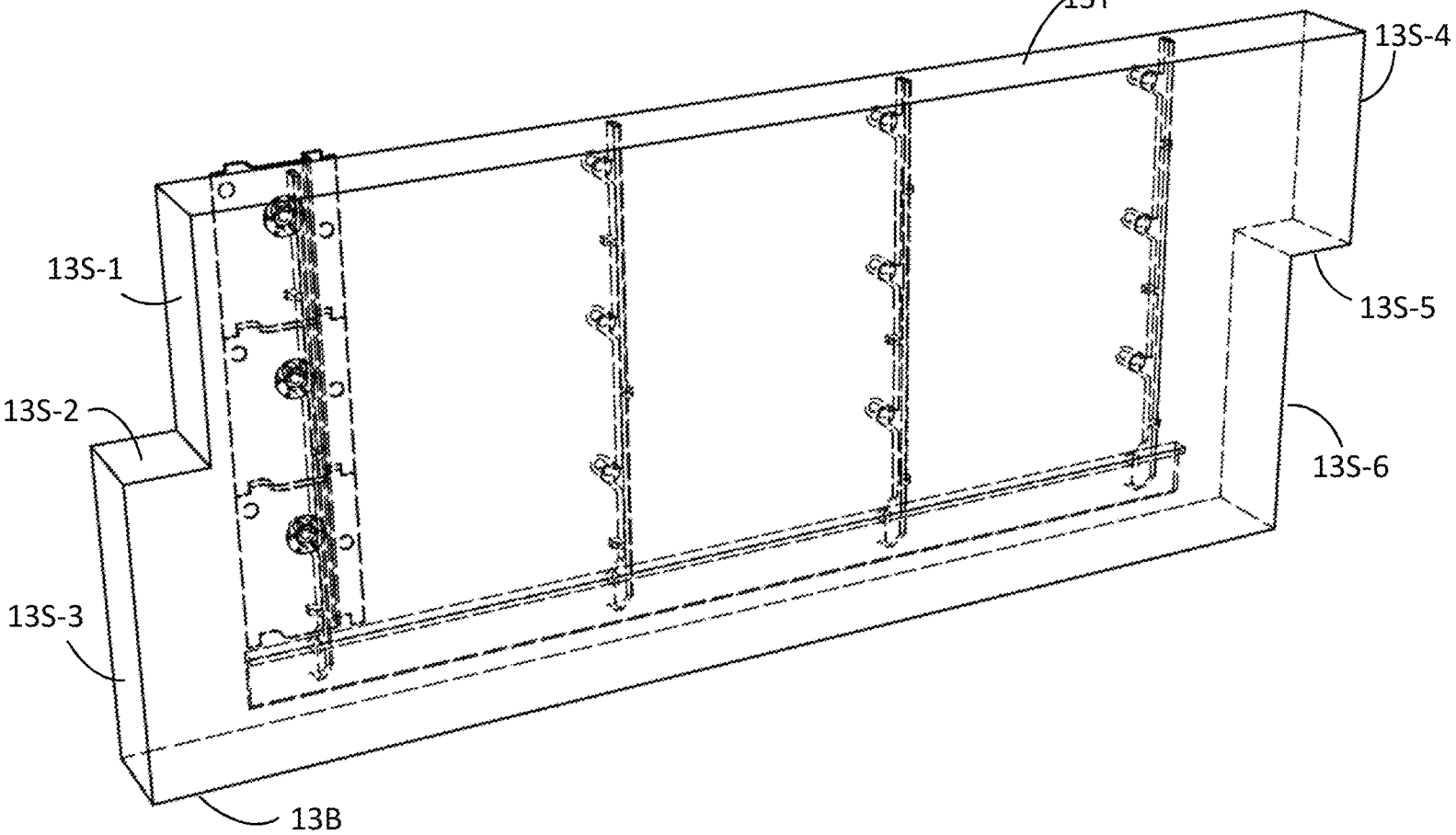
FIG. 45 is a diagram illustrating the body of the veneer panel of FIG. 5 shown with the encased frame of FIG. 22 and mounting strip of FIG. 42A-42B attached at the rear in broken lines.
Figure 46:
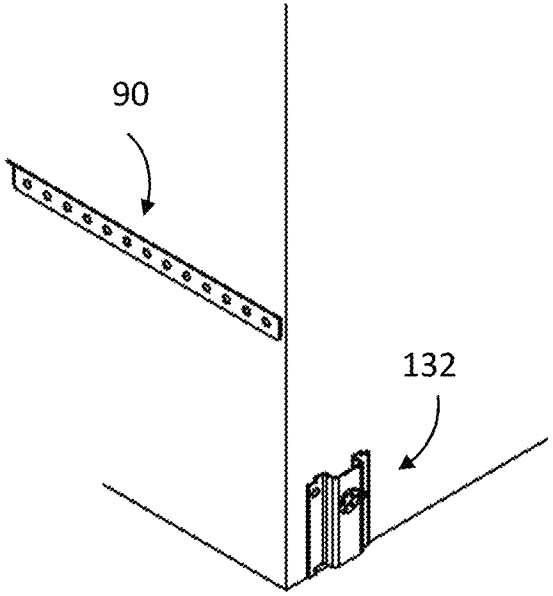
FIG. 46 is a perspective view of a portion of a building corner to which are affixed the two-section mounting rail shown in FIG. 39A-39C and the push fastener shown in FIG. 8A-8C in preparation for installation of a veneer corner according to the invention.

Snap connector 102 (FIG. 4A-4C) and push connector 132 (FIG. 8A-8C) represent the female component of a pair of mating connectors that can be utilized to secure a veneer panel or corner of the invention to a building surface. A plurality of snap connector 102 can be integrally formed on a mounting strip as exemplified by mounting strip 100 shown in FIG. 4A-4C. Similarly, a plurality of push connector 132 can be formed in series on a strip as exemplified by FIGS. 41A-41B and 42A-42B. FIG. 41A-41B provides a front perspective view and a rear view, respectively, of push connector mounting strip 134 formed as a vertical series of two push connector 132. FIG. 42A-42B provides a front perspective view and a rear view, respectively, of push connector mounting strip 136 formed as a vertical series of three push connector 132. FIGS. 43 and 44 provide a front perspective view illustrating the use of mounting strip 102 and 136 with frame 20 and 23, respectively. FIG. 45 provides a front perspective view illustrating the position of embedded frame 23 in a veneer panel and in operation with mounting strip 136. FIG. 46 provides a view of mounting rail 90 and push in connector 132 pre-mounted on adjoining building surfaces in anticipation of installation of a veneer corner of the invention. As shown, mounting rail 90 is secured to a first surface and push in connector 132 is secured to a second surface orthogonal to the first to support a veneer corner configured with a hanger on the primary orthogonal section and a push connector on the second orthogonal section.

A mounting strip provided by the invention can have two or more connectors of a pair of mating connectors. As exemplified by mounting strip 102 (FIG. 4A-4C), a mounting strip of the invention can be formed with a male member and a female member of a pair of mating connector. A mounting strip of the invention can be formed with a male member of a mating pair and two, three or more than three female members of the same pair of mating connector. Mounting strip 102, for example, is formed with a male member of a mating pair and three uniformly spaced female members of the same pair of mating connectors. Mounting strip 102 is formed with trim lines 104 to facilitate on site cutting of mounting strip 102 to subunits as is convenient during installation. A mounting strip of the invention can be formed with a plurality of male member of a mating pair or a plurality of female members of the same pair of mating connector. Mounting strip 134 and 136, for example, are formed with two and three female connectors, respectively.

Figure 4D:
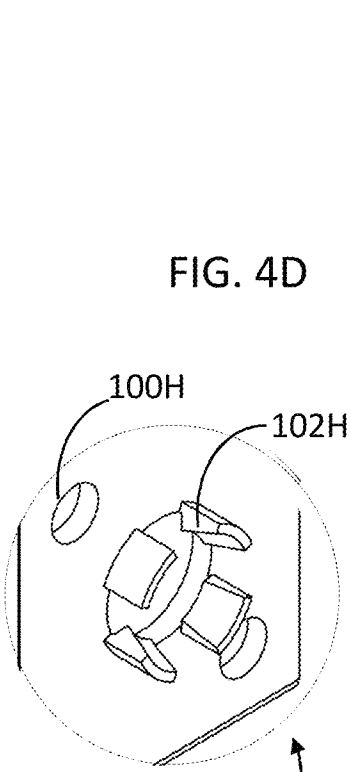
FIG. 4A-4D are a perspective view (4A), a front view (4B) a side view (4C) and an enlarged view (4D) of a mounting strip according to the invention.
Figure 4C:
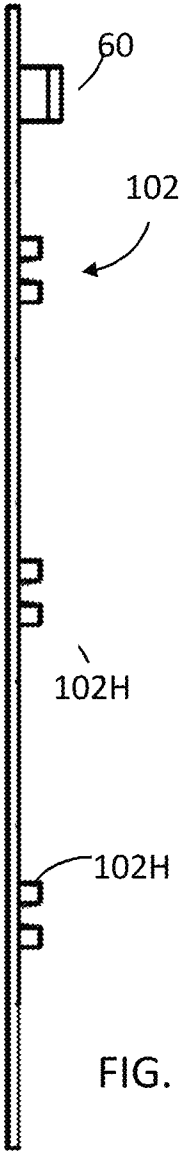
Figure 4B:
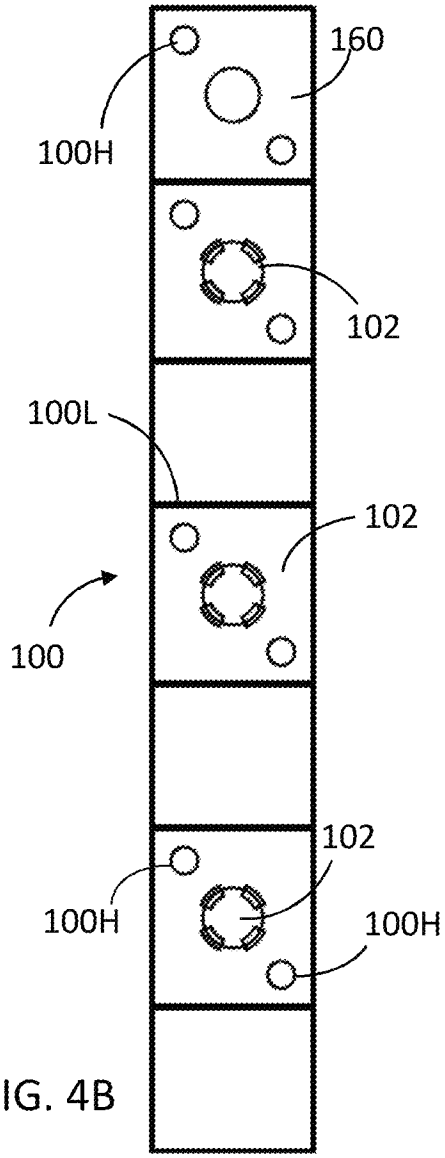
Figure 4A:
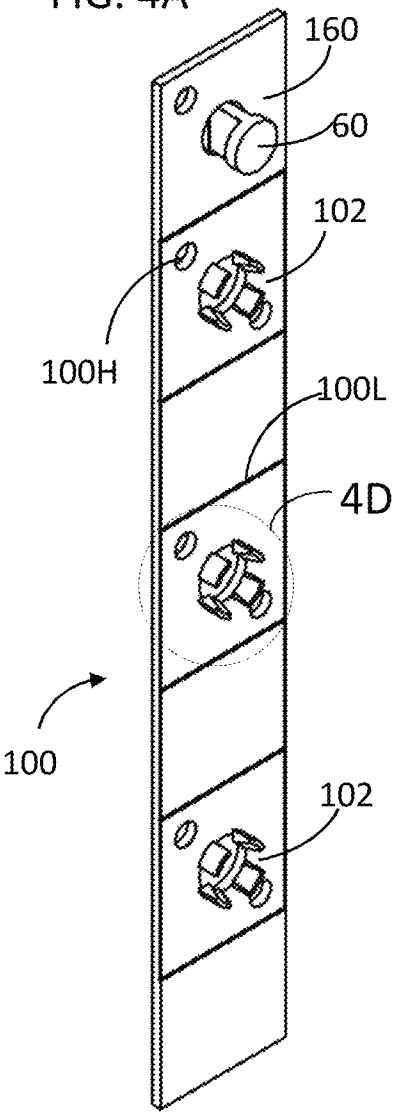

In some embodiments, the mounting strip has a flat body supporting the male or female connector (60, 102) and having fastening holes for securing to a building surface as exemplified by mounting strip 102 illustrated in FIG. 4A-4C. In some embodiments, the mounting strip is configured with a raised body supporting a female connector of a pair of mating connectors. The raised body forms a housing for receiving the male connector of the pair of mating connectors. Mounting strips 134 and 136 are examples of mounting strips configured with a raised body, i.e. 132B, that supports a female connector formed by radial tabs 132T. The raised body can be any shape. The raised body can simply include opposing sides that are angled from a mounting flange such as flange 132F thereby offsetting the female connector with respect to the mounting flange to recreate a chamber for receiving the male connector. The raised body can be in the form of a housing with a circular cross-section extending from the mounting flange. In these embodiments, the radial retention tabs forming the female connector is disposed in the housing, and as such, the housing serves to position the radial retention tab in a position offset from the plane of the mounting flange thereby forming cavity for receiving the male connector.

While the invention has been described in conjunction with the detailed description, the foregoing description is intended to illustrate and not limit the scope of the invention defined by the claims. Modification and variation of the concepts herein disclosed may be resorted to by those skilled in the art, and such modifications and variations are considered to be within the scope of this invention. The invention has been described broadly and generically herein. Each of the narrower species and sub-generic groupings falling within the generic disclosure form part of the invention.

As used herein and in the appended claims, the singular forms "a," "an," and "the" include the plural unless the context clearly dictates otherwise. As used herein, the term "about" in reference to a numeric value means within 10% of the numeric value.

What is claimed is:

1. A veneer panel comprising:

(a) a veneer body having a front face, a rear face and an intermediate thickness therebetween, the intermediate thickness defining a first and a second opposite plane parallel side; and (b) a frame partially embedded in the intermediate thickness of the veneer body, the frame comprising:

(i) an exposed, elongated J-shaped fastening member at a rear edge of the first opposite plane parallel side, the J-shaped fastening member comprising a tall planar rear section, a short planar forward section, and a base section joining the tall planar rear section to the short planar forward section to form a groove, the tall planar rear section comprising a first fastening hole for securing the veneer panel to a surface;

(ii) an exposed, elongated flange at a bottom edge of the rear face of the veneer body, the flange comprising a plane which is between the plane of the tall planar rear section and the plane of the short planar forward section of the J-shaped fastening member, thereby enabling the flange to rest in the groove of a second J-shaped fastening member above which the veneer panel is mounted;

(iii) a connecting rib connecting the J-shaped fastening member and the flange, the connecting rib comprising:

a. a rib body section embedded in the intermediate thickness of the veneer body, b. a first rearward-angled rib end portion connecting an embedded first end of the rib body section and the J-shaped fastening member, c. a second rearward-angled end portion connecting an embedded second end of the rib body section and the flange, and d. an exposed orthogonal support member extending rearwardly from the connecting rib, the orthogonal support member comprising a first mating connector of a pair of mating connectors.

2. The veneer panel of claim 1, further comprising a two-section reinforcement member, wherein the two-section reinforcement member comprises:

(a) an exposed reinforcement section secured to the rear of the tall planar rear section of the J-shaped fastening member, the exposed reinforcement section comprising a second fastening hole that aligns with the first fastening hole on the tall planar rear section of the J-shaped fastening member; and (b) an anchoring fin adjoining the exposed reinforcement section at a first angle, the anchoring fin being embedded within the intermediate thickness of the veneer body, the anchoring fin comprising an opening which comprises veneer body material.

3. The veneer panel of claim 2, wherein the two-section reinforcement member is secured to the J-shaped fastening member through engagement of a flexural frame connector on the two-section reinforcement member with an undercut or cutout on the J-shaped fastening member.

4. The veneer panel of claim 3, wherein the flexural frame connector comprises a foldable tab or a hook.

5. The veneer panel of claim 2, wherein the tall planar rear section of the J-shaped fastening member comprises a plurality of the first fastening hole.

6. The veneer panel of claim 5, wherein the exposed reinforcement section comprises a plurality of the second fastening hole, and wherein the second holes in the plurality of the second fastening hole and that in the plurality of the first fastening hole are similarly spaced such that each hole in the plurality of the second fastening hole aligns with a hole in the plurality of the first fastening hole.

7. The veneer panel of claim 5, wherein the tall planar rear section of the J-shaped fastening member comprises a plurality of vertically extending ridges effective to maintain clearance between the tall planar rear section of the J-shaped fastening member and a flange of another veneer panel resting in the groove of the J-shaped fastening member, each vertically extending ridge separating two or more fastening holes of the plurality of the first fastening hole.

8. The veneer panel of claim 1, wherein the first mating connector is a male connector.

9. The veneer panel of claim 1, wherein the first mating connector is a snap connector that comprises a notch or a push connector that comprises a cylindrical head.

10. The veneer panel of claim 1, wherein the frame comprises a plurality of the connecting rib, a plurality of the orthogonal support member, or a plurality of the connecting rib and a plurality of the orthogonal support member.

11. The veneer panel of claim 1, wherein the frame comprises two, three or four of the connecting rib, each of which comprises one, two or three of the orthogonal support member.

12. The veneer panel of claim 2, wherein the frame comprises a polymeric material, the two-section reinforcement member comprises a metal, a metal alloy or steel, the veneer body comprises concrete, or any combination thereof.

13. The veneer panel of claim 1, wherein the veneer body comprises a first body section and a second body section that adjoin to form a right-angle body corner.

14. The veneer panel of claim 13, wherein the first body section, the second body section, or each of the first body section and the second body section comprises the frame.

15. The veneer panel of claim 14, wherein a two-section reinforcement member is secured to the J-shaped fastening member of the frame in the first body section, the second body section, or each of the first body section and the second body section, wherein the two-section reinforcement member comprises:

(a) an exposed reinforcement section secured to the rear of the tall planar rear section of the J-shaped fastening member, the exposed reinforcement section comprising a second fastening hole that aligns with the first fastening hole on the tall planar rear section; and (b) an anchoring fin adjoining the exposed reinforcement section at a first angle, the anchoring fin being embedded within the intermediate thickness of the veneer body, the anchoring fin comprising an opening which comprises veneer body material.

16. The veneer panel of claim 13, wherein the first body section comprises a first front face and the second body section comprises a second front face, and wherein the first front face and the second front face orient in diverging directions thereby forming a veneer corner effective for installation on an outside corner.

17. The veneer panel of claim 13, wherein the first body section comprises a first front face and the second body section comprises a second front face, and wherein the first front face and the second front face orient in converging directions thereby forming a veneer corner effective for installation on an inside corner.

18. The veneer panel of claim 1, wherein the J-shaped fastening member, the flange, the connecting rib and the orthogonal support member are integrally formed parts of the frame.

19. The veneer panel of claim 15, wherein the tall planar rear section of the J-shaped fastening member of the frame in the first body section, the second body section, or each of the first body section and the second body section comprises a plurality of the first fastening hole.

20. The veneer panel of claim 19, wherein the exposed reinforcement section comprises a plurality of the second fastening hole, and wherein the holes in the plurality of the second fastening hole and that in the plurality of the first fastening hole are similarly spaced such that each hole in the plurality of the second fastening hole aligns with a hole in the plurality of the first fastening hole.

* * * * *